United States Patent [19]

Aoki et al.

[11] Patent Number: 4,489,636

[45] Date of Patent: Dec. 25, 1984

[54] ELECTRONIC MUSICAL INSTRUMENTS HAVING SUPPLEMENTAL TONE GENERATING FUNCTION

[75] Inventors: Eiichiro Aoki; Iwao Higashi, both of Hamamatsu, Japan

[73] Assignee: Nippon Gakki Seizo Kabushiki Kaisha, Hamamatsu, Japan

[21] Appl. No.: 493,711

[22] Filed: May 11, 1983

[30] Foreign Application Priority Data

May 27, 1982 [JP] Japan ..... 57-88746
May 27, 1982 [JP] Japan ..... 57-88747

[51] Int. Cl.[3] ..... G10H 1/38; G10H 7/00

[52] U.S. Cl. ..... 84/1.01; 84/DIG. 2; 84/DIG. 22

[58] Field of Search ..... 84/1.01, 1.03, DIG. 2, 84/DIG. 22

[56] References Cited

U.S. PATENT DOCUMENTS 4,381,689 5/1983 Oya ..... 84/1.01

FOREIGN PATENT DOCUMENTS 72213 6/1977 Japan .

*Primary Examiner*—S. J. Witkowski

*Attorney, Agent, or Firm*—Spensley Horn Jubas & Lubitz

[57] ABSTRACT

An electronic musical instrument which produces counter melody automatically selects one from among chord constituting tones in a predetermined priority order and produces a tone of the same note as the selected tone as a counter melody tone. This electronic musical instrument further comprises a chord type detector for detecting a chord type of a performed chord besides a chord designation detector for detecting the fact that the chord has been designated, a counter melody tone determining circuit for selecting one from among the chord constituting tones and sound system for producing the counter melody tone. The predetermined priority order is determined in accordance with the detected chord type. This dependence on chord type make it possible to produce a counter melody tone which is more rich in music.

16 Claims, 31 Drawing Figures

ELECTRONIC MUSICAL INSTRUMENTS HAVING SUPPLEMENTAL TONE GENERATING FUNCTION

BACKGROUND OF THE INVENTION

This invention relates to an electronic musical instrument that automatically performs such a supplemental tone as a counter melody tone.

One example of a prior art electronic musical instrument that automatically performs a counter melody tone together with an accompaniment chord is disclosed in Japanese patent preliminary publication No. 77213/1977. In the electronic musical instrument disclosed therein a specific one from among the chord constituting tones, which has a consonant relation with a melody tone, is selected when the chord has changed so as to produce the selected chord constituting tone as a counter melody tone.

The counter melody tone should be in harmony with a melody tone, and its tone pitch should vary smoothly and slowly corresponding to the progression of the melody tones and should vary like a wave on the whole thereby to modifying the melody tone such that it is heard as a deep and rich accompaniment tone.

With the prior art electronic musical instrument, however, since such specific tones as the root or the 3rd degree tone from among chord constituting tones is selected as the counter melody tone as above described, the same counter melody tone repeats many times in case of the same chord succession in a music so that the performed music would become monotonous and lack variety. On the contrary, the counter melody tones change too frequently in case that chords changes frequently, thus disturbing the flow of the music. In any above-described case, the inherent function of the counter melody tone can not be sufficiently manifested.

To solve these problems, one of the inventors has proposed an electronic musical instrument disclosed in U.S. patent application Ser. No. 250,089 filed on Apr. 1, 1981 now U.S. Pat. No. 4,470,332, assigned to Nippon Gakki Co., Ltd. the same assignee as the present application, in which a specific tone utilized as the counter melody tone in relation to an accompaniment chord is not fixed but instead a specific tone utilized as the counter melody tone is varied with a specific motion pattern.

However, this method too does not consider the motions of the music and the chord so that the produced music lacks naturality.

SUMMARY OF THE INVENTION

The principal object of this invention is to provide an electronic musical instrument capable of automatically performing such a supplemental tone as a counter melody tone in more consonant relation to a melody tone than a prior art instrument.

To attain this object according to this invention, one of the chord constituting tones is selected according to a predetermined order of priority and a tone of the same note as that of the selected chord constituting tone is generated as the supplemental tone.

According to this invention, there is provided an electronic musical instrument comprising chord designating means for designating a chord, chord type detecting means for detecting a chord type of the chord designated by said chord designation means, chord designation detecting means for detecting the fact that said chord has been designated, tone selecting means for selecting, in response to the detection of said fact, one from among a group of tones in priority order determined by said chord type, said group comprising the chord constituting tones of said chord, and tone producing means connected to said chord designating means and said tone selecting means for producing a chord tone and a supplemental tone corresponding to said chord and said selected tone respectively.

BRIEF DESCRIPTION OF THE DRAWINGS

In the accompanying derawings.

DESCRIPTION OF THE PREFERRED EMBODIMENTS

Figure 1:
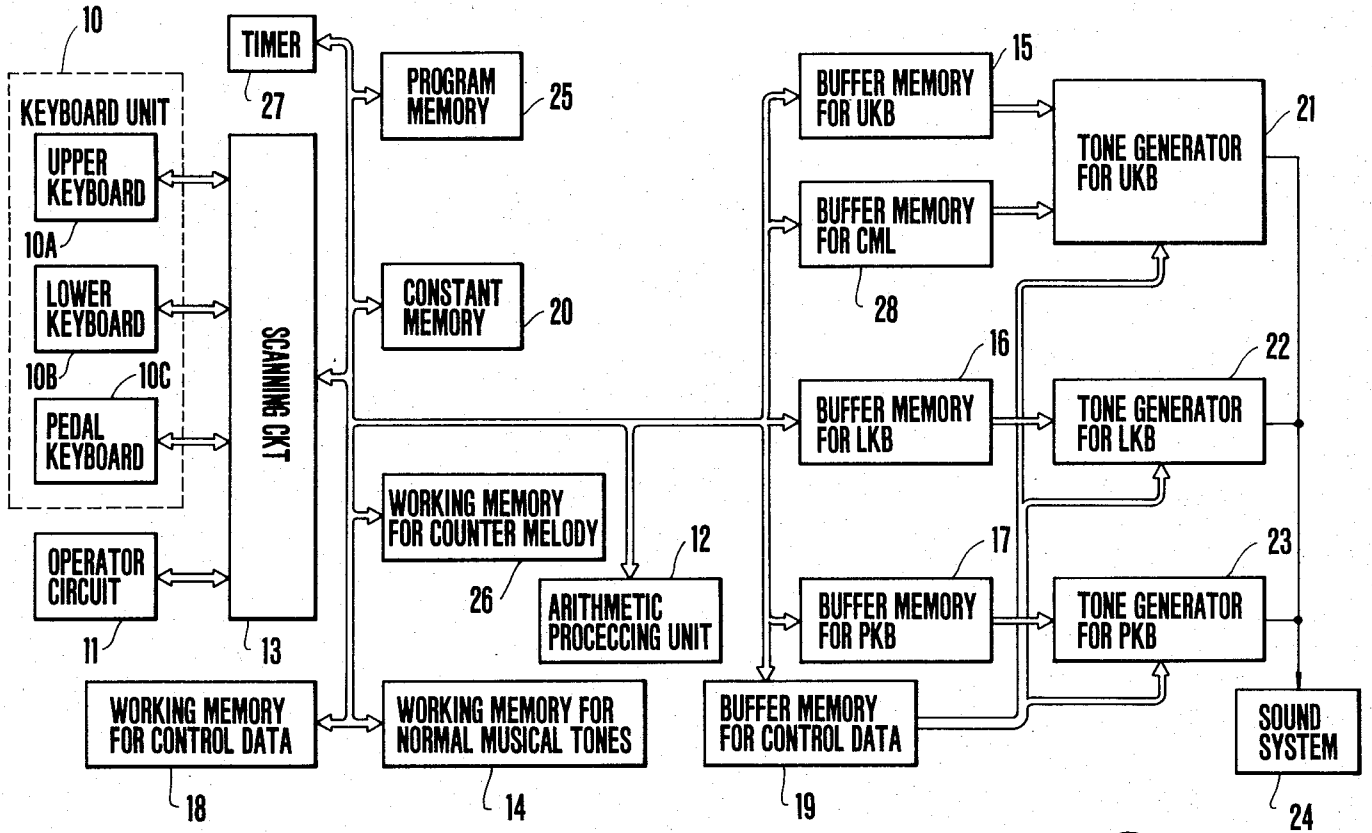
FIG. 1 is a overall block diagram showing one embodiment of an electronic musical instrument of this invention.

A preferred embodiment of the electronic musical instrument according to this invention and shown in FIG. 1 comprises a keyboard unit 10 including an upper keyboard 10A, a lower keyboard 10B and a pedal keyboard 10C. Usually, for a melody performance the upper keyboard 10A is used, whereas for an accompaniment (chord), the low keyboard 10B is used. Adjacent the keyboard unit 10 is disposed an operator circuit 11 including a finger code mode selection switch which selects a finger code mode or a single finger mode for an auto-bass/chord performance, a counter melody control mode switch for controlling whether a counter melody tone is to be produced or not, and an operator circuit 11 for controlling the color and volume of a musical tone corresponding to a depressed key of each of the keyboards.

The ON/OFF states of the depressed keys of the keyboard unit 10, the ON/OFF state or the quantity of the operation of each operator of the operator circuit 11 are detected by a sequential scanning effected by a scanning circuit 13 under the control of an arithmetic processing unit 12.

When an ON state key is detected as a result of the sequential scanning, a key code KC representing the detected key would be stored in corresponding one of memory areas corresponding to respective keyboards of a working memory device 14 for normal musical tones. Upon detection of an ON state operator, a flag information representing the ON state of the detected operator would be stored in corresponding one of memory areas corresponding to respective keyboards of a working memory device 18 for control data. At the same time, the operation quantity of a volume operator or the like set as an analogue quantity is converted into a digital value which is stored in the corresponding memory area.

In this case, each of the key codes KC representing the keys of respective keyboards is constituted by an octave code OC representing an octave tone region and a note code NC representing a note name as shown in the following Table I.

TABLE I

| Octave | | OC |
|---|---|---|
| First Octave | (C1-B1) | 0 0 1 |
| Second Octave | (C2-B2) | 0 1 0 |
| Third Octave | (C3-B3) | 0 1 1 |
| Fourth Octave | (C4-B4) | 1 0 0 |
| Fifth Octave | (C5-B5) | 1 0 1 |
| Sixth Octave | (C6) | 1 1 0 |

| Note | NC | Decimal notation |
|---|---|---|
| C | 0 0 0 1 | 1 |
| C# | 0 0 1 0 | 2 |
| D | 0 0 1 1 | 3 |
| D# | 0 1 0 1 | 5 |
| E | 0 1 1 0 | 6 |
| F | 0 1 1 1 | 7 |
| F# | 1 0 0 1 | 9 |
| G | 1 0 1 0 | 10 |
| G# | 1 0 1 1 | 11 |
| A | 1 1 0 1 | 13 |
| A# | 1 1 1 0 | 14 |
| B | 1 1 1 1 | 16 |

Where a key or operator which has been in an ON state till previous scanning is found to be in an OFF state as a result of a present scanning, the key code KC or the flag information of this key or operator is erased. Accordingly, a key code representing the most newly depressed key of each keyboard is stored in the working memory device 14 for normal musical tones, whereas control data representing the newest ON/OFF state and the newest operation state quantity of each operator would be stored in the working memory device 18 for control data.

Of the key codes KC and the control data stored in the working memory devices 14 and 18, the key codes KC are separated for respective keyboards and respectively transferred to a buffer memory device 15 for the upper keyboard (UKB), a buffer memory device 16 for the lower keyboard (LKB) and a buffer memory device 17 for the pedal keyboard (PKB).

Where a finger code mode is selected by a finger code mode selection switch of the operator circuit 11, the key codes KC regarding all depressed keys of the lower keyboard 10B are transferred to the buffer memory device 16 for the lower keyboard 10B. However, where the single finger mode is selected, a key code KC representing a certain depressed key of the lower keyboad 10B is transferred to the buffer memory device 16 as data for producing a root, while at the same time, key codes for producing remaining chord constituting tones (subordinate tone) by referring to the key code of the root are read out from a constant memory device 20 and then transferred to the buffer memory device 16.

The control data representing the ON/OFF states and operation quantities of respective operators are transferred to a buffer memory devie 19 for control data.

The key codes KC representing the depressed keys of respective keyboards transferred to and stored in respective buffer memory devices 15, 16 and 17 are transferred respectively to a tone generator 21 for the upper keyboard (UKB), a tone generator 22 for the lower keyboard (LKB) and a tone generator 23 for the pedal keyboard (PKB). Concurrently therewith, the control data stored in the buffer memory device 19 for control data are separated for respective keyboards and then sent to respective tone generators 21, 22 and 23. Accordingly, the tone generator 21 for the upper keyboard forms a corresponding musical tone based on the key codes KC representing the depressed keys of the upper keyboard 10A, and such control data as the color and volume of the tone regarding the upper keyboard 10A, and the musical tone thus formed is produced as a melody tone by a sound system 24.

The lower keyboard tone generator 22 forms a musical tone to be produced based on the key codes KC representing the depressed keys of the lower keyboard 10B or chord constituting tones and such control data as the tone color and the tone volume regarding the lower keyboard 10B so as to cause the sound system 24 to produce an accompaniment tone (chord). The pedal keyboard tone generator 23 forms a musical tone corresponding to the key code KC representing a depressed key of the pedal keyboard 10C and such control data as the tone color and tone volume regarding the pedal keyboard 10C so as to cause the sound system 24 to produce the musical tone as a bass tone.

Each of the tone generators 21, 22 and 23 can be constituted by utilizing a waveform memory device read out system, a harmonic synthesizing system, a frequency modulation system and other well known musical tone forming systems.

The formation of a musical tone by an ordinary performance of the keyboard unit 10 is effected under the control of the arithmetic processing unit 12 according to a program for forming a normal musical tone which represents a musical tone besides a counter melody tone and prestored in a program memory device 25. In addition to the program, the program memory device 25 prestores with a program for forming a counter melody tone having a harmonic relation with respect to a melody tone and varies smoothly and slowly in relation to the variation of the accompaniment tone. Each time the keys corresponding to the chord constituting tones (at the time of the single finger mode, the key corresponding to the root tone) depressed on the lower keyboard 10B vary according to the counter melody tone forming program, the key codes KC corresponding to the counter melody tone are determined and transferred to a buffer memory device 28 for the counter melody tone (CML). The key codes KC corresponding to this counter melody tone are supplied to the upper keyboard tone generator 21. Then, the tone generator 21 forms a melody tone corresponding to the depressed keys of the upper keyboard 10A and a counter melody tone and causes the sound system 24 to produce these tones, wherein the counter melody tone belongs to in the tone range of G1 through G2.

For the purpose of forming the counter melody tone, the constant memory device 20 prestores a chord code detection table for checking whether the chord performed (or designated) by the lower keyboard 10B has a normal musical construction or not, and for checking the chord name when the chord has the normal construction, as well as various tables for determining a counter melody tone corresponding to various designation states of the chord where the same chord is designated continuously.

The counter melody working memory device 26 is provided with various registers and flag registers as shown in the following Tables II and III exclusively used for forming the counter melody tone by utilizing the memory areas of the working memory device 28.

There is also provided a timer 27 for measuring the time interval between a chord designation operation (performing operation of the accompaniment tone) and the performance of the first melody tone.

Furthermore, the arithmetic processing unit 12 is provided with registers and flag registers as shown in the following Table IV.

TABLE II

| Abbreviated symbol | Title | Memory content |
|---|---|---|
| MLKN $I_R$ | Melody key number register | Key number corresponding to present melody tone |
| LKKN $I_R$ | Chord constituting tone key number register | Key number corresponding to first tone of the chord constituting tones now being designated |
| LKKN $II_R$ | | Key number corresponding to second tone |
| LKKN $III_R$ | | Key number corresponding to third tone |
| LKKN $IV_R$ | | Key number corresponding to fourth tone |
| LKKN $V_R$ | | Key number corresponding to fifth tone |
| CDRT $I_R$ | First chord root key number register | Key number corresponding to root of newly designated chord constituting tones |
| CDRT $2_R$ | Second chord root key number register | Key number corresponding to root of previously designated chord constituting tones |
| CDTP $1_a$ | First chord type register | Data representing type of newly designated chord |
| CDTP $2_R$ | Second chord type register | Data representing type of previously designated chord |
| $MVSC_R$ | Melody-root interval register | Data representing interval between present melody tone and root note |
| $CMLVSC_R$ | Previous counter melody-root interval register | Data representing interval between previous counter melody tone and present root note |
| $DWDIST_R$ | Down distance register | Data representing interval between previous counter melody tone and constituting tone closest to low tone among newly designated chord constituting tones |
| $UPDIST_R$ | Up distance register | Data representing interval between previous counter melody tone and constituting tone closest to high tone among newly designated chord constituting tone |
| CMLKN $2_R$ | Second counter melody key | Key number corresponding to previous counter melody tone |
| CLNKN $3_R$ | Third counter melody key number register | Key number corresponding to twice previous counter melody tone |

TABLE III

| Abbreviated symbol | Title | Meaning of memory content |
|---|---|---|
| MLKON | Melody key-on | Logic "1" means that melody |

TABLE III-continued

| Abbreviated symbol | Title | Meaning of memory content |
|---|---|---|
| $FLG_R$ | flag register | tone is now being produced. |
| MLEV1 $FLG_R$ | 1st melody event flag register | Logic "1" means that present event is melody event. |
| MLEV2 $FLG_R$ | Second melody event flag register | Logic "1" means that previous event was melody event. |
| LKKON $FLG_R$ | Chord key-on flag register | Logic "1" means that chord is now being designated. |
| LKDON $FLG_R$ | Plurality of chords key-on flag register | Logic "1" means that chord designation is done with more than two keys. |
| CDDT $FLG_R$ | Code hold flag register | Logic "1" means that designated chord has been held as normal code. |
| CDEV1 $FLG_R$ | First chord event flag register | Logic "1" means that present event has been chord event. |
| CDEV2 $FLG_R$ | Second chord event flag register | Logic "1" means that previous event has been chord event. |
| SMCD1 $FLG_R$ | First same code flag register | Logic "1" means that present chord event is continuation of the same chords. |
| SMCD2 $FLG_R$ | Second same code flag register | Logic "1" means that previous chord event has been continuation of the same chord. |
| STRT1 $FLG_R$ | First start flag register | Logic "1" means that present event has been event corresponding to start of music. |
| STRT2 $FLG_R$ | Second start flag register event corresponding to | Logic "1" means that previous event has been start of music. |

TABLE IV

| Abbreviated symbol | Title | Remarks |
|---|---|---|
| $A_R$ | A register | Utilized for storing result of calculation |
| $B_R$ | B register | |
| $X_R$ | X register | |
| $Y_R$ | Y register | |
| Z $FLG_R$ | Z flag register | Utilized for judging result of calculation |

Figure 2:
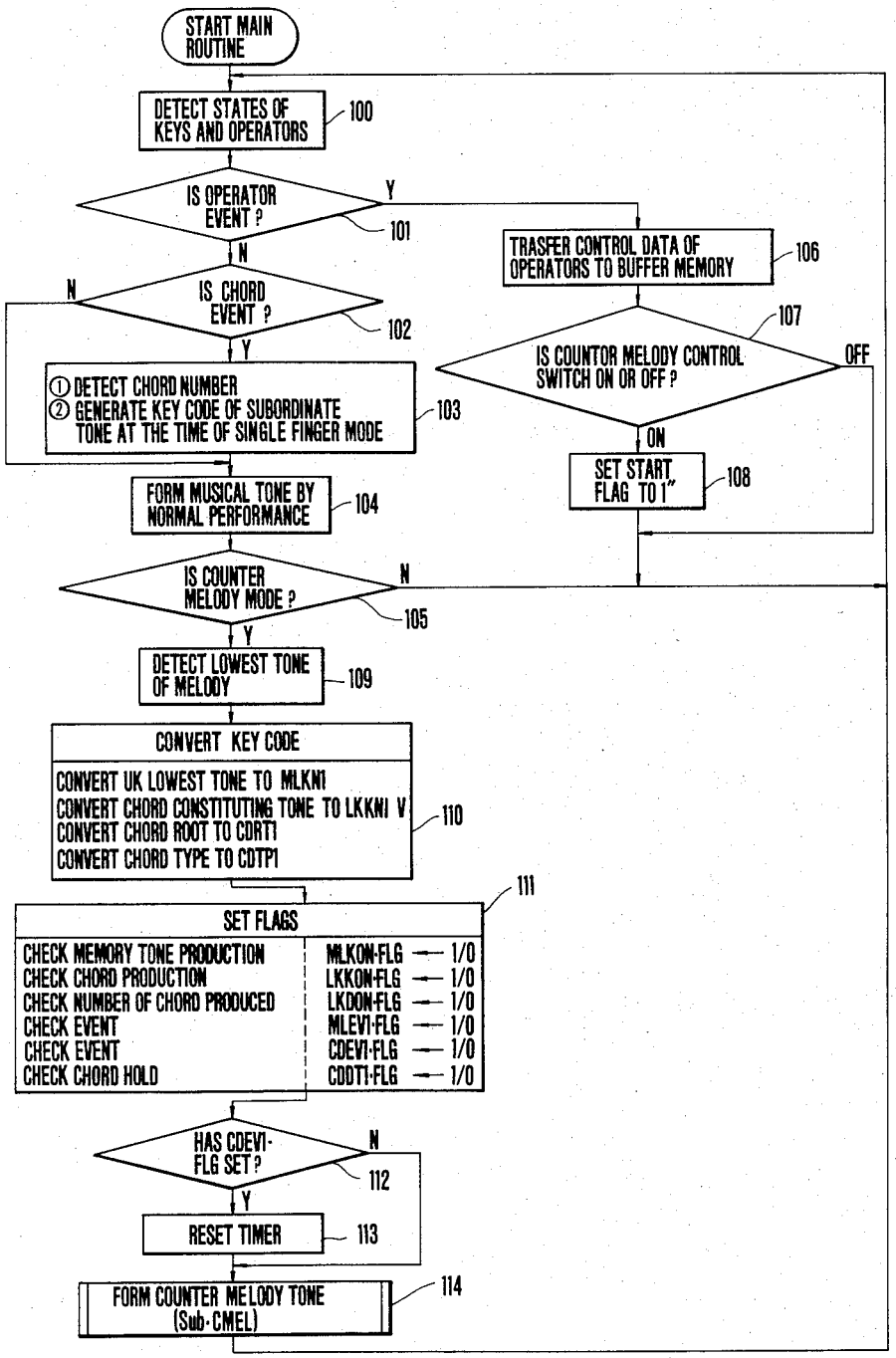
FIG. 2 is a flow chart showing a main routine of a case wherein a normal performance tone and a counter melody tone are formed.

FIG. 2 shows a flow chart showing a main routine where an normal performance tone and a counter melody tone are formed. At step 100, ON/OFF states of keys and operators of keyboard unit 10 and operator circuit 11 are detected by a sequential scanning. As above described, the key codes KC and control data showing the ON/OFF states of the operators detected by the detection procedure are stored in the normal musical tone working memory device 14 and the control data working memory device 18 respectively.

Also at this step 100, the key codes KC and the control data detected by the previous sequential scanning are compared respectively with the key codes and the control data detected by the present sequential scanning so as to detect whether the depressed keys for the melody tones of the upper keyboard 10*a* have changed or not, whether the state of designating a chord of the lower keyboard (state of depressed keys for producing an accompaniment tone) has changed or not, whether depressed keys for producing a bass tone of the pedal keyboard have changed or not, and whether the state of the operator of the operator circuit 11 has changed or not.

When the result of detection of the state change (detection of event) shows an event in which the designation state of a chord of the lower keyboard 10B, that is a chord event, at step 101 a check is made whether the event is the operator event or not, and at step 102 a check is made whether the event is a chord event or not. Then, at step 103, a check is made whether a chord designated by the lower keyboard 10B has a normal construction or not. That is a check is made whether a normal chord code has been held or not. At the same time a chord name is detected where a normal chord code has been held.

Further at step 103, where the chord is designated in the case of a single finger mode, it is determined that a depressed key of the lower keyboard 10B corresponds to the root so as to read out a key code KC corresponding to a subordinate tone of the root from the constant memory device 20. The key code corresponding to the subordinate tone is stored in a memory area of the working memory device 14 corresponding to the lower keyboard 10B together with the key code KC corresponding to the root note.

Detections of hold/not-hold of a chord and the chord name are made in the following manner. In this embodiment, a total of 108 types of the chord names are detected using 12 tones of C through E as root with regard to normally used 9 types of the chords, i.e., major (M), seventh (7th), major seventh (M7), minor (m), minor seventh (m7), minor seventh flat five (m7-5), augment (Aug), diminish (dim), sixth (6th). Constituting tones of these chords are not limited to those used normally but may include modifications thereof.

Figure 3:
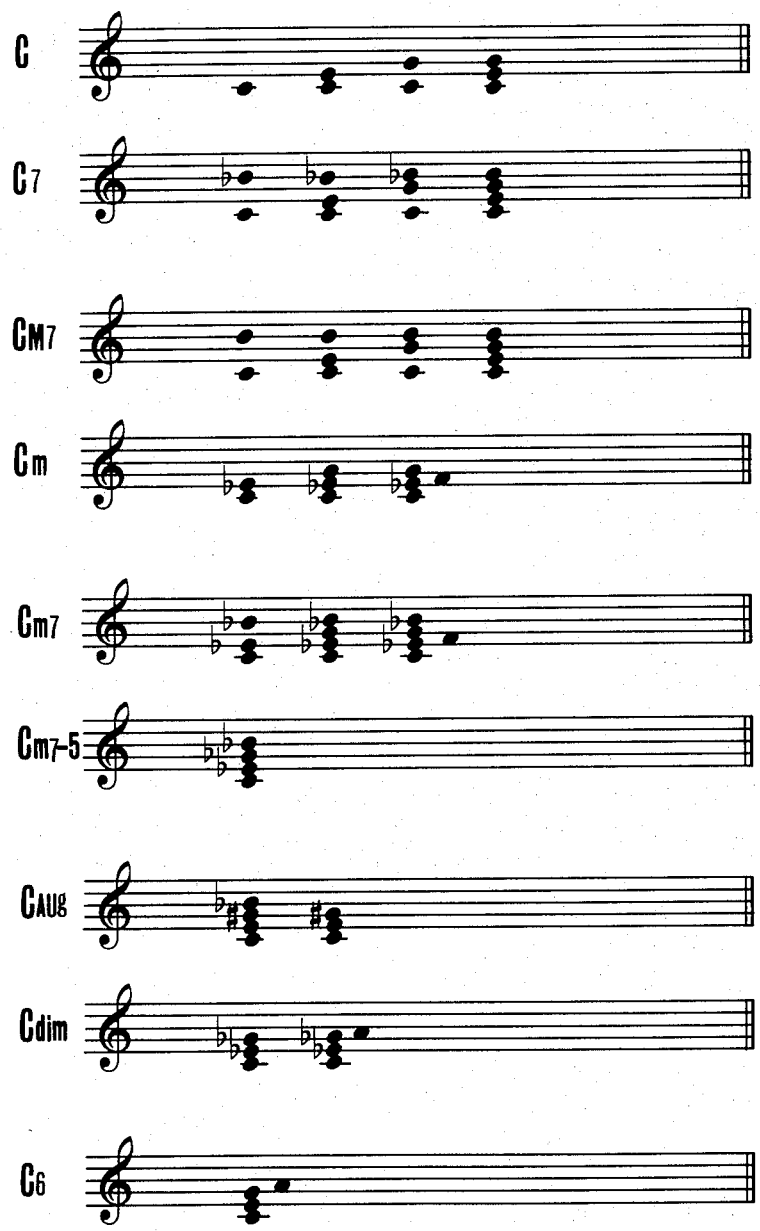
FIG. 3 is a musical score showing one example of a combination of tones recognized as a normal chord construction tones.

For example, with reference to a chord utilizing note C as the root, all constructions are shown in FIG. 3, may be used as normal constructions, and it is assumed that a normal chord has been designated.

For the purpose of detecting chord names of such construction, the constant memory device 20 is prestored with chord detection table for respective notes of C through B including reference chord constructions which are regarded as normal chords. For example, for 9 types of the chord constructions utilizing note C as the root, their reference chord constructions are stored as numerical data as shown in the following Table V.

TABLE V

| | Constituting tone | | | | | | | | | | | |
|---|---|---|---|---|---|---|---|---|---|---|---|---|
| Chord type | 0 | 1 | 2 | 3 | 4 | 5 | 6 | 7 | 8 | 9 | A | B |
| M | 1 | 0 | 0 | 0 | 0 | 0 | 0 | 0 | 0 | 0 | 0 | 0 |
| | 1 | 0 | 0 | 0 | 1 | 0 | 0 | 0 | 0 | 0 | 0 | 0 |
| | 1 | 0 | 0 | 0 | 0 | 0 | 0 | 1 | 0 | 0 | 0 | 0 |
| | 1 | 0 | 0 | 0 | 1 | 0 | 0 | 1 | 0 | 0 | 0 | 0 |
| 7th | 1 | 0 | 0 | 0 | 0 | 0 | 0 | 0 | 0 | 0 | 1 | 0 |
| | 1 | 0 | 0 | 0 | 1 | 0 | 0 | 0 | 0 | 0 | 1 | 0 |
| | 1 | 0 | 0 | 0 | 0 | 0 | 0 | 1 | 0 | 0 | 1 | 0 |
| | 1 | 0 | 0 | 0 | 1 | 0 | 0 | 1 | 0 | 0 | 1 | 0 |
| M7 | 1 | 0 | 0 | 0 | 0 | 0 | 0 | 0 | 0 | 0 | 0 | 1 |
| | 1 | 0 | 0 | 0 | 1 | 0 | 0 | 0 | 0 | 0 | 0 | 1 |
| | 1 | 0 | 0 | 0 | 0 | 0 | 0 | 1 | 0 | 0 | 0 | 1 |
| | 1 | 0 | 0 | 0 | 1 | 0 | 0 | 1 | 0 | 0 | 0 | 1 |
| m | 1 | 0 | 0 | 1 | 0 | 0 | 0 | 0 | 0 | 0 | 0 | 0 |
| | 1 | 0 | 0 | 1 | 0 | 0 | 0 | 1 | 0 | 0 | 0 | 0 |
| | 1 | 0 | 0 | 1 | 0 | 1 | 0 | 1 | 0 | 0 | 0 | 0 |
| m7 | 1 | 0 | 0 | 1 | 0 | 0 | 0 | 1 | 0 | 0 | 1 | 0 |
| | 1 | 0 | 0 | 1 | 0 | 0 | 0 | 0 | 0 | 0 | 1 | 0 |
| | 1 | 0 | 0 | 1 | 0 | 1 | 0 | 1 | 0 | 0 | 1 | 0 |
| m7-5 | 1 | 0 | 0 | 1 | 0 | 0 | 1 | 0 | 0 | 0 | 1 | 0 |
| aug | 1 | 0 | 0 | 0 | 1 | 0 | 0 | 0 | 1 | 0 | 1 | 0 |
| | 1 | 0 | 0 | 0 | 1 | 0 | 0 | 0 | 1 | 0 | 0 | 0 |
| dim | 1 | 0 | 0 | 1 | 0 | 0 | 1 | 0 | 0 | 0 | 0 | 0 |
| | 1 | 0 | 0 | 0 | 1 | 0 | 0 | 0 | 1 | 0 | 0 | 0 |
| 6 | 1 | 0 | 0 | 0 | 1 | 0 | 0 | 1 | 0 | 1 | 0 | 0 |

In Table V, columns represent types of chords such as major (M), while rows show 12 notes of C through B expressed by serial numbers 0 through B (hexadecimal notation). Digit [1] in columns represents that a given note presents in the reference chord constituting notes.

For example, with regard to the construction of a C major (CM) chord, as shown in FIG. 2, four constructions of (a) do,
(b) do, mi
(c) do, so
(d) do, mi, so are recognized as the normal chord constructions so that the reference chord constructions can be shown by the following numerical data corresponding thereto.

(a) [1 0 0 0 0 0 0 0 0 0 0 0]
(b) [1 0 0 0 1 0 0 0 0 0 0 0]
(c) [1 0 0 0 0 0 0 1 0 0 0 0]
(d) [1 0 0 0 1 0 0 1 0 0 0 0]

Accordingly, when a chord is designated by the lower keyboard 10B, code designation data in which the bit position of the number (0 through B) corresponding to each note of the designated chord constituting tones is made "1" are compared with reference chord constituting data for each root sequentially read out from the chord detection table so as to detect whether the chord designated by the lower keyboard 10B has a normal chord construction and whether the construction corresponds to which one of the chord name.

The chord name, data representing the type of the chord and the key codes representing the chord constituting tones thus detected are stored in the counter melody working memory device 26 together with a key code KC representing the root.

In this case since the chord constituting tones designated by the lower keyboard 10B are stored in the normal musical tone working memory device 18 as corresponding key code KC, when detecting the chord name as above described, a processing is executed for converting only a portion of a note code NC into a serial data numbers of from 0 to B. Such conversion is made by utilizing a note code conversion table as shown in the following Table VI prestored in the constant memory device 20.

TABLE VI

| Note | Note code NC | Note number (hexadecimal notation |
|---|---|---|
| C | 0 0 0 1 | 0 |
| C# | 0 0 1 0 | 1 |
| D | 0 0 1 1 | 2 |
| D# | 0 1 0 1 | 3 |
| E | 0 1 1 0 | 4 |
| F | 0 1 1 1 | 5 |
| F# | 1 0 0 1 | 6 |
| G | 1 0 1 0 | 7 |
| G# | 1 0 1 1 | 8 |
| A | 1 1 0 1 | 9 |
| A# | 1 1 1 0 | A |
| B | 1 1 1 1 | B |

Upon detection of the generation of a chord event, a check as to whether a chord code has been held or not, detection of the chord name, and reading out of a key code corresponding to a subordinate tone (only in the single finger mode) are executed. Upon completion of these processings, the program is advanced to step 104 at which the key code KC which has been stored in the normal musical tone working memory device 14 is transferred to the lower keyboard buffer memory device 16, whereby the tone generator 22 forms a chord corresponding to the chord construction designated by the lower keyboard 10B.

However, the processing of step 103 would not be executed when a melody even in which melody performance depressed keys have changed, that is a chord event is not generated, and an operator event is not generated, but instead key codes KC representing newly depressed keys for the melody performance is transferred to the buffer memory device 15 at step 104, whereby the tone generator 21 forms melody tones corresponding to the newest key code KC.

Thereafter, at step 105 a check is made whether the mode is the counter melody mode or not, that is whether the counter melody control mode switch has selected a mode in which a counter melody tone is to be formed or not. When the result of judgement shows that the counter melody mode has not selected, the program is returned to step 100 to repeat the processings described above.

However, when the result of detection at step 100 shows that the operating state of the operator has changed, that is when generation of the operator event is detected, the program is branched from step 101 to step 106 at which control data representing the newest ON/OFF states of the operator and the amounts of operations which have been stored in the control data working memory device 18 are transferred to the control data buffer memory device 19. As a consequence, respective tone generators 21, 22 and 23 control the color and volume of the musical tone according to the newest control data.

At step 106, the ON/OFF state of the counter melody control mode switch provided for the operator circuit 11 is detected. When this mode switch is in the ON state, at step 107, the state of the counter melody control mode switch is judged. When the switch is ON, at step 108, a first start flag STRT1-FLG is set to "1", and then the program is returned to step 100.

More particularly, when the counter melody control switch is in the ON sate, thereafter, each time a melody event or a chord event is generated, a first start flag STRT1-FLG set for the purpose of designating formation of an ordinary musical tone (melody or chord) as well as a counter melody tone and the program is returned to step 100.

On the contrary when the counter melody control mode switch is OFF, the program is returned from step 107 directly to step 100, and thereafter only the processing for forming the normal musical tone is repeated.

After the counter melody control mode switch has been turned ON and the first start flag STRT1-FLG has been set, when none of the operator event, melody event and chord event is produced the program becomes a waiting condition in which steps 100→105→100 are repeated.

Thereafter, however, when either one of the melody event or chord event is generated, since the mode to form the counter melody tone has already been determined by the first start flag STRT1-FLG, based on the judgement executed at step 105, the counter melody tone would be formed in the next steps succeeding step 109.

As will be described later, the first start flag STRT1-FLG is reset when a counter melody tone corresponding to the melody event or chord event firstly formed after the setting of the flag has formed. Consequently, the firstly formed event following the setting of the flag STRT1-FLG means that the event corresponds to the first portion of the entire music added with the counter melody tone. In other words, the first start flag STRT1-FLG means that a melody event or a chord event generated after the setting of the flag is an event corresponding to the state of the music.

Of course before the program is advanced to step 109 from step 105, chord code detection and the normal musical tone formation are executed at steps 103 and 104.

During the formation of the counter melody tone, at step 109 the lowest tone of the melody tone is detected.

This embodiment is constructed such that the melody tone is generated in a tone range of from G#2 to C6, as it is desirable to generate the counter melody tone on the lower tone range than the melody tone due to its characteristic, the lowest tone of the melody tone is firstly detected.

The lowest tone of the melody tones is detected by comparing the key codes of the depressed keys of the upper keyboard 10A, and a key code KC representing the lowest tone is temporarily stored in the counter melody working memory device 26. For the sake of simplicity, in the following the lowest tone of the melody tones is merely called "a melody tone".

At step 110 of key code conversion procedure, key codes KC respectively corresponding to a melody tone, chord constituting tones and a root are converted into key numbers KN which are stored respectively in a melody key number register $MLKN1_R$, a chord constituting tone key number register $MLKN1_R$, a chord constituting tone key member register $LKNI_R$ through $LKKNV_R$, and a first chord root key number register CDRT1R.

The key numbers KN have values of 0 through 60 assigned to the keys in the tone range of from C1 through C6 as shown in the following Table VII.

TABLE VII

| | Key code KC | | | | | | | | Key number KN |
|---|---|---|---|---|---|---|---|---|---|
| | OC | | | | NC | | | | (decimal representation) |
| C1 | 0 | 0 | 1 | | 0 | 0 | 0 | 1 | 0 |
| C#1 | 0 | 0 | 1 | | 0 | 0 | 1 | 0 | 1 |
| D1 | 0 | 0 | 1 | | 0 | 0 | 1 | 1 | 2 |
| D#1 | 0 | 0 | 1 | | 0 | 1 | 0 | 1 | 3 |
| E1 | 0 | 0 | 1 | | 0 | 1 | 1 | 0 | 4 |
| F1 | 0 | 0 | 1 | | 0 | 1 | 1 | 1 | 5 |
| F#1 | 0 | 0 | 1 | | 1 | 0 | 0 | 1 | 6 |
| G1 | 0 | 0 | 1 | | 1 | 0 | 1 | 0 | 7 |
| G#1 | 0 | 0 | 1 | | 1 | 0 | 1 | 1 | 8 |
| . | | . | | | | . | | | . |
| . | | . | | | | . | | | . |
| . | | . | | | | . | | | . |
| C#2 | 0 | 1 | 0 | | 0 | 0 | 1 | 0 | 13 |
| D2 | 0 | 1 | 0 | | 0 | 0 | 1 | 1 | 14 |
| . | | . | | | | . | | | . |
| . | | . | | | | . | | | . |
| . | | . | | | | . | | | . |
| G2 | 0 | 1 | 0 | | 1 | 0 | 1 | 0 | 19 |
| . | | . | | | | . | | | . |
| . | | . | | | | . | | | . |
| . | | . | | | | . | | | . |
| C6 | 1 | 1 | 0 | | 0 | 0 | 0 | 1 | 60 |

The purpose of converting the key numbers KN is to simplify the arithmetic operation for determining the counter melody tone. More particularly, as can be noted from Table I, the note code NC portion of the key code KC has a discontinuous numerical value construction in which decimal values "4", "8", "12" and "15" do not present. For this reason, to detect that whether the counter melody tone and the melody tone have a dissonant relation of a semi-tone difference or not, when the note code NC is subtracted, even in a combination of tones having a semi-tone difference, the difference of the note codes becomes "1" or "2", which makes difficult the calculation requiring reexamination of the note relation of two tones.

On the contrary, when continuous key numbers KN are assigned to respective notes irrespective of the note relation of two tones and when these tones have a difference of semi-tone, the difference of their key numbers is always "1" or "11". As a consequence, whether the two tones are in the dissonant relation of semi-tone difference or not can be detected by merely subtracting the key numbers.

For this reason, the constant memory device 20 prestores a key code conversion table utilized to convert the key codes KC into serial key numbers KN as shown in Table VII. Key codes KC corresponding to a melody tone and chord constituting tones are converted into corresponding key numbers KN by using this conversion table and then stored in respective registers described above.

When the key code conversion at step 110 is completed, at the next step 111 various registers for forming the counter melody tone are set.

Thus, at first, the production of the melody tone is checked. When keys for a melody tone of the upper keyboard 10A are now being depressed, a melody key-on flag MLKON-FLG is set (logic "1"). But when the keys are not depressed the flag would be reset (log "0"). Then, tone production of a chord is checked, and when a chord is now being designated for the lower keyboard (key operation of the accompaniment tone), a chord key-on flag LKKON-FLG would be set (logic "1"), while the chord is not designated the flag would be reset (logic "0").

Further, the number of the chord constituting tones is checked. When more than two chord constituting tones are designated, a plurality of chord key-on flag LKDON-FLG would be set.

Furthermore, an event check is made as to whether the branching from step 105 to step 109 is caused by the generation of a melody event or a chord event or not, in other words, whether the present event is a melody event or a chord event. In the case of the melody event, the first melody event flag MLEV1-FLG is set while at the same time a first chord event flag CDEV1-FLG is reset. On the contrary, when the event is a chord event instead of a melody event, the first chord event flag CDEV1-FLG would be set and the first melody event flag MLEV1-FLG would be reset.

Finally, a check is made as to whether the construction of the chord designated by the lower keyboard 10B is normal or not, that is whether a normal chord code has been established or not. If the code is established a code hold flag CDDT-FLG would be set, and if not the flag would be reset.

Checks of the tone production of a melody tone and a chord and of the number of tone productions of the chord are performed based on the key codes KC corresponding to depressed keys of respective keyboards and stored in the normal musical tone working memory device 14. The check of the melody tone production is effected by referring to the result of detection of the newest state executed at step 100. The check for code hold and not hold is effected by referring to the result of chord code detection.

The purpose of checking the production of a melody tone is to divide the processing for determining the counter melody tone in accordance with presence or absence of the tone production of a melody tone, and even when the designated chords are the same, to make different the counter melody tones in accordance with the presence or absence of the melody tone.

The purpose of checking the tone production of the chord is to stop the tone production of the counter melody tone where a chord is not produced because the counter melody tone is produced only when a chord is produced.

Furthermore the purpose of checking the number of chord produced is to make different the manner of determining the counter melody tone due to the fact that the chord code is not held either by one chord tone produced or by more than two chord produced.

At step 111 when flags are set, at the next step 112, a check is made whether the first chord event flag CDEV1-FLG has been set (logic "1") or not, and when the result is YES, at step 113, the timer 27 is reset. Then at step 114 a counter melody tone is formed.

However, when the result of check at step 112 is NO, the program directly jumps to step 114.

More particularly, the timer 27 is reset such that when the result of detection of the state executed at step 100 shows that even when the newly detected event is a chord event, but where the first chord event flag CEDV1-FLG has been set, the time interval between the chord interval and a first melody event following thereto can be measured. For this reason, in the processings to be described later, when the time interval between a chord event and a first melody event succeeding thereto is in a predetermined spacing the performance of a melody event causing the melody event is deemed as it were made at the same time when a chord is designated which causes a preceding chord event, from the standpoint of a musical score.

At the step 114 for forming the counter melody tone, an appropriate counter melody tone is determined in accordance with the designation of the chord and the state of performance of the melody tone. As the counter melody tone is determined, a key code KC corresponding thereto is transferred to the counter melody buffer memory device 28, whereby the upper keyboard tone generator 21 forms a melody tone together with a counter melody tone.

Upon completion of the counter melody tone, the program is returned to the step 100 for detecting the state so that when a new event is generated the processings described above are repeated.

Summarizing the above description, when the counter melody control mode switch is OFF, a melody tone, a chord (accompaniment tone) or a bass tone is formed corresponding to the key operation of the keyboard unit 10. However, when the counter melody control mode switch is ON, either the melody performance keys of the upper keyboard 10A or the chord designation keys (accompaniment keys) of the chord of the lower keyboard 10B change, a counter melody tone corresponding to the contents of the melody tone and the chord is formed at steps following the steps 100.

Figure 4:
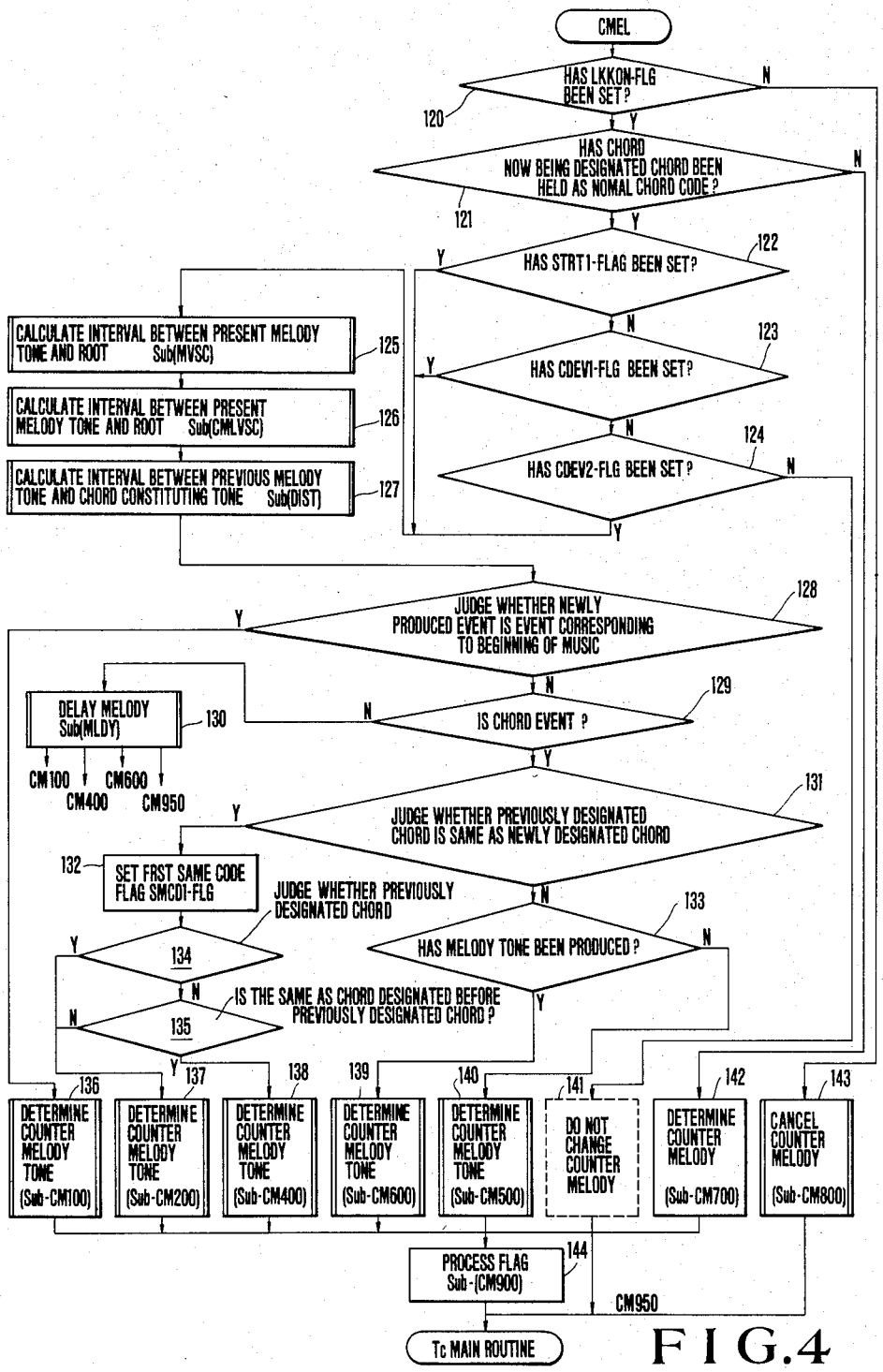
FIG. 4 is a flow chart showing a subroutine for selecting a counter melody determination processing corresponding to a performance state.

The processing of forming a counter melody executed at step 114 is shown in detail by a subroutine (Sub-CMEL) shown in FIG. 4.

In this subroutine, each time the keyboard unit 10 generates a new event, an analysis is made as to whether the event is a melody event or a chord event. At the same time, the event is compared with a previous event in accordance with a flag stored in various flag registers for analyzing the content of the performance as to whether the events of the same chord continues or a melody event continues so as to select one of the determining procedures of a plurality of prepared counter melodies in accordance with the melody performance and the chord performance based on the result of analysis thereby determining an optimum counter melody tone.

A plurality of counter melody determination processings shown in the subroutine (Sub-CMEL) can be classified as follows.

More particularly, a chord can be formed only which its pitch varies smoothly and when a chord is designated, after the counter melody control mode switch has been turned on, since the extent of variation in the pitch variation of a counter melody tone determined by a chord initially designated at the beginning of a music is not clearly determined because there is no previous counter melody tone is available. Accordingly, a subroutine (Sub-CM100) is prepared in which increments of the tone pitches determined for different types of the chord such as major (M) are added to the root note among chord constituting tones in accordance with the presence or absence of a melody tone for determining the tone pitch of the new counter melody tone based on the sum.

At this time, where the chord designated at the beginning of the music does not hold a normal chord code, it is assumed that the previous counter melody tone is a note G1, and one of the chord constituting tones having a smallest interval with respect to the G1 note is determined as a new counter melody tone. The determination of a counter melody tone where the chord code does not hold, is executed by another subroutine (Sub-CM700) to be described later.

In a performance in which the chord is continuously designated and the flow of the music is stable, subroutines (Sub-CM400) and (Sub-CM200) are prepared that determine counter melody tones in which the flow of the music is stabilized. More particularly, in a performance state in which the designation of the same code is made twice continuously and a melody tone is produced, in the subroutine (Sub-CM400) a tone same as one of the present chord constituting tones is determined as a new counter melody tone by taking into consideration the relation between the previous melody tone and the melody tone. Further in a performance state where the designation of the same chord is made twice continuously and there is no melody tone produced, or in a performance state in which the same chord is designated more than twice irrespective of the presence or absence of a melody tone, subroutine (Sub-CM200) determines a tone same as a 3rd or 6th tone with respect to the melody tone from among the chord constituting tones, or a tone same as the closest tone on the higher tone side of the chord constituting tones to the previous counter melody tone is determined as a new counter melody tone.

Furthermore, in a performance state in which the chord thus determined varies so as to make unstable the flow of the music, subroutines (Sub-CM500) and (Sub-CM600) that determine a counter melody tone in which the flow of the music is stabilized are prepared at this stage, by taking into consideration the relation with reference to the content of the melody tone production, in the absence of the melody tone production, in the subroutine (Sub-CM500) an interval between the previous counter melody tone and the root of the presently designated chord constituting tone is determined for correcting the tone pitch of the previous melody tone in less than major 2nd by using a correction value determined for each chord type in accordance with the interval thus determined so as to determine the corrected value as the tone pitch of the new counter melody tone. Where a melody tone is produced, in the subroutine (Sub-CM600), one of the chord constituting tones having an interval of less than major 2nd with reference to the previous counter melody tone is selected according to a predetermined order of priority determined for respective types of the chord for determining the selected tone as a new counter melody tone.

Furthermore in a case wherein a chord has been designated but a normal chord code is not established, by taking into consideration the importance of a smooth tone pitch variation of the chord at a tone same as one of the chord constituting tones having a shortest interval difference with respect to the previous counter melody tone is determined as a new counter melody tone by the subroutine (Sub-CM700).

Further, a subroutine (Sub-CM800) is prepared for the purpose of releasing or stopping the tone production of the counter melody tone when the designation of a chord disappears.

In addition, a subroutine (Sub-MLDY) is prepared for determining a new counter melody tone on the assumption that a melody key operated a predetermind time later than the designation of a chord is deemed as it is operated at the same time as the chord designation.

In the subroutine (Sub-CMEL) shown in FIG. 4, at step 120, a check is made as to whether a chord key-on flag LKKON-FLG has been set or not. More particularly, according to the content of the flag LKKON-FLG, a judgement is made as to whether the keyboard unit 10 has designated a chord or not or whether the chord designation has been released or not. When the result of the judgement shows that the chord key-on flag LKKON-FLG has been reset and that the chord designation has been released, the program is jumped to step 143 where the counter melody shown in the subroutine Sub-CM800 is released, thus releasing the counter melody tone production.

In contrast, when the result of the judgement shows that the chord key-on flag LKKON-FLG has been set and that the chord designation has been made, at step 121 a judgement is made as to whether the chord now being designated is held as a normal chord or not by referring to the content of a code hold flag CDDT-FLG. When the result of the judgement is NO, the program is jumped to step 142 at which a counter melody shown in subroutine (Sub-CM700) at which the counter melody is determined, that is one of the chord constituting tones having the shortest interval difference with reference to the previous counter melody tone would be determined as the new counter melody tone.

However, when the result of the judgement at step 121 is YES, at step 122, a judgement is made as to whether a start flag STRT1-FLG has been set or not. Then at steps 123 and 124 judgements are made as to whether the first chord event flag CDEV1-FLG and the second chord event flag CDEV2-FLG have been set or not. More particularly, a judgement is made as to whether an event newly produced by the keyboard unit 10 is an event produced firstly after the counter melody control mode switch has turned ON (except the operator event). In other words, a judgement is made whether the event corresponds to the beginning of a music to which the counter melody tone is to be added or not by referring to the start flag STRT1-FLG. Then in the absence of an event corresponding to the beginning of a music, a judgement is made as to whether the newly produced event is a chord event or not by referring to the content of the first chord event flag CDEV1-FLG. When the result of the judgement shows that the new event is a melody event instead of a chord, a judgement is made as to whether the previously produced event is a chord event or not according to the content of the second event flag CDEV2. When the result of the judgement shows that the previous event is not a chord event (that is the previous event was also a melody event), it is judged that melody events are produced continuously at an intermediate stage of the music so that the program is jumped from step 124 to step 141 from which the program is returned to the main routine without executing any procedure. More particularly where both adjacent events produced at an intermediate portion of the music are the melody events, the program returns to the main routine without executing any processing regarding the counter melody tone.

However, under the following two conditions (a) when an event corresponding to the beginning of a music after the start flag STR1-FLG has been set by the closure of the counter melody control mode switch is a chord event representing the designation of a chord, and (b) when either one of adjacent chords produced at the intermediate portion of the music corresponds to a chord event representing a chord designation, the program is directly advanced from step 122 to step 125 where the condition (a) holds, whereas under the latter condition (b), the program is advanced from step 122 directly to step 125 or through step 124 for executing succeeding processings.

More particularly, each time when an event that designates a chord is produced, the processings following step 125 are executed, whereas when a melody event is produced the processings following step 125 would be executed upon generation of a melody event only when the previous event is a chord event representing a chord designation.

Among the events produced under the condition (a), a chord event representing a chord release would be removed by a judgement executed at step 121.

When the program is advanced in this manner for processing steps succeeding step 125, in the subroutine (Sub-MVSC) of step 125, a tone interval (spacing) between the root of a chord constituting tones now being designated and the melody tone (The lowest tone) is calculated.

Since this calculation is performed to determine the aforementioned counter melody tone based on the interval difference between a melody tone and a root note, it is advantageous to calculate beforehand the interval difference so as to use this calculated difference for both subroutines.

Figure 5:
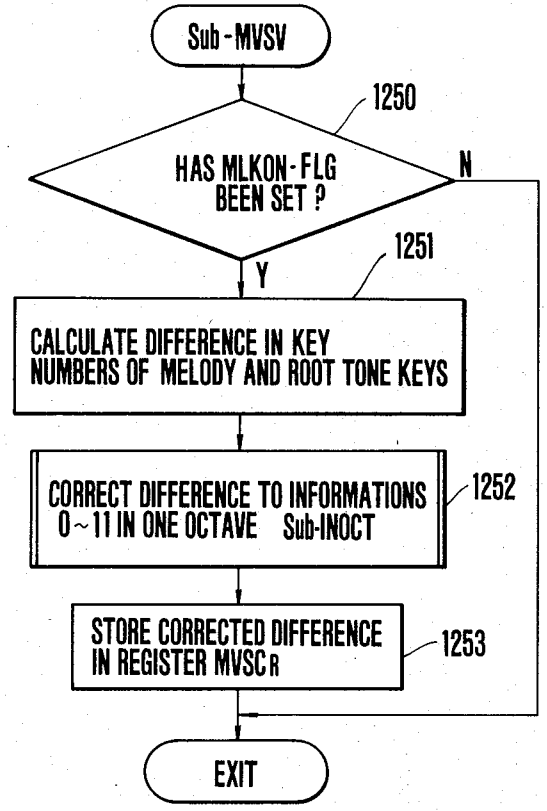
FIG. 5 is a flow chart showing the detail of a subroutine calculating an interval between a melody tone and a root note.

The processing of calculating at step 125 is shown by a detailed flow chart shown in FIG. 5 in which a judgement is made whether there are depressed keys for a melody keys or not depending upon whether the melody key-on flag MLKON-FLG has been set or not. Thus, at step 1250, a judgement is made as to whether a melody key-on flag MLKON-FLG has been set or not for judging whether melody keys have been depressed or not. If there are no depressed key for the melody, the program returns to the subroutine (Sub-CMEL) shown in FIG. 4. However, when there are depressed keys for the melody, at step 1251 an interval difference of two tones is calculated as the difference in the key numbers in accordance of the melody key number MLKN1 showing a depressed key of the lowest tone pitch among the depressed keys for a melody and a code root key number CDRT1 representing the root note among the chord constituting tones now being designated and the result of calculation is stored in the A register $A_R$ in the arithmetic processing unit 12.

Thereafter, according to the subroutine (Sub-INOCT) of the step 1252 a processing is executed for correcting the result of calculation of the interval to a value less than one octave. Thus, the processing is executed such that the interval difference between a melody and a root would be detected as an interval difference within one octave by neglecting the octave tone range.

For example, where the melody is C2 and the root is E2, since as can be noted from the following Table VII, the key numbers KN(C3) and CDRT1 of these tone are KN(C3)=24 (decimal notation)

CDRT1=16 (decimal notation)

the difference in the key numbers would be "12". However, since this value contains an information request for an octave request it does not represent the interval between the C and E notes in one octave. Accordingly, a processing for detecting the difference in the key numbers of two tones as informations (0–11) representing the interval differences in one octave is executed in the subroutine Sub-INOCT at step 1252. The result of this calculation is stored in a melody-root note spacing register at step 1253.

Following the processing at step 125 shown in FIG. 4, in subroutine (Sub-CMLVSC) at step 126, the interval difference between the previous counter melody tone and a root of the chord constituting tones now being designated is calculated.

This calculation is executed for the purpose of calculating beforehand the interval becauuse the counter melody tone is determined based on the interval between the previous melody tone and the presently designated root in the subroutine (Sub-CM500).

Figure 6:
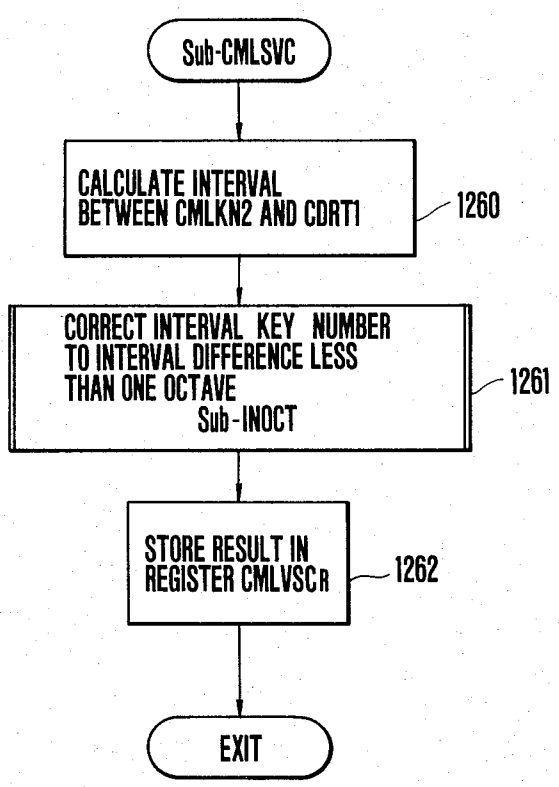
FIG. 6 is a flow chart showing the detail of a subroutine for calculating an interval difference between a previous counter melody tone and a present root note.

The calculation effected at step 126 is shown in a detailed flow chart shown in FIG. 6. Thus at step 1260, the interval between two tones is calculated as a key number difference in accordance with a counter melody key number CMLKN2 representing the previous counter melody and a chord root key number CDRT1 representing the root now being designated and the result of the calculation is temporarily stored in the A register $A_R$.

A processing of correcting a key number representing the interval to an information representing an interval less than one octave is executed in a subroutine (Sub-INOCT) of step 1261, and the result of this calculation is stored in the previous counter melody-root note interval register $CMLVSC_R$ at step 1262.

Figure 7:
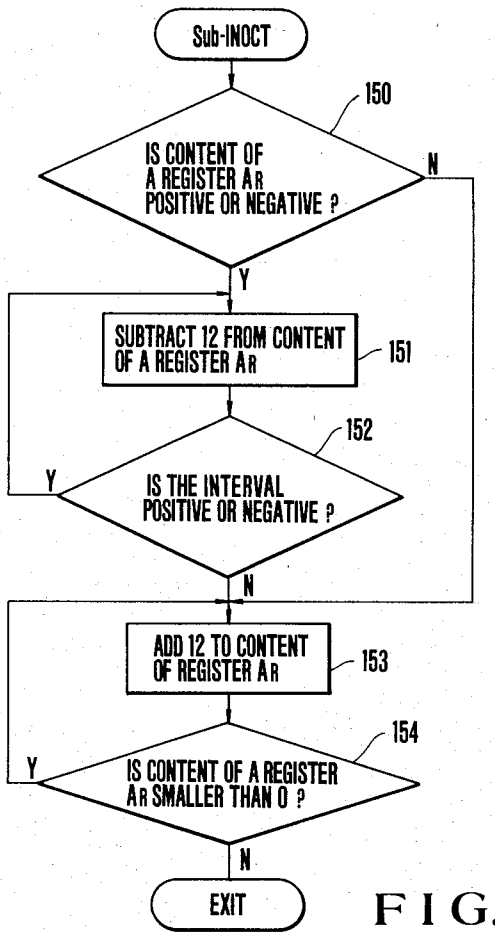
FIG. 7 is a flow chart showing the detail of a subroutine for converting an interval information of two tones into an interval information in one octave.

In the subroutines shown in FIGS. 5 and 6 the subroutine (Sub-INOCT) for correcting an interval information of two tones represented by the difference between key numbers to an information of an interval of less than one octave is shown in detail by a flow chart shown in FIG. 7.

Thus, at step 150, a judgement is made as to whether the content of the A regiser $A_R$, that is a key number representing the interval between two tones is a positive value or a negative value. If the content of the A register $A_R$ is positive, at step 151 a value "12" representing an interval of one octave is subtracted from the content of A register $A_R$. Then at step 152 a judgement is made as to whether the interval is positive or negative. If the result of step 152 shows that the interval is still positive the program is returned from step 152 to step 151 to again subtract "12" corresponding to the interval of one octave. In this manner, by sequentially subtracting "12" corresponding to the interval of one octave from the key number representing the interval between two tones, the content of the A register $A_R$ is sequentially decreased by an interval unit corresponding to one octave. When the content of the A register $A_R$ becomes negative as a result of the sequential subtraction operations, at step 153 "12" is added to the content of the A register $A_R$. If the sum is still negative, at step 154 a judgement is made whether the content of the A register $A_R$ is smaller than zero. If the result shows that the content of the A register $A_R$ is still negative the program is returned to step 153 from step 154 to add again "12". As a result of repeating steps 153 and 154, when the content of the A regiser $A_R$ becomes positive the program is returned to the subroutine, shown in FIGS. 5 or 6 from step 154. When the content of the A register $A_R$ has already reached negative at step 150, the program would be jumped to step 153.

In summary, in the subroutine (Sub-INOCT) by dividing the interval between two tones also containing information elements of an octave tone region with 12 corresponding to the interval difference of one octave, the information elements of an octave tone range from a value representing the interval between two tones so as to take out the finally remaining surplus as an information representing the interval between two tones in one octave. Consequently the interval between two tones can be obtained as the absolute values of 0 through 11.

Upon completion of the processing at step 126, in a subroutine (Sub-DIST) at step 127 shown in FIG. 4, the interval difference between the previous counter melody tone and one of the chord constituting tones now being designated, having the minimum interval with respect to the low tone side and the high tone side, is calculated. It should be understood that, the chord constituting tone of the minimum interval does not contain a tone of the same note name as that of the previous counter melody tone.

The calculation is executed such that in the subroutines (Sub-CM200), (Sub-CM600) and (Sub-CM700) the counter melody tones described above are determined respectively based on the interval between the previous counter melody tone and a chord constituting tone closest thereto. Accordingly the interval difference is calculated beforehand so as to use it commonly in respective subroutines.

Figure 8:
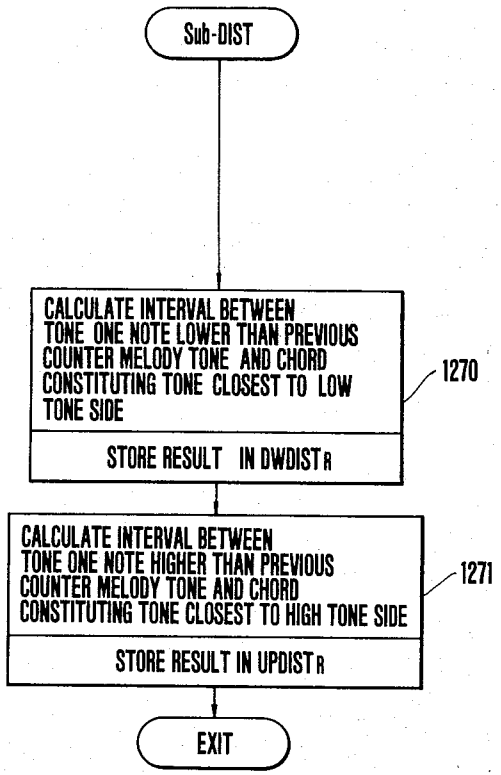
FIG. 8 is a flow chart showing the detail of a subroutine for calculating an interval between a previous counter melody tone and a constituent tone closest to a higher tone and a lower tone.

The calculating procedure executed at step 127 is shown by the detailed flow chart shown in FIG. 8.

Thus, at step 1270, the interval between a tone one note lower than the previous counter melody tone and a chord constituting tone closest to the low tone side is calculated. The result of this calculation is stored in a down distance register $DWDIST_R$ as down distance data.

Then at step 1271 an interval between a tone one note higher the previous counter melody tone and a chord constituting tone closest to the high tone side is calculated, and the result of the calculation is stored in an up distance register $UPDIST_R$ as up distance data.

The calculations at steps 1270 and 1271 are executed only by the note information elements of the chord key numbers LKKNI through LKKNV stored in five chord constituting tones key number registers $LKKNI_R$ through $LKKNV_R$, and of the key number of the previous counter melody tone stored in a second counter melody key number register $CMLKN2_R$.

Figure 9:
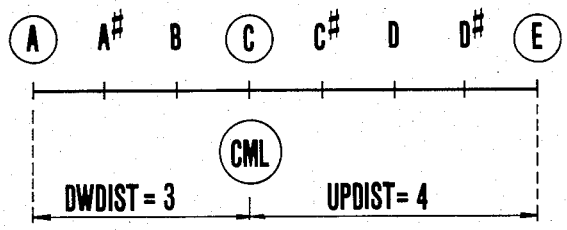
FIGS. 9*a*, 9*b* and 9*c* are graphs showing one example of the content of the calculation executed by the flow chart shown in FIG. 8.
Figure 9:
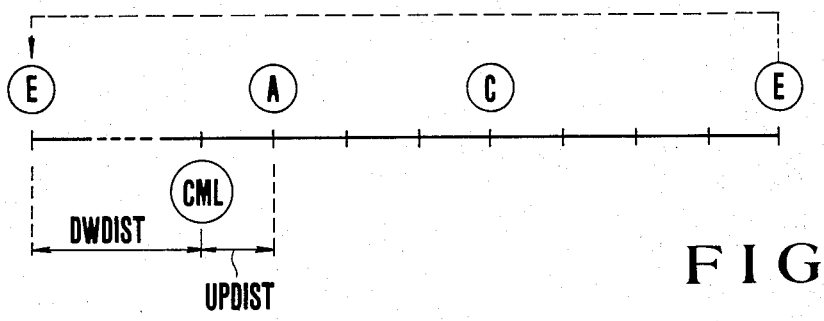
Figure 9:
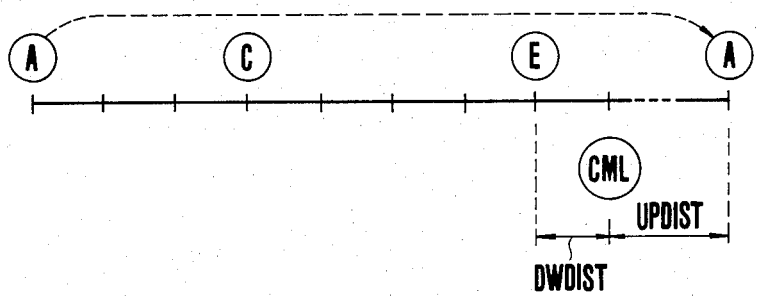

Consequently, as shown in FIG. 9*a*, an A minor (Am) chord in which first to third tones are constituted by notes A, C and E respectively would be designated, whereas when the previous counter melody tone CML corresponds to a note C, the down distance data DWDIST is "3" and the up distance data UPDIST is "4".

As shown in FIG. 9*b*, when the previous counter melody tone CML comprises a chord constituting tone of A minor which is on the lower tone side than the root an interval between a tone one octave lower than the third tone and the previous counter melody tone is calculated as the down distance DWDIST, while the interval between the root and the previous melody tone is calculated as the up distance UPDIST.

As shown in FIG. 9*c* when the previous counter melody tone CML comprises a chord constituting tone of the A minor which is on the higher tone side than the third tone, the interval between a tone one octave lower than the root note and the previous counter melody tone CML is calculated as the up distance UPDIST, whereas the interval between the third tone and the previous counter melody tone is calculated as the down distance DWDIST.

After completing the procedure of step 127 shown in FIG. 4, at step 128 a judgement is made whether a newly produced event is an event corresponding to the beginning of a music or not in accordance with the content of the start flag STR1-FLG. When the result is YES, the program is advanced to the subroutine (Sub-CM100) of step 136 in which a counter melody tone at the beginning of the music is determined.

In this case, the processings after step 125 are executed when either one of the aforementioned conditions (a) and (b) holds. With regard to the melody event, however, since the processings after step 121 are possible only when a chord has already been designated and it is still continuing (the condition of step 120), the subroutine (Sub-CM100) that determines the counter melody tone at the beginning of the music is started at a time when a chord event is produced representing designation of the chord. Further as the result of judgement at step 121 is added, the subroutine (Sub-CM100) is started only when a designated chord constitutes a normal chord code.

Thus, as a result of the designation of the first chord at the beginning of the music, the counter melody tone is determined by the subroutine (Sub-CM100).

As will be described later, the start flag STRT1 FLG would be reset in the subroutine (Sub-CM900) after either one of the counter melody has been determined. For this reason, the subroutine (Sub-CM100) is started only once at the beginning of the music.

Where the newly produced event is a chord event or a melody event not corresponding to the beginning of a music, at step 129, a judgement is made as to whether the event is a chord event or not according to the content of a first chord event flag CDEV1-FLG. When the result judgement shows that the event is a melody event, the program is branched from step 129 to a subroutine (Sub-MLDY) of step 130 where a melody delay is processed.

More particularly, when a newly produced melody event is a melody event following to a chord event, a check is made as to whether the melody event was produced in a predetermined time after the previous chord event or not. If the melody event was produced within the predetermined time, the melody event is treated as if it were the same as the previous chord event on a musical score and a melody delay processing is commenced for determining a new counter melody tone.

However, when the newly produced event is also a chord event, at step 131 a judgement is made as to whether the previously designated chord is the same as the newly designated chord or not. This judgement is made when a chord root key number CDRT2 representing the root note of previously and newly designated chord constituting tones coincides with CDRT1 and when a code type data CDTP2 and CDTP1 representing the type of the chord coincide with each other.

When the result of step 131 shows that the chords are different, at step 133 a judgement is made as to whether a melody tone is produced or not in accordance with the content of the melody key-on flag MLKON-FLG. When a melody tone is produced, in a subroutine (Sub-CM600) of step 139 a counter melody tone related to a melody tone and new chord constituting tones is determined. However, when no melody tone is produced, in a subroutine (Sub-CM500) of step 140 a counter melody tone related to the new chord constituting tones is determined.

When the result of the judgement executed at step 131 shows that the previously designated chord and the presently designated chord are the same, the program is branched from step 131 to step 132 at which a first same chord flag SMCD1-FLG showing that the previous chord and the present chord are the same is set (logic "1"). Then at step 134 a judgement is made as to whether the previously designated chord is the same as the chord designated before the previously designated chord in accordance with a second same chord flag SMCD2-FLG. If the result of this judgement shows that the previous chord is different from a chord before that chord, at step 135 a judgement is made as to whether a melody tone is now being produced or not according to the content of the melody key-on flag MLKON1-FLG.

When the melody tone is being produced the program is advanced to a subroutine (Sub-CM400) of step 138 where a counter melody tone is determined when the same chord is continuously repeated twice and when there is a melody tone being produced.

However, where the present chord is the same as just preceding two chords, in other words, when the same chord is continuously designated three times, according to the result of the judgement at step 134, the program is branched to a subroutine (Sub-CM200) of step 137. Even when the present and previous chords are the same, when no melody tone is produced according to the result of the judgement of step 135 the program is advanced to a subroutine (Sub-CM200) of step 137. Accordingly, in the subroutine (Sub-CM200) a counter melody tone is determined when the same chord continues at least twice and there is no melody tone produced, or when the same chord continues 3 times irrespective of the presence or absence of a melody tone.

According to the processings described above, a counter melody tone corresponding to the performance mode is determined. After that the program is advanced to a subroutine (Sub-CM900) of step 144 at which various flag registers are reset or their contents are exchanged for the purpose of transferring data for producing counter melody tones or for processing the next new event.

The counter melody tones determined by the procedures for determining respective melody tones are corrected their tone production ranges so that the counter melody tones would be produced in a tone range between G1 to G2.

Figure 10:
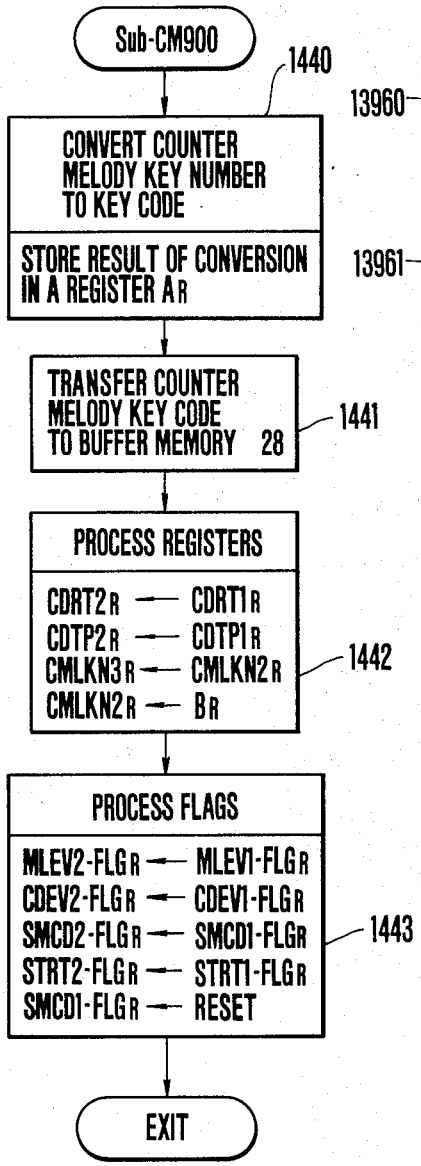
FIG. 10 is a flow chart of a detailed subroutine for executing a flag processing.

The detail of the subroutine (Sub-CM900) for processing the flag of step 144 is shown by a flow chart shown in FIG. 10. More particularly, at step 1440 a processing is executed for converting the counter melody key number CMLKN1 corresponding to the counter melody tone determined by any one of the counter melody determining procedures to a key code KC, and the reset of conversion is stored in the A register $A_R$. After that, at step 1441 a key code KC corresponding to the counter melody tone is transferred from the A register $A_R$ to the counter melody buffer memory device 28, whereby the tone generator 21 forms a counter melody tone.

Then at step 1442, for the purpose of coping with the next new event, register processings are executed for exchanging the contents of various registers. More particularly, the content of the first chord root key number register $CDRT1_R$ is transferred to and stored in the second chord root key number register $CDRT2_R$, while at the same time the content of the first chord type register $CDTP1_R$ is transferred to and stored in the second chord type register $CDTP2_R$. Furthermore the content of the second counter key melody key number register $CMLKN2_R$ is transferred and stored in the second counter melody key number register $CMLKN3_R$, while at the same time, the key number CMLKN1 of a counter melody tone which is newly determined and is being stored in the B register $B_R$ is transferred and stored in the second counter melody key number register $CMLKN2_R$.

By these register processings, a key number KN representing the root of the newly designated chord constituting tones is stored in the second chord root key number register $CDRT2_R$ as the key number KN of the previously designated root, whereas a chord type data representing the type of the newly designated chord is stored in the second chord root type register $CDTP2_R$ as the chord type data of the type of the previously designated chord. Furthermore, a key number CMLKN2 representing the previous counter melody tone is stored in the third counter melody key number register $CMLKN3_R$ as the key number CMLKN3 representing the counter melody tone of two times before.

Also in the next step 1443, the contents of various flags are exchanged for coping with a next new event. More particularly, the content of the first melody event flag register $MLEV1\text{-}FLG_R$ is transferred and stored in the second melody event flag register $MLEV2\text{-}FLG_R$, while the content of the first chord event flag register $CDEV1\text{-}FLG_R$ is transferred to and stored in the second chord event flag register $CDEV2\text{-}FLG_R$. In the same manner, the content of the first same code flag register $SMCD1\text{-}FLG_R$ is transferred and stored in the second same chord flag register $SMCD2\text{-}FLG_R$, while the content of the first start flag register $STRT1\text{-}FLG_R$ is transferred and stored in the second start flag register $STRT2\text{-}FLG_R$. Further, the content of the first same chord flag register $SMCD1\text{-}FLG_R$ is reset (logic "0").

By these flag processings, only when the present event is a melody event, a flag $MLEV2\text{-}FLG_R$ showing that the previous event was the melody event is stored in the second melody event flag register $MLEV2\text{-}FLG_R$. Also only when the present event is a chord event, a flag CEDV2-FLG showing that the previous event was the chord event would be stored in the second chord event flag register $CDEV2\text{-}FLG_R$. Furthermore, only when the present chord event is the same chord event as the previous event, a flag SMCD2-FLG showing that the previous event was the same chord event as the chord event preceding the previous event would be stored in the second same chord flag register $SMCD2\text{-}FLG_R$, and a flag STRT2-FLG showing that the previous event was the event at the beginning of the music would be stored.

Figure 11:
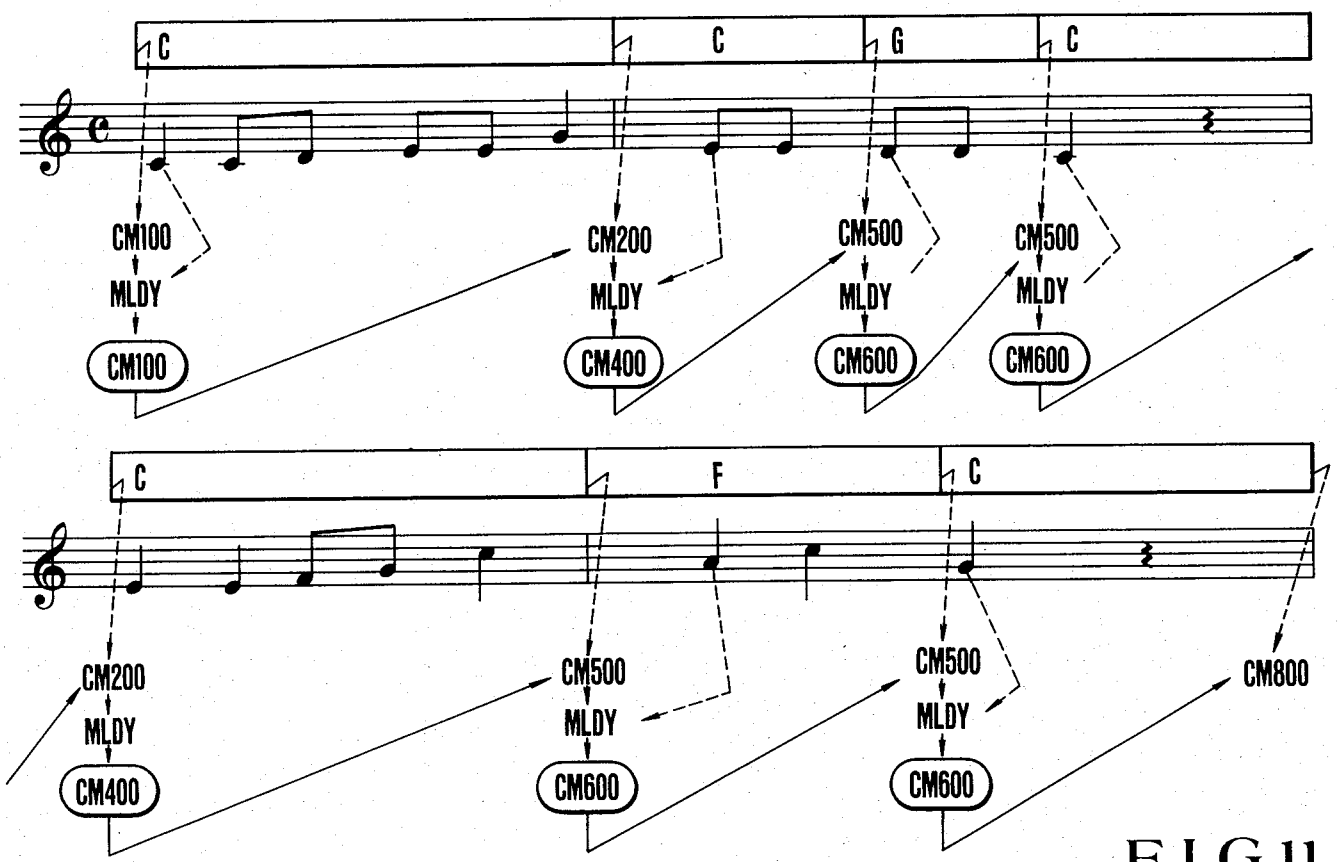
FIGS. 11 and 12 show musical scores for explaining how to use the subroutine shown in FIG. 4.

The content of the chord hold flag register $CDDT\text{-}FLG_R$ is renewed by a code detection processing each time a chord event is produced. Also the content of the melody key-on flag register $MLKON\text{-}FLG_R$ is renewed by a flag resetting process (step 111 shown in FIG. 4) executed each time an event is produced.

Where a music as shown by a musical score shown in FIG. 11 is performed, a manner of detemining a counter melody by using which one of the subroutines will be described briefly. Symbols C, G, F, etc. on the score as shown in FIG. 11 represent chord names, letters CM100, MLDY, CM500, etc. beneath the score represent titles of respective subroutines determining counter melody tones, solid arrows show variations in the subroutine, while dotted line arrows show conditions of changing the subroutines.

It is assumed that designation of a chord is made prior to the key operation of a melody tone, and that the first measure appears at the beginning of a music.

In FIG. 11, when a C minor chord code is designated at the beginning of the first measure, since the event of this chord corresponds to the beginning of the music, according to the judgement executed at step 128 shown in FIG. 4 the program is advanced to the subroutine (Sub-CM100) of step 136. Then in this subroutine, a counter melody tone at the beginning of the music is determined according to a processing predetermined by the content thereof. At this time, since the keys for a melody tone is not yet depressed, the counter melody tone at the beginning of the music is determined only when a melody tone is not produced.

However, a key for a C note (do) melody tone is depressed succeeding to the designation of the C minor chord code, and when the result of judgement executed at step 129 shown in FIG. 4 is No, the program is advanced to the subroutine (Sub-MLDY) of step 130. Then in this subroutine (Sub-MLDY), a judgement is made as to whether the present melody event has been produced or not in a time (about 150 ms) following the previous chord event. When the present melody event has been produced within the time T, it is assumed that the melody event has been produced at the same time as the previous chord event and for the purpose of determining again a counter melody tone by taking into consideration such new melody tone, a subroutine is newly selected for determining again a counter melody tone by referring to the contents of the start flag STRT2-FLG and the same chord flag SMCD2-FLG. For this reason, when the key of a note C melody tone is depressed within the time T following the designation of the C minor chord, the subroutine (Sub-CM100) is again selected for the purpose of determining again the counter melody tone when the melody tone is produced in the subroutine (Sub-MLDY). Consequently, the program is returned to the subroutine (Sub-CM100) where the counter melody tone is determined again only when the C minor chord and the note C melody tone are being produced.

The tone producing range of the counter melody tone firstly determined in the subroutine (Sub-CM100) is corrected in the subroutine (Sub-CM900) for processing the flag for preparing to transfer the counter melody tone to the counter melody buffer memory device 28. But where a new counter melody tone is determined again by a melody event within time T the previously determined counter melody tone is invalidated, whereas the counter melody tone determined again later is made effective and transferred to the counter melody buffer memory device 28.

A flag processing subroutine (Sub-CM900) executed after the execution of each of the subroutines (Sub-CM100) (Sub-MLDY) and (Sub-CM500) is not shown in FIG. 11.

As the counter melody tone at the beginning of a music is determined as above described, the program is returned to the main routine via the subroutine (Sub-CM900) to come into a waiting state for a new event.

After that when the keys for melody tones of the notes C (do), D (re), E (mi), E (mi) and G (so) at the first measure are sequentially depressed, since in this case melody events are continuous, according to the results of judgements at steps 123 and 124 shown in FIG. 4 the program is branched to step IN and then returned to the main routine without executing any processing. More particularly, where the melody events are continuous, processing regarding the counter melody tone would not be executed.

When a C minor chord is designated at the second measure, since the chord is the same as the previous chord, the program is branched to step 132 according to the result of judgement at step 131, and then branched to the step 135 according to the result of judgement of step 134. At this time, since keys for the melody tones are not yet depressed, the program is advanced to the subroutine (Sub-CM200) of step 137 according to the result of judgement at step 135. In this subroutine, when there is no melody tone produced and when the same C minor chord is continuously produced twice, a corresponding counter melody tone is determined.

However, when the key for the note E (mi) melody tone is depressed within the time T after designation of the C minor chord, in the same manner as in the case of the first measure the program is advanced to the melody delay processing subroutine (Sub-MLDY) to select a subroutine (Sub-CM400) for determining again the counter melody tone in which the same chord continues and the tone production of the melody tone is added. Consequently, the program returns again to the subroutine (Sub-CM400) where the C minor chord is produced continuously and a counter melody tone in which the note E (mi) melody tone is produced is determined again, whereby the counter melody tone thus determined again is produced.

Then when the key for producing note E (mi) melody tone is depressed, since this means that the melody events are produced continuously, the program is returned to the main routine without executing the counter melody tone formation.

When a G minor chord is designated at an intermediate point of the second measure, since this means that this chord is different from the previous chord, the program is branched to step 133 according to the result of judgement of step 131. Since at this time, the keys for the melody tone have not yet been depressed the program is advanced to the subroutine (Sub-CM500) according to the result of judgement at step 133. However, when the key for the note D melody tone is depressed within succeeding time T, the program is advanced to the subroutine (Sub-MLDY) for processing a melody delay. In this subroutine a subroutine (Sub-CM600) is selected that determines again the counter melody tone where the chord varies and a melody tone is produced. Consequently, the program is advanced to the subroutine (Sub-CM600) where a new counter melody tone is dtermined again which satisfies the conditions described just above. Accordingly, the counter melody tone thus determined again is produced.

By repeating these processings, at the time of performing the musical score shown in FIG. 11, the counter melody tone is determined by the subroutine (Sub-CM100), the second measure by the subroutines (Sub-CM400) and (Sub-M600), third measure by the subroutine (Sub-CM400) and the fourth measure by the subroutine (Sub-CM600) respectively. When the designation of the chord disappears at the fourth measure, in the subroutine (Sub-CM800) of step 143 shown in FIG. 4, the counter melody tone is released, that is tone production is stopped.

Figure 12:
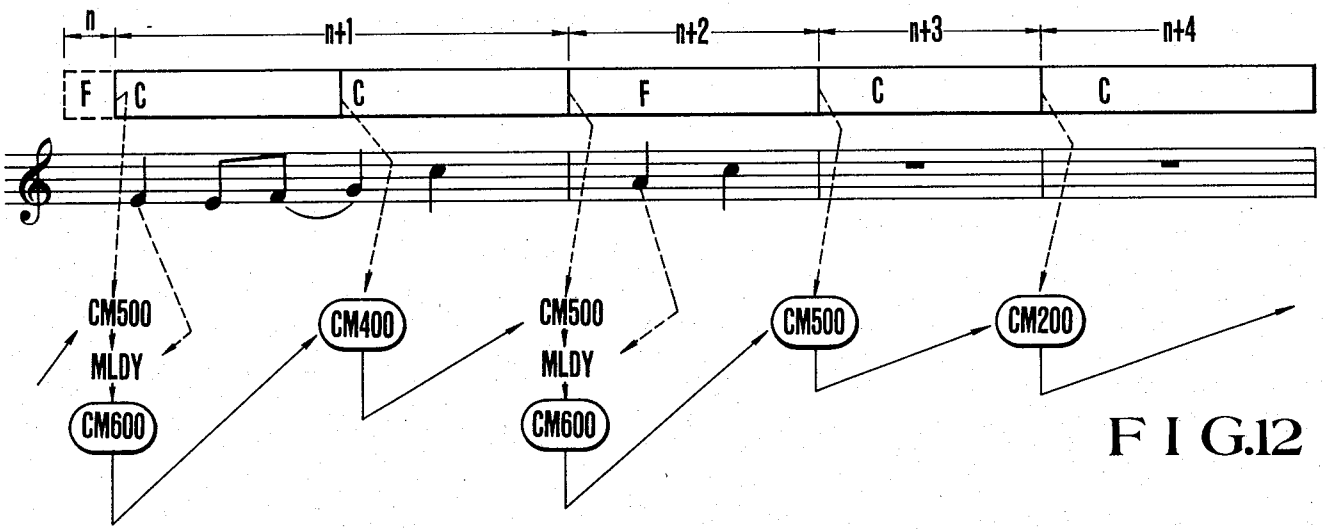

In a case of a music shown by a musical score between the (n+1)th measure shown in FIG. 12 and the (n+4)th measure, at the beginning of the (n+1)th measure, a counter melody tone is determined in the subroutine (Sub-CM600), but when a C minor chord same as that of a measure is designated at the beginning thereof, the program is branched to step 132 according to the result of judgement of step 131 shown in FIG. 4, and then branched to step 135 according to the result of judgement at step 134. However, when the second C minor chord code is designated, since an F (fa) melody tone and a G (so) melody tone are produced continuously it means that the melody tone has already been produced, whereby the program is advanced to the subroutine (Sub-CM400) according to the result of judgement of step 135. In this subroutine, where a counter melody tone is determined in which a chord same as the previous chord has been produced continuously.

As the F minor chord is designated at the (n+2)th measure, since this chord is different from the previous chord, the F minor chord is designated in the subroutine (Sub-CM600) as above described and a counter melody tone is produced only when the note A melody tone is produced.

Then when a C minor chord is designated at the (n+3)th measure, although this chord is different from the previous chord, a counter melody tone is determined in the subroutine (Sub-CM500). More particularly, since no melody tone is produced at the (n+3)th measure, the program is advanced to the subroutine (Sub-CM500) according to the result of judgement of step 133 shown in FIG. 4, at which a counter melody tone is determined when no melody tone is produced and a chord different from the previous chord is designated.

Then, when a C minor chord same as the previous chord is designated at the (n+4)th measure, although the same chord is produced continuously, since no melody tone is produced, the program is advanced to subroutine (Sub-CM200) according to the result of judgement at steps 131 through 135 so that a counter melody tone is determined in which the same chord code is cotinuously deignated and no melody tone is produced.

As can be noted from the foregoing description, in many cases the counter melody tone is determined by the subroutine (Sub-CM600).

Processes for determining counter melody tones corresponding to the state of designation of the chord and the state of performance of the melody tone will be described hereunder for respective routines with reference to detailed flow charts shown in FIG. 13 and the following drawings and showing a program of determining a melody tone.

For the sake of description the state of performing a chord and a melody tone these performances are divided into Chapter 1 through Chapter 7 as shown in the following Table VIII.

Since subroutine (Sub-CM800) is used only to clear the content of the counter melody buffer memory device 28, its description will not be made.

TABLE VIII

| | Name of subroutine | State of performance |
|---|---|---|
| Chapter 1 | Sub MLDY | Where keys of melody tones are not depressed following depression of a chord |
| Chapter 2 | Sub CM100 | The beginning of music |
| Chapter 3 | Sub CM400 | The same chord continues twice and melody tone is produced. |
| Chapter 4 | Sub CM200 | The same chord continues more than 3 times, or the same chord is continuously designated twice and no melody tone is produced. |
| Chapter 5 | Sub CM600 | Present event is a chord event and melody tone is produced. |
| Chapter 6 | Sub CM500 | The present chord is a chord event and no melody tone is produced |
| Chapter 7 | Sub CM700 | Chord event that does not hold as normal chord code |

Chapter 1. Detail of Subroutine (Sub-MLDY)

As above described, in the subroutine (Sub-CMEL) shown in FIG. 4, each time a chord event is produced, a subroutine that determines a specific counter melody tone is selected according to the result of analysis of the performance mode, and a new counter melody tone is determined by taking into consideration the relations among melody tones in respective subroutines.

At a point at which the measure changes, however, designation of a chord and key operation of a melody tone which should be made at the same time from the standpoint of a musical score are made at different timing. That is in a normal case, the chord is designated first and then the keys of a melody tone are depressed so that a counter melody tone determined immediately after the designation of the chord has no relation with the newly designated chord but is determined by considering the relation regarding the last melody tone of the previous measure.

Where a melody event following a chord event is produced within the predetermined time T, in the subroutine (Sub-MLDY) a subroutine is selected for determining again a counter melody tone by invalidating a counter melody tone determined before the key operation of a melody tone and by considering the relation with respect to the new melody tone, and by considering that the melody event is produced at the same time as the designation of the chord. Consequently, either one of the subroutine, (Sub-CM100), (Sub-CM400) and (Sub-CM600) is selected.

Figure 13:
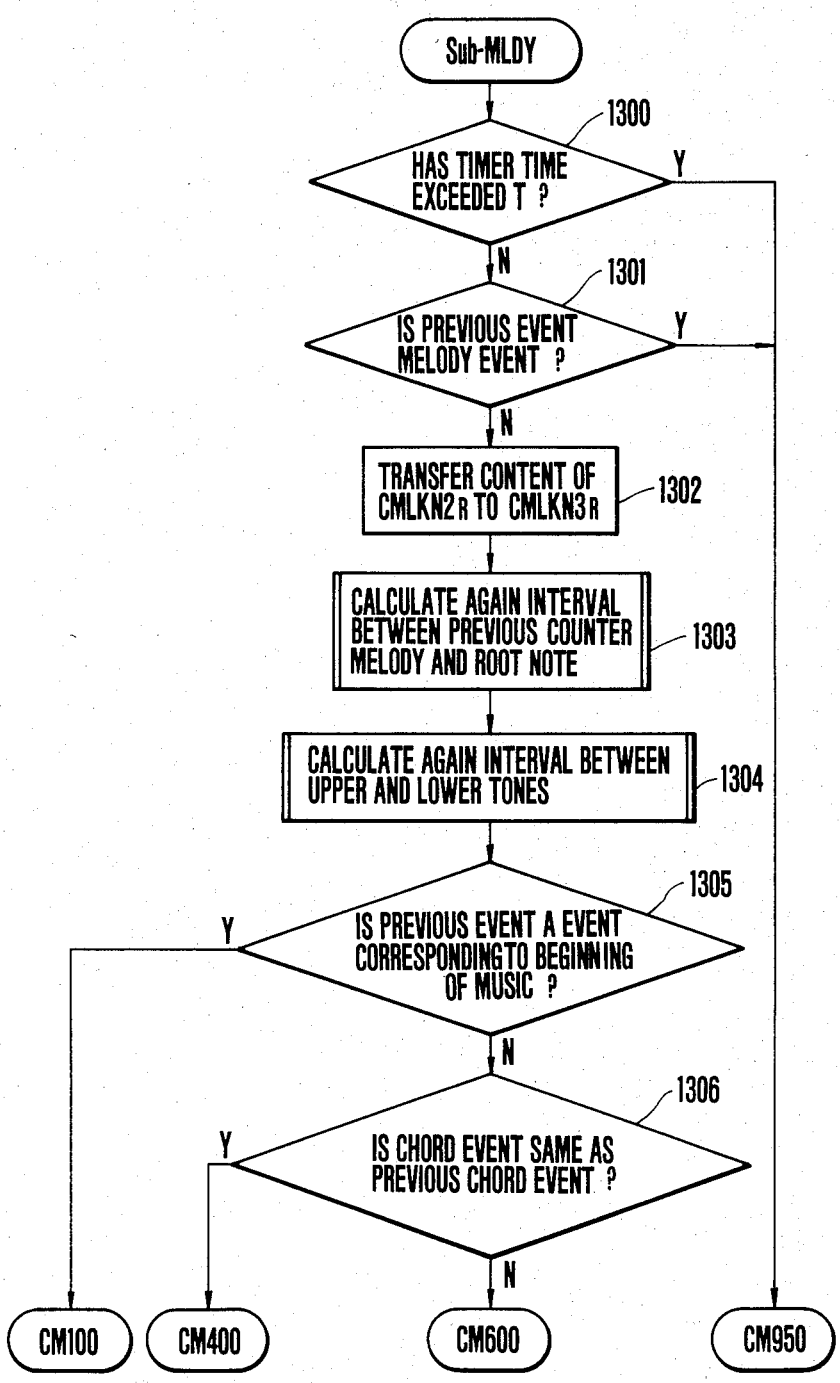
FIG. 13 is a flow chart showing the detail of a subroutine for meeting a delay in the operation of melody keys.

FIG. 13 is a flow chart showing the detail of the subroutine (Sub-MLDY). At step 1300 a judgement is made as to whether the time of the timer 27 (see FIG. 1) has exceeded the predtermined time T (T=150 ms) or not. As has been pointed out hereinbefore, the timer 27 is reset in the main routine shown in FIG. 2 when a chord event is produced and starts its timing function. Under this state, when a melody event is produced following the chord event, the program is advanced from the subroutine (Sub-CMEL) shown in FIG. 4 to step 1300 of the subroutine (Sub-MLDY) to judge whether the time measured by the timer has exceeded the predetermined time T.

In other words, a judgement is made as to whether the melody event following the chord event has been produced within time T or not. If the time measured by the timer exceeds the time T, the program is returned to the main routine by noting that the present melody event is not of the same timing as the previous timing. Accordingly, in this case, a counter melody tone determined immediately after the production of the chord event is considered effective.

However, if the time measured by the timer is less than the time T, at the next step 1301 a judgement is made as to whether the previous event was a melody event or not according to the content of the melody event flag MLEV2-FLG. When the result of judgement is YES, the program is returned to the main routine.

However, when the previous event was a chord event, it is judged that the present event is the first melody event following the chord event within time T so that it should be processed at the same time as the previous chord event, and the program is advanced to the next step 1302 where the content of two step before of the counter melody key number register $CMLKN3_R$ is transferred to the previous counter melody key number register $CMLKN2_R$. In other words, the content of the register $CMLKN3_R$ is transferred to the previous counter melody key number register $CMLKN2_R$ for the purpose of processing the key number CMLKN3 of the counter melody tone produced before the chord as the key number DMLKN2 of the previous counter melody tone.

As the previous counter melody key number CMLKN3 is returned to the counter melody key number CMLKN2 of two steps before in the succeeding steps 1303 and 1304, the spacing CMLVSC between the previous counter melody tone and the root, the down distance $DWDIST_R$ and updistance are calculated again.

More particularly the spacing CMLVSC between the previous counter melody and the root, down distance DWDIST and updistance UPDIST have already been calculated at steps 126 and 127 prior to the processing of the melody delay in which a counter melody tone before producing a melody event is taken as the previous counter melody tone since the melody event has already been produced following the chord event within time T. However, when the first melody tone has produced following the chord event within time T, as it is necessary to process the counter melody tone before producing the chord event as the previous counter melody tone, the spacing CMLVSC between the previous counter melody tone and the root, the down distance DWDIST and the up distance UPDIST which have been calculated before commencing the melody delay processing become useless.

For this reason, where the first melody event succeeding the chord event is produced within time T, a counter melody tone produced before the chord event is returned to the previous counter melody tone. Based on this melody tone the spacing CMLVSC between the previous counter melody tone and the root, the down distance DWDIST and the up distance UPDIST are calculated again at steps 1303 and 1304.

Then at the next step 1305, a judgement is made as to whether the previous event, that is the chord event was an event corresponding to the beginning of a music or not in accordance with the content of the second start flag STRT2-FLG. If the chord event at this time corresponds to the beginning of the music the subroutine (Sub-CM100) would be selected. Otherwise, at step a judgement is made as to whether the chord event was the same chord event of the same chord according to the content of the second same chord code flag SMCD2-FLG. If the result of judgement shows that the chord event was the same as the chord event of the previous chord, the subroutine (Sub-CM400) would be selected.

If the chord event was different from the previous chord event, the subroutine (Sub-CM600) would be selected.

The counter melody tone in a case in which keys of a melody tone are depressed within the time T after the designation of the chord, is determined again in either one of the subroutines (Sub-CM100), (Sub-CM400) and (Sub-CM600) selected as above described.

Thus even when the designation of the keys and the key depression of a melody tone are not made at the same time it is possible to determine an optimum counter melody tone by taking into consideration the relation with reference to the melody tone.

Chapter 2—Detail of the Subroutine (Sub-CM100)

As described above, a counter melody tone should have smoothly varying tone pitch and is produced when a chord is designated, but when determining a counter melody tone based on a chord firstly designated at a portion corresponding to the beginning of a music, the starting point of pitch variation is vague because the previous melody tone does not present. Unless a special counter melody determining performance is provided, it is impossible to determine a counter melody tone whose pitch varies smoothly at the portion corresponding to the beginning of the music.

For this reason, the subroutine (Sub-CM100) is provided which is constructed such that the root (first tone) among the chord constituting tones (maximum 5) determined at the first time is corrected so as to determine that it is the counter melody tone at the beginning of the music.

Figure 14:
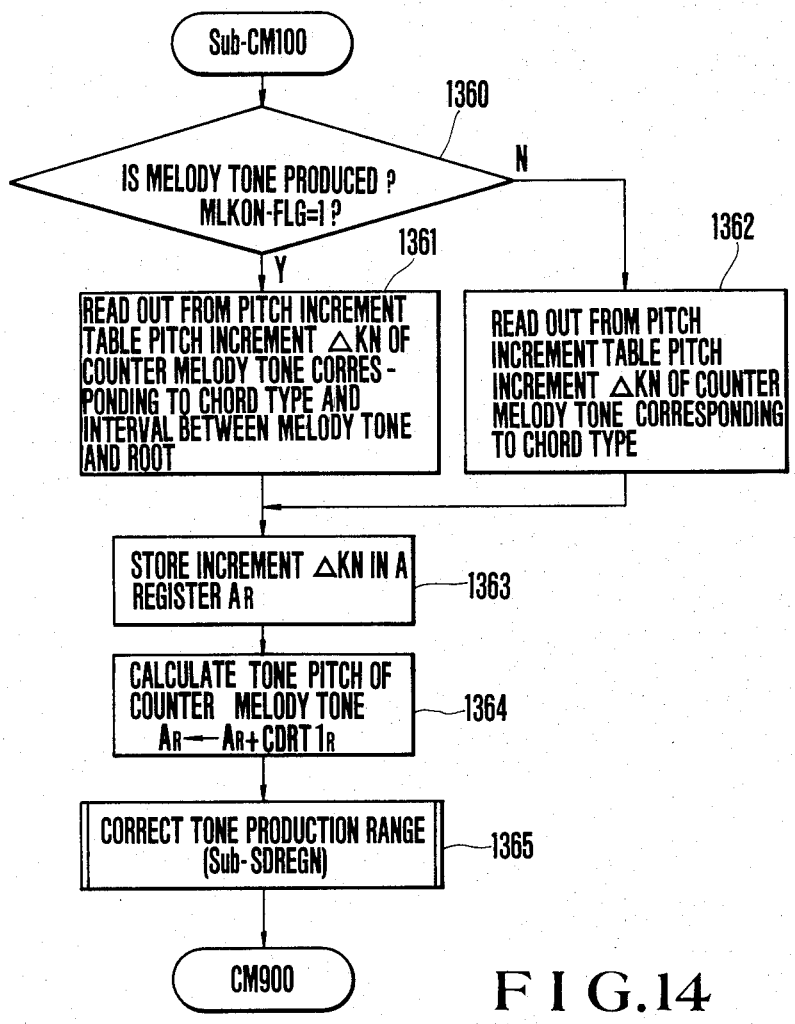
FIG. 14 is a flow chart showing the detail of a subroutine for determining a counter melody tone at the beginning of a music.

FIG. 14 is a flow chart showing the detail of the subroutine (Sub-CM100) in which the processings at steps 1360 through 1365 are started by the judgement at step 128 or the selection of the melody delay processing routine effected at step 130.

At step 1360 a judgement is made whether a melody tone is produced or not according to the content of the melody key-on flag MLKON-FLG. When the result of judgement shows that the melody tone is produced, at step 1261 the pitch increment of the root corresponding to the chord type CDTP and the spacing MVSC between the melody tone and the root is calculated as the increment ΔKN of the key number by using the following Table IX.

More particularly, the constant memory device 20 is prestored with the interval between the root among the chord constituting tones and a new counter melody tone, as the increment ΔKN of the key number, corresponding to the chord type and the spacing between a melody tone and the root. Thus the tone pitch of the root is corrected by the increment ΔKN of the key number corresponding to the chord type CDTP and the spacing MVSC between the melody tone and the root and for the purpose of using the corrected tone pitch as the key number CMLKN1 as a new counter melody tone. The constant memory device 20 is given with an address information corresponding to the chord type CDTP and the spacing MVSC between the melody tone and the root. As a consequence, the increment ΔKN of the key number CDRS1 of the root that is the corrected value of the tone pitch of the root.

TABLE IX (Tone pitch increment table)

| | MVSC | | | | | | | | | | | | |
|---|---|---|---|---|---|---|---|---|---|---|---|---|---|
| CDTP | 0 | 1 | 2 | 3 | 4 | 5 | 6 | 7 | 8 | 9 | A | B | No melody |
| M | 4 | 7 | 7 | 7 | 7 | 0 | 4 | 4 | 4 | 4 | 4 | 4 | 4 |
| 7 | 4 | 4 | 10 | 10 | 10 | 10 | 10 | 10 | 4 | 4 | 4 | 4 | 4 |
| 6 | 9 | 9 | 9 | 9 | 9 | 9 | 4 | 4 | 4 | 4 | 4 | 4 | 4 |
| M7 | 4 | 4 | 11 | 11 | 11 | 11 | 11 | 11 | 4 | 4 | 4 | 4 | 4 |
| m | 3 | 7 | 7 | 7 | 7 | 0 | 3 | 3 | 3 | 3 | 3 | 3 | 3 |
| m7 | 3 | 7 | 7 | 7 | 7 | 0 | 3 | 3 | 3 | 3 | 3 | 3 | 3 |
| m7-5 | 3 | 6 | 6 | 6 | 6 | 10 | 10 | 10 | 3 | 3 | 3 | 3 | 3 |
| dim | 3 | 6 | 6 | 6 | 9 | 9 | 9 | 3 | 3 | 3 | 3 | 3 | 3 |
| Aug | 8 | 8 | 8 | 8 | 8 | 8 | 4 | 4 | 4 | 4 | 4 | 8 | 4 |

For example, in the case of a musical score shown in FIG. 11, the chord type is major (M) and the interval between melody and the root MVSC is "0". Accordingly "4" is read out as the increment ΔKN.

However where there is no melody tone produced, (that is when the result of judgement at step 1360 is NO), the program is advanced to step 1362 so as to read out the increment ΔKN only corresponding to the chord type CDTP from a tone pitch increment Table.

For example, where there is no melody tone produced when a C major chord is designated, "4" is read out as the increment ΔKN.

The increment ΔKN of the key number of the root read out as above descirbed in accordance with the presence or absence of a melody tone is temprorarily stored in the A register $A_R$ in the arithmetic processing unit 12 at step 1363. At the next step 1364, the key number CDRT1 stored in the first code route key number register $CDRT1_R$ is added to the increment ΔKN temporarily stored in the A register $A_R$.

The sum is temporarily stored in the A register $A_R$ as a key number CMLKN1 representing the tone pitch of a new counter melody tone, and then at step 1365, the tone production range is changed to G1 to G2 in a subroutine Sub-SDREGN used to correct the tone production range to produce a counter melody tone.

For example, in the case of the musical score shown in FIG. 11, when a C major chord has a tone range of C1 to B1, since the melody tone is a note C, the result of calculation at step 1364 becomes $$A_r + CDRT1_r = (0+4)+0=4$$

so that tone E1 (mi) spaced 4 semi-tones from the root note of note C would be determined as the new counter melody tone.

As shown in the followng Table X, the increment is determined such that the newly determined counter melody tone and the root will have a relation of 3rd or 6th. Accordingly, a counter melody tone having a harmonic relation with respect to a melody tone can be determined.

Figure 15:
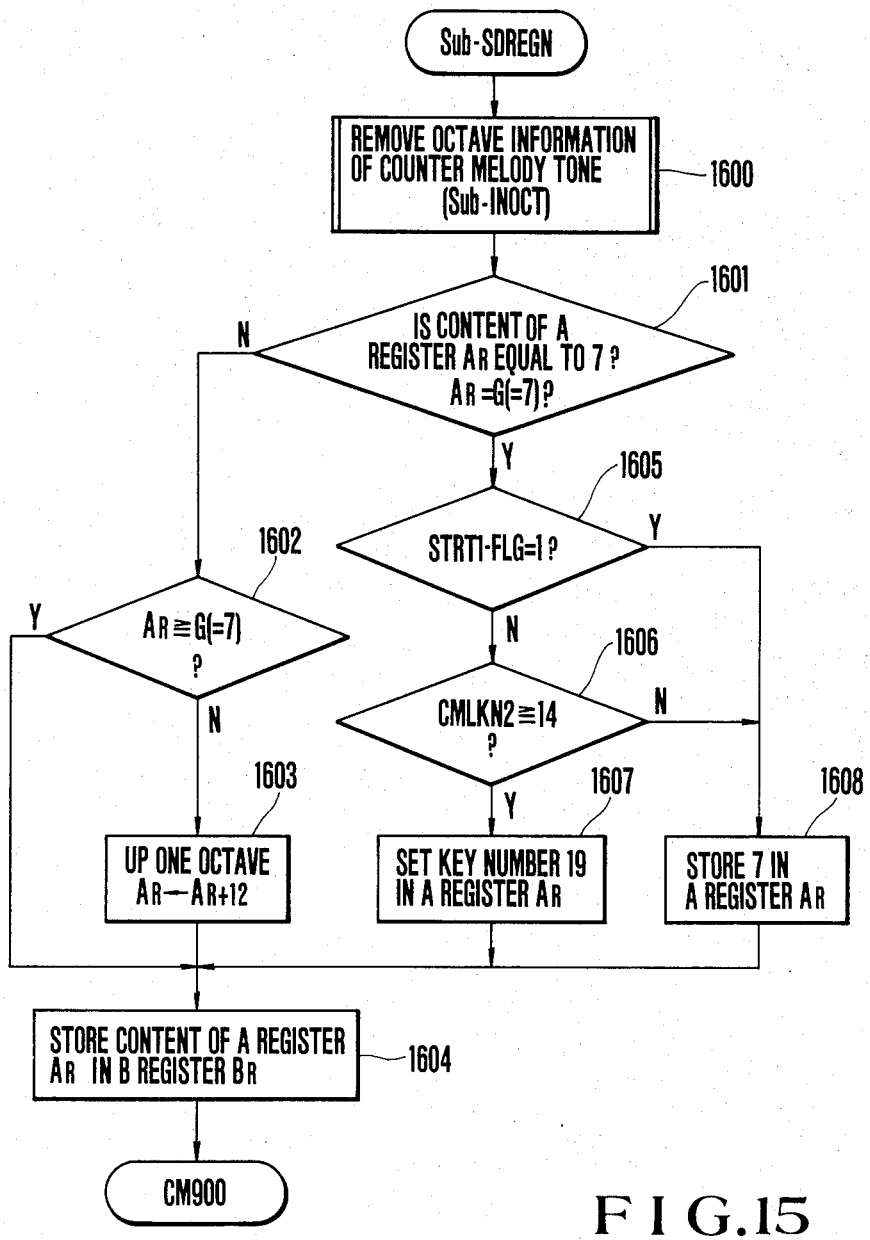
FIG. 15 is a flow chart showing the detail of a subroutine for correcting a tone producing range of a counter melody tone.

The detailed flow chart of the subroutine (Sub-SDREGN) in which the tone production range is corrected at step 1365 is shown in FIG. 15.

Thus, in a subroutine (Sub-INOCT) of step 1600 shown in FIG. 15 a processing for removing the octave information element of the counter melody tone is executed. Thus, the octave information element of the key number CMLKN1 corresponding to the tone pitch of the counter melody tone is removed and converted into an information represented by a value "0" through "B" (hexadecimal notation) as shown in Table VI. The result of this processing is temporarily stored in the A register $A_R$.

At step 1601 a judgement is made as to whether the content of A register $A_R$ is equal to "7" or not, in other words whether the note of the counter melody tone is G or not. When the result of judgement shows that the note of the newly determined counter melody tone is not G, at step 1602 a judgement is made as to whether the content of A register $A_R$ is larger than the key number of note G. If the result of this judgement is YES, the key number (CMLKNI) is transferred from A register $A_R$ to B register $B_R$ as a key number corresponding to the tone pitch of a counter melody tone which should be produced by the key number CMLKN1.

More particularly, the newly determined key number CMLKN1 corresponds to either one of the notes G# through B, this key number is transferred to B register $B_R$ as the key number of a counter melody tone to be lastly produced by the key number CMLKN1 whereby the counter melody tone is produced in the tone range of G#1 through B1.

However, when the key number CMKN1 of the newly determined counter melody tone is smaller than the key number of note G, the program is advanced from step 1602 to step 1603 where a key number 12 corresponding to the interval of one octave is added to correct the key number to a key number on the higher tone side by one octave.

More particularly, when the key number CMLKN1 of the newly determined counter melody tone is either one of the note F# through c, "12" is added to the key number CMLKN1 representing this note so as to correct it to a key number representing notes F#2 through C2 on the higher tone side by one octave. At step 1604 this corrected key number is transferred to the B register $B_R$ and then, in a subroutine (Sub-CM900) shown in FIG. 10, converted into a corresponding key code KC which is transferred to the counter melody buffer memory device 28.

However, when the newly determined counter melody tone is the note G, the program is advanced from step 1601 to step 1605 where a judgement is made as to whether the present event corresponds to the beginning or not according to the content of the first start flag STRT1-FLG. If the event corresponds to the beginning of the music, at step 1608, the value 7 of a key number representing the note G1 is stored in the A register $A_R$ and then the content of the A register $A_R$ is transferred to B register $B_R$ at step 1604. More particularly, when the counter melody tone determined at the beginning of the music is a note G, the note G1 would be produced as a new counter melody tone.

However when the present event is an event at the beginning of the music the program is advanced from step 1605 to 1606 where a judgement is made whether the previous counter melody tone is a tone on the high tone side of higher than D2 (the key number is larger than 14) by again taking into consideration the previous counter melody tone. When the result of judgement is YES, at step 1607 after setting in the A register $A_R$ the key number 19 representing the note G2 the key number is transferred to B register B2. Conversely when the previous counter melody tone is on the lower tone side lower than C#1 (the key number is less than 13), the program is branched to step 1608 where a key number 7 representing this tone is set in the A register A2 and then transferred to the B register $B_R$.

Accordingly, in a musical score shown in FIG. 11, for example, in the subroutine (Sub-CM100) shown in FIG. 14, although note E1 is determined as the counter melody tone at the beginning of the music but this note is on the lower tone side than note G in one octave tone range, at step 1603, the tone is produced after being corrected to note E2 one octave above.

In the flow chart shown in FIG. 15 the subroutine (Sub-INOCT) provided for the purpose of eliminating an octave information element from the key number CMLKN1 corresponding to the counter melody tone is the same as that shown in FIG. 7 so that it is not described.

In the flow chart shown in FIG. 15 keys for a melody tone are operated within time T subsequent to the designation of a chord, although the B register B2 is storing the key number of a counter melody tone determined prior to the key operation of the melody tone, this key number is not immediately transferred to the counter melody buffer memory device 28 but delayed until the melody is delayed and a melody tone is added to determine again the new counter melody tone. When the new counter melody tone is determined again the key number of the new counter melody tone is sent out as the key number of the counter melody tone to be actually produced.

As above described, at the beginning of a music, the root is corrected in accordance with the chord type CDTP and the spacing between the melody and the root to determine a counter melody tone, thus producing a most suitable counter melody tone.

Chapter 3—Detail of Subroutine (Sub-CM400)

In a performance state in which the same chord is continuously designated and the flow of the music is stable, it is advantageous to produce a counter melody tone in which the flow of the music is varies.

This subroutine (Sub-CM400) is provided for this reason.

There are the following three performance states in which the same chord continues.

(a) the same chord continues twice and a melody tone is also produced.

(b) irrespective of the presence and absence of a melody tone, the same chord continues more than three times.

(c) no melody tone is produced but the designation of the same chord continues twice.

In this case, the subroutine (Sub-CM400) determines a counter melody tone under state (a), whereas a counter melody tone under states (b) and (c) is determined by the subroutine (Sub-CM200).

Figure 16:
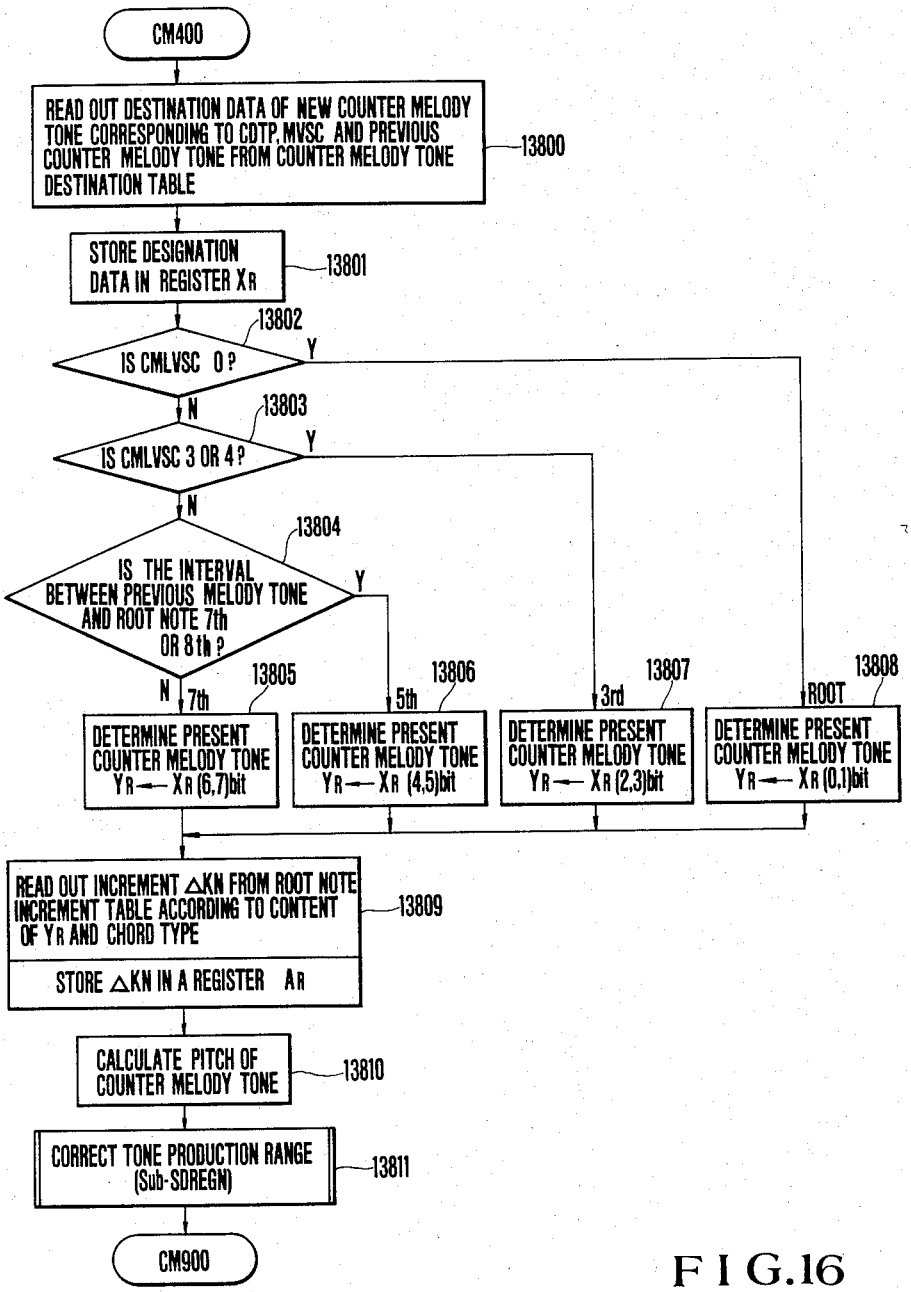
FIG. 16 is a flow chart showing the detail of a subroutine that determines a counter melody tone in which a melody tone is produced in case of the same chord succession.

FIG. 16 is a flow chart showing the detail of subroutine (Sub-CM400) in which steps 13800 through 13811 are started when the state (a) is detected based on the result of analysis of subroutine (Sub-CMEL) shown in FIG. 4. There are two program processing paths, viz, a path started after the judgement at step 135 shown in FIG. 4, and a path started after the judgement of the melody delay.

In the flow chart shown in FIG. 16, at step 13800 a designation data which designates that which one of the chord constituting tones should be designated as the new counter melody tone is read out from a counter melody tone destination table in the constant memory device 20 in accordance with the spacing between the melody tone and the root and the chord type CDTP.

In other words, a designation data designating that the new counter melody tone should be moved to which one of the chord constituting tones are read out from the counter melody destination table.

As shown in the following Table X, the designation data are determined by combinations of the spacing MVSC between the melody tone and the root. When the destination of the new counter melody tone is the same tone as the root it is represented by a digit "0", when the destination is the same tone as the second tone (3rd tone) it is designated by "1", when the destination is the same tone as the third tone (5th tone) it is designated as "2", and when the destination is the same tone as the fourth tone (7th) it is represented by "3".

According to whether the previous counter melody tone corresponds to either one of the root, the second tone, the third tone and the fourth tone of the present chord constituting tones, the designation data are stored in memory addresses in which 8 bits constitute one word, in discrete two bits.

TABLE X (Counter melody destination table)

| | MVSC CDTP | 0 | | 1 | | 2 | | 3 | | 4 | | 5 | |
|---|---|---|---|---|---|---|---|---|---|---|---|---|---|
| do, mi, so, | M | 1 | 1 | 2 | 2 | 2 | 2 | 2 | 2 | 2 | 2 | 0 | 0 |
| | | 1 | | 2 | | 2 | | 2 | | 2 | | 0 | |
| do, mi, so, ti$^b$ | 7 | 1 | 1 | 2 | 2 | 3 | 3 | 3 | 3 | 3 | 2 | 3 | 3 |
| | | 1 | 2 | 2 | 3 | 3 | 3 | 3 | 3 | 2 | 3 | 3 | 3 |
| do, mi, so, la | 6 | 3 | 3 | 3 | 3 | 3 | 3 | 3 | 3 | 3 | 3 | 3 | 3 |
| | | 3 | 3 | 3 | 3 | 3 | 3 | 3 | 3 | 3 | 3 | 3 | 3 |
| do, mi, so, ti | M7 | 1 | 1 | 2 | 2 | 3 | 3 | 3 | 3 | 3 | 3 | 3 | 3 |
| | | 1 | 1 | 2 | 2 | 3 | 3 | 3 | 3 | 3 | 3 | 3 | 3 |
| do, mi$^b$, so | m | 1 | 1 | 2 | 2 | 2 | 2 | 2 | 2 | 2 | 2 | 0 | 0 |
| | | 1 | | 2 | | 2 | | 2 | | 2 | | 0 | |
| do, mi$^b$, so, ti$^b$ | m7 | 1 | 1 | 2 | 2 | 2 | 2 | 2 | 2 | 2 | 2 | 0 | 0 |
| | | 1 | | 2 | | 2 | | 2 | | 2 | | 0 | |
| do, mi$^b$, so$^b$, ti$^b$ | m7-5 | 1 | 1 | 3 | 3 | 3 | 3 | 3 | 3 | 3 | 3 | 3 | 3 |
| | | 1 | 1 | 3 | 3 | 3 | 3 | 3 | 3 | 3 | 3 | 3 | 3 |
| do, mi$^b$, so$^b$, la | dim | 1 | 1 | 2 | 2 | 2 | 2 | 0 | 0 | 3 | 3 | 3 | 3 |
| | | 1 | 1 | 2 | 2 | 2 | 2 | 0 | 0 | 3 | 3 | 3 | 3 |
| do, mi, so# | Aug | 2 | 2 | 2 | 2 | 2 | 2 | 2 | 2 | 2 | 2 | 0 | 0 |
| | | 2 | | 2 | | 2 | | 2 | | 2 | | 0 | |

| | MVSC CDTP | 6 | | 7 | | 8 | | 9 | | A | | B | |
|---|---|---|---|---|---|---|---|---|---|---|---|---|---|
| do, mi, so, | M | 0 | 0 | 1 | 1 | 1 | 1 | 0 | 0 | 1 | 1 | 1 | 1 |
| | | 0 | | 1 | | 1 | | 0 | | 1 | | 1 | |
| do, mi, so, ti$^b$ | 7 | 3 | 3 | 3 | 3 | 3 | 1 | 0 | 1 | 2 | 2 | 2 | 2 |
| | | 3 | 3 | 1 | 3 | 2 | 0 | 2 | 0 | 2 | 2 | 2 | 2 |
| do, mi, so, la | 6 | 3 | 3 | 1 | 1 | 1 | 1 | 1 | 1 | 1 | 1 | 1 | 1 |
| | | 3 | 3 | 1 | 1 | 1 | 1 | 1 | 1 | 1 | 1 | 1 | 1 |
| do, mi, so, ti | M7 | 3 | 3 | 3 | 3 | 3 | 3 | 1 | 1 | 1 | 1 | 1 | 1 |
| | | 3 | 3 | 3 | 3 | 3 | 3 | 1 | 1 | 1 | 1 | 1 | 1 |
| do, mi$^b$, so | m | 1 | 1 | 1 | 1 | 1 | 1 | 0 | 0 | 1 | 1 | 1 | 1 |
| | | 1 | | 1 | | 1 | | 0 | | 1 | | 1 | |
| do, mi$^b$, so, ti$^b$ | m7 | 1 | 1 | 1 | 1 | 1 | 1 | 0 | 0 | 1 | 1 | 1 | 1 |
| | | 1 | | 1 | | 1 | | 0 | | 1 | | 1 | |
| do, mi$^b$, so$^b$, ti$^b$ | m7-5 | 3 | 3 | 1 | 1 | 1 | 1 | 1 | 1 | 1 | 1 | 1 | 1 |
| | | 3 | 3 | 1 | 1 | 1 | 1 | 1 | 1 | 1 | 1 | 1 | 1 |
| do, mi$^b$, so$^b$, la | dim | 1 | 1 | 1 | 1 | 1 | 1 | 1 | 1 | 2 | 2 | 2 | 2 |
| | | 1 | 1 | 1 | 1 | 1 | 1 | 1 | 1 | 2 | 2 | 2 | 2 |
| do, mi, so# | Aug | 0 | 0 | 1 | 1 | 1 | 1 | 0 | 0 | 1 | 1 | 2 | 2 |
| | | 0 | | 1 | | 1 | | 0 | | 1 | | 2 | |

More particularly, as shown in the following Table XI, at the 7th and 6th bits are stored a designation data corresponding to a case wherein the previous counter melody tone corresponds to the fourth tone (7th tone)

of the chord constituting tones, at the 5th and 4th bits are stored designation data corresponding to the third tone (5th tone). Further, at the third and second bits are stored designation data corresponding to the second tone (3rd tone), and at the first and zeroth bits are stored designation data corresponding to the first tone (root tone).

TABLE XI

| Bit | Designation data |
|---|---|
| 7 | designation data of a case in which the previous |
| 6 | counter melody tone corresponds to the fourth tone |
| 5 | designation data of a case in which the previous |
| 4 | counter melody tone corresponds to the third tone |
| 3 | designation data of a case in which the previous |
| 2 | counter melody tone corresponds to the second tone |
| 1 | designation data of a case in which the previous |
| 0 | counter melody tone corresponds to the first tone |

In Table X, in the four blocks at the cross-point between the spacing MVSC between the melody tone and the root and the chord type CDTD, the designation data of a case wherein the previous melody tone corresponding to the first tone is shown at the left upper, the designation data of a case wherein the previous counter melody tone corresponds to the second tone is shown at the right upper, the designation data of a case wherein the previous melody tone corresponds to the third tone is shown at the left lower, and the designation data of a case wherein the previous counter melody tone corresponds to the fourth tone is shown at the right lower, respectively by digits 0 through 3. In Table X vacant columns show digits 0.

These 4 designation data each consisting of two bit units are simultaneously read out by giving address informations corresponding to the spacing M SC between the melody tone and the root and the chord type CDTP to the constant memory device 20.

Thus, a new counter melody tone is read out according to a relation among a designation data that designates one of the chord constituting tones to which the tone is to be designated, the spacing MVSC between the melody tone and the root, chord type CDTP and the previous counter melody tone.

For example, where the chord type is major (M) and the spacing between the melody and the root is zero, and when the contents of the 7th and 6th bits, 5th and 4th bits, and the third and second bits are "1" a designation data whose first through 0th bits are "0" is read out. When the previous counter melody tone corresponds to either one of the first to third tones of the present chord constituting tones, it is designated that the new counter melody tone should be moved to a tone same as the second tone, whereas when the previous counter melody tone corresponds to the fourth tone, it is designated that the new counter melody tone should be moved to a tone same as the first tone.

When the type of the chord is augument (Aug) and the spacing between the melody tone and the root is B, that is 11, a designation data is read out, the contents of its 7th and 6th bits, 5th and 4th bits, and the third and second bits are 2, and the contents of its first and zeroth bits being "0". When the previous counter melody tone corresponds to either one of the first to third tones of the present chord constituting tones, it is designated that the new counter melody tone should be moved to a tone same as the second tone, whereas when the previous counter melody tone corresponds to the 4th tone it is designated that the new counter melody tone should be moved to a tone same as the first tone.

The designation data thus read out is stored in the X register $X_R$ at the next step 13801. Then at the next step 13802, a judgement is made as to whether the spacing between the previous counter melody tone and the root is "0" or not. More particularly, a judgement is made whether the previous counter melody tone is the same as the root (first note) of the present chord constituting tones or not. If the result of this judgement is YES, the program is branched to step 13808 where the contents of the first through zeroth bits of the X register $X_R$ are selected and stored in the Y register $Y_R$. At the step 13809 the increment ΔKN in the key number of the root note is read out from the root note increment table in the constant memory device 20 based on the content of Y register $Y_R$ and the chord type CDTP.

As shown in the following Table XII, the key number increment ΔKN of the root note is determined in accordance with the chord data CDTP and the content of the designation data. For example, where the designation data is "1" and when the chord type CDTP is major M, the increment ΔKN=4 would be read out, whereas when the designation data is "2", an increment ΔKN=7 would be read out.

TABLE XII

| | (Root note increment table) | | | |
|---|---|---|---|---|
| | Designation data | | | |
| CDTP | 0 | 1 | 2 | 3 |
| M | 0 | 4 | 7 | 0 |
| 7 | 0 | 4 | 7 | A |
| 6 | 0 | 4 | 7 | 9 |
| M7 | 0 | 4 | 7 | B |
| m | 0 | 3 | 7 | 0 |
| m7 | 0 | 3 | 7 | A |
| m7-5 | 0 | 3 | 6 | A |
| dim | 0 | 3 | 6 | 9 |
| Aug | 0 | 4 | 8 | 0 |

Where the designation data makes the new counter melody tone to be equal to the root of the chord constituting tones, since it is possible to use the key number CDRT1 of the root as it is, the increment ΔKN is set to "0".

The increment ΔKN thus read out according to the designation data and the chord type CDTP is stored in the A register $A_R$ and then added to the root note key number CDRT1 at step 13810. The sum is determined as the key number CMLKN1 of a new counter melody tone.

This key number CMLKN1 of the new counter melody tone is stored in the A register $A_R$ and then corrected to the note range G1 through G2 in a tone production correction subroutine (Sub-SDREGN) of step 13811. Thereafter, the corrected key number is converted into a corresponding key code and transferred to the counter melody buffer memory device 28.

When the spacing CMLVSC between the previous counter melody tone and the root is not "0", the program is advanced from step 13802 to step 13803 where a judgement is made as to whether the spacing CMLVSC is "3" or "4". More particularly, a judgement is made as to whether the previous counter melody tone is equal to the second tone (3rd tone) of the present chord constituting tones or not. If the result of judgement is YES, the program is branched to step 13807 where the contents of the third through second bits of the X register $X_R$ are selected and stored in the Y register $Y_R$. Thereafter, in the same manner as above described, the increment ΔKN of the key number CDRT1 of the root is read out and added to the root note key number CDRT1 to determine the key number CMKN1 of the new counter melody tone by adding the increment ΔKN to the root note key number CDRT1.

Where the spacing CMLVSC between the previous counter melody tone and the root is not "3" or "4" the program is advanced from step 13803 to step 13804 where a judgement is made whether the spacing between the previous melody tone and the root is "6", "7" or "8". Where the result of judgement is YES, it is determined that the previous counter melody tone was the third tone (5th tone) of the present chord constituting tones, and the program is branched to step 13806 where the contents of the fifth through fourth bits of the X register $X_R$ are selected and stored in the Y register $Y_R$. Then at the succeeding steps 13809 through 13811, the key number CMKN1 of a new counter melody tone is determined in the same manner as above described.

When the spacing CMLVSC between the previous counter melody tone and the root is not equal to either one of "6", "7" and "8", it is judged that the previous counter melody tone was the same as the fourth tone (7th tone) of the present chord constituting tones. Then the program is advanced from step 13804 to step 13805 where the contents of the 7th through 6th bits of the X register $X_R$ are selected and stored in the Y register $Y_R$. Then at the succeeding steps 13809 through 13811, the key number of a new counter melody tone is determined.

For example, as shown in the musical score shown in FIG. 17, where a C major chord continues twice, the melody tone of the counter melody tone of the (n+2)th measure will be as follows if it is assumed that the previous (n+1)th mesure is a C note.

More particularly, the spacing MVSC between the melody tone and the root at the (n+2)th measure is "4" and since the chord type CDTP is a major M, the dsignation data for the destination of the counter melody tone is "2" as shown in Table X. From Table XII, the increment of the root note C is "7", whereby a G note will be determined as the new counter melody tone. In other words, a tone same as the tone "so" among the chord constituting tones do, mi and so would be determined as the melody tone of the (n+2)th measure.

In the subroutine (Sub-CM400), since the counter melody destination table is referred to according to the spacing between the melody tone and the root, a new melody tone would not be determined unless a melody tone is produced. Where the same chord tone continues more than three times and when the melody tone is the same as the previous melody tone, designation data bounded by circles in Table X are generated so as to determine a counter melody tone same as the previous one. This makes it impossible to attain the desired object of increasing the variation in the tone pitch of the counter melody tone. For these two reasons, a subroutine (Sub-CM200) to be described later is provided.

As above described in the subroutine (Sub-CM400), a tone same as one of the present chord constituting tones is determined as a new counter melody tone according to a relation between the previous counter melody tone and the melody tone. As a consequence, where the same chord constitutes twice, and when the melody tone has varied a counter melody tone that varies with a three degree interval difference can be obtained, thereby imparting variation to the flow of the music.

Chapter 4—Detail of the Subroutine (Sub-CM200)

As above described, in the subroutine (Sub-CM400) a counter melody tone is determined when the same chord is continuously designated twice and when a meldy tone is produced. Actually, however, there is a case wherein the same chord is continuously designated more than three times and the same chord is designated continously even though no melody tone is produced.

The subroutine (Sub-CM200) is executed where (a) the same chord is designated continuously more than 3 times irrespetive of the presence or absence of a melody tone, and (b) no melody tone is produced and the same chord is continuously designated twice.

so as to determine a counter melody tone having a large width of tone pitch variation.

More particularly, under the condition (a), a check is made as to whether there are a 3 or 6 degree tone among chord constituting tones with reference to the melody tone and when there are such chord constituting tones either one of them is determined as a new counter melody tone, whereas when there is no such chord constituting tone, a chord constituting tone having the shortest interval difference from the tone toward the higher tone side than the previous counter melody tone is determined as a new counter melody tone.

Under condition (b) a chord constituting tone having the shortest interval difference from a tone on the higher tone side than the previous counter melody tone is determined as a new counter melody tone.

Figure 18:
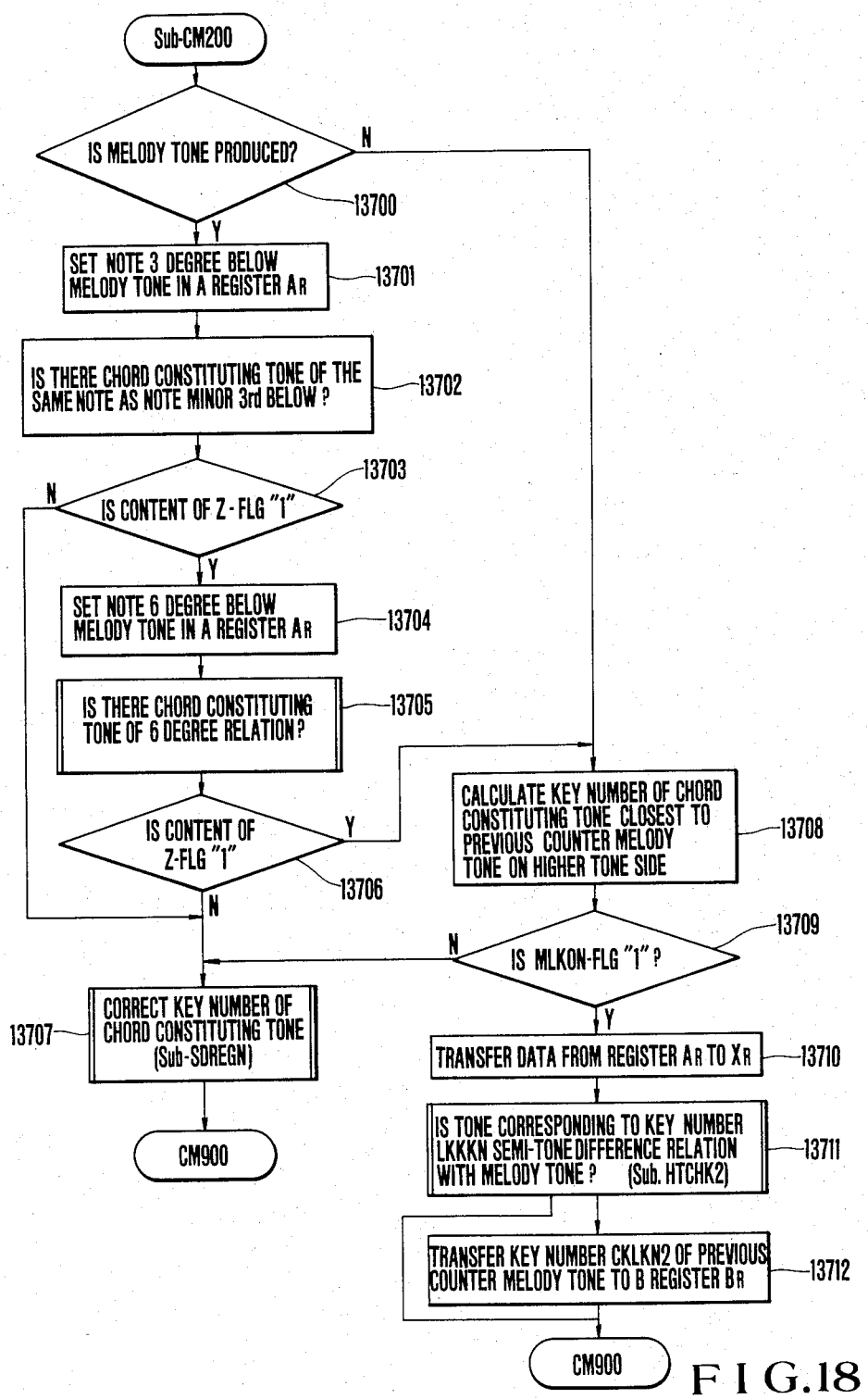
FIG. 18 is a flow chart showing the detail of a subroutine for determining a counter melody tone when the same chord is designated continuously at least more than twice.

FIG. 18 is a flow chart showing the detail of the subroutine (Sub-CM200) in which steps 13700 through 13712 are executed when either one of the conditions (a) and (b) holds as a result of analysis of the subroutine (Sub-CMEL) shown in FIG. 4.

Thus, when the condition (a) holds, a judgement at step 134 is made or a melody delay processing is executed, whereas when the condition (b) holds the judgement at step 135 shown in FIG. 4 is executed.

A processing when condition (a) holds will firstly be described.

In FIG. 18, at step 13700 a judgement is made whether a melody tone is produced or not according to the content of the melody key-on flag MLKON-FLG. If there is a melody tone, at steps 13701 through 13706 a judgement is made whether there is a tone of the same note as the note 3 degrees below (minor third, major third below) and the melody tone same as the tone 6 degrees below (minor third, major 6th below) in the presently designated chord constituting tones.

At first, a judgement is made as to whether there is a tone of the same note as a tone minor third below the melody tone in the chord constituting tones.

To this end, at step 13701, the key number KN of a note minor 8th below the melody tone is calculated and set in the A register $A_R$. The key number of this note of minor third below is obtained by subtracting a key number "3" corresponding to the minor third interval from the key number MLKN1 of the melody tone.

Then, in the subroutine (Sub-3/6 LKCHK) of the step 13702, a check is made whether there is a chord constituting tone of the same note as the note minor third below in accordance with the key number KN of a note minor third below the melody tone. At the same time a check is made as to whether the chord constituting tone is of the same note as the previous counter melody tone.

Figure 19:
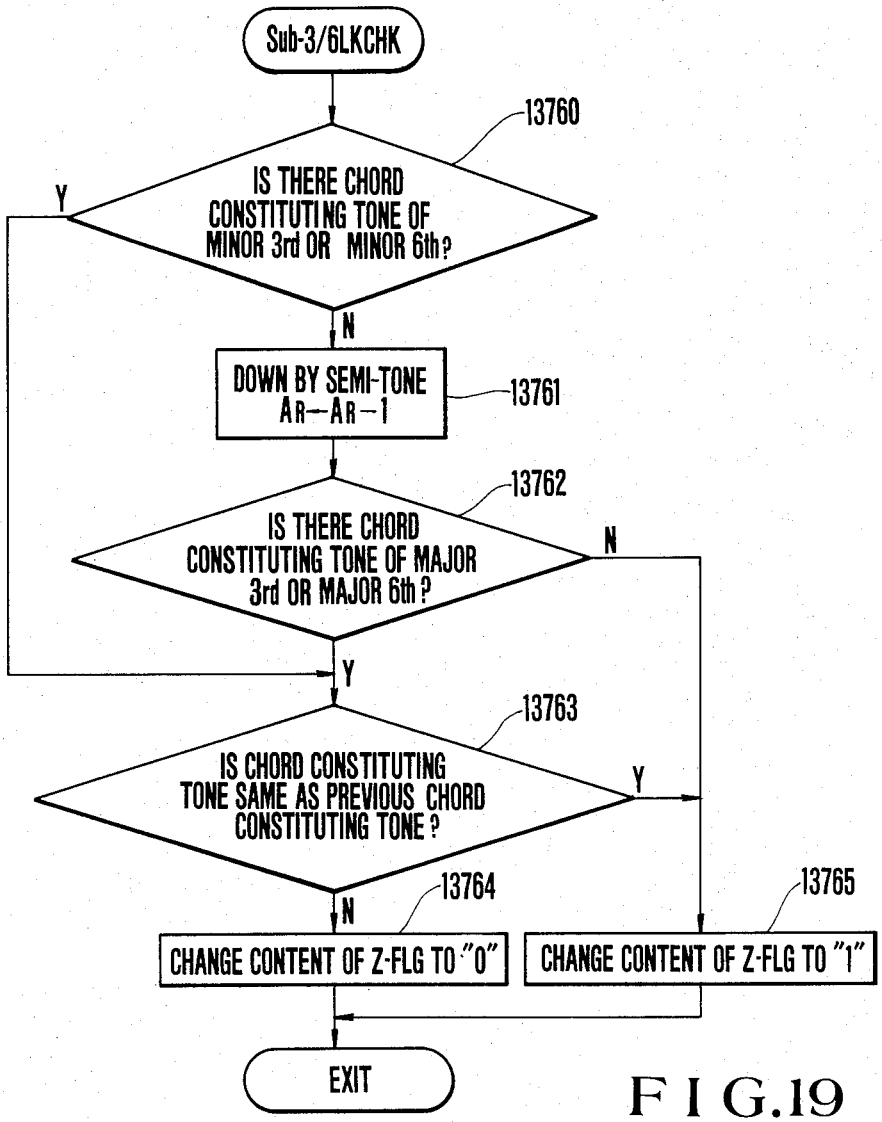
FIG. 19 is a flow chart showing the detail of a subroutine for detecting a chord constituting tone having a 3 or 6 degree relation with reference to the melody tone.

FIG. 19 shows the detailed flow chart of the subroutine (Sub-3/6 LKCHK). In this subroutine, at step 13760, the key number KN minor 3rd below is sequentially compared with the key numbers LKKN1 through LKKNV of the chord constituting tones respectively stored in registers $LKKNI_R$ through $LKKNV_R$ so as to judge whether there is a key number of the same note or not. In other words a check is made whether there is a chord constituting tone of minor 3rd or minor 6th or not.

When the result of judgement executed at step 13760 is YES, at step 13763 the key number KN of a note minor third lower than the melody tone is compared with the key number CMLK of the previous counter melody. In other words a judgement is made as to whether a chord constituting tone of the same note as a note minor 3rd below the melody tone is the same as the previous counter melody tone.

When the result of judgement at step 13763 is YES, at the next step 13764 the content of the Z flag Z-FLG is made "0" and the program is returned to the subroutine (Sub-CM200). More particularly, the content of the Z flag Z-FLG is set to a value showing that a tone that can be determined as a new counter melody tone has been detected, and then the program is returned to subroutine (Sub-CM200).

Then, in the subroutine (Sub-CM200) the program is advanced from step 13702 to step 13707 where the key number LKKN of a chord constituting tone of the same note as a note minor third below the melody tone is corrected to a key number in a tone range of G1 through G2 and sent out as the key number CMLKN1 of the new counter melody tone.

When the result of judgement at step 13760 shows that there is no chord constituting tone of the same note as a note minor third below the melody tone, at the next step 13761 a judgement is made as to whether there is a chord constituting tone of the same note as a tone major third below the melody tone or not so that a value "1" corresponding to the key number representing a semi-tone difference is subtracted from the count of the A register $A_R$. Then at the next step 13762, the key number KN of the same note as the tone major third below the melody tone is sequentially compared with the key numbers LKKNI through LKKNV of the chord constituting tones to judge whether there is a key number KN of the same note.

When the result of this judgement is YES, in the same manner as the case of minor third, as step 13763 a judgement is made as to whether the chord constituting tone is the same as the previous counter melody tone or not. When the result of judgement is NO, at step 13764, the content of the Z flag Z-FLG is made "0", and the program is returned to the subroutine (Sub-CM200) in which the key number LKKN of a chord constituting tone of the same note as the tone major third below the melody tone is corrected to a key number CMLKN1 of the new counter melody in the tone range G1 through G2 and then sent out.

(a1) Where there is no chord constituting tone of the same note as the tone minor third below and major third below the melody tone and (a2) where there is a chord constituting tone of the same note as the tone minor third or major third below the melody tone but the chord constituting tone is of the same note as the previous counter melody tone, the program is advanced to step 13765 where the content of the Z flag Z-FLG is made "1" and the program is returned to subroutine (Sub-CM200). Thus, the Z flag Z-FLG displays that a chord constituting tone of the same note as the tone having a relation of 3 degrees or 6 degrees with respect to the melody tone should not be determined as a new counter melody tone. Then the program is returned to the subroutine (Sub-CM200).

In this subroutine, after step 12702 at which a judgement is made whether Z-FLG is "1" or not. Then at step 13702, the key number KN of a tone minor 6th below the melody tone is calculated and set in the A register $A_R$ for the purpose of checking whether there is a chord constituting tone of the same note as the tone minor 6th below the melody tone.

This key number KN of a tone minor 6th below is obtained by subtracting the value "8" of the key number corresponding to the tone interval of minor 6th from the key number MLKN1 of the melody tone.

Then in the subroutine (Sub-3/6 LKCHK) of the next step 13705, a check is made as to whether there is a chord constituting tone of the same note as a note minor 6th below in accordance with the key number of a tone minor 6th below the melody tone. At the same time when there is a chord constituting tone of the same note, a further check is made whether it is the same as the previous counter melody tone or not.

The step 13705 is executed in the same manner as the preceding step 13702.

When the result of judgement of step 13705 shows that there is a chord constituting tone of the same note as the tone minor 6th below or major 6th below the melody tone, and that the chord constituting tone is not of the same note as the previous counter melody tone, at step 13707, the tone production range is corrected and then sent out as the key number CMLKN1 of a new counter melody tone.

(a2) Where there is no chord constituting tone of the same note as the tone minor 6th below or major 6th below the melody tone, or (a3) where there is a chord constituting tone of the same note as the tone minor 6th below or major 6th below the melody tone but when the chord constituting tone is of the same note as the previous counter melody tone, the program is advanced to step 13708 according to the judgement at step 13706 as to whether Z-FLAG is "1" or not which is effected. At the step 13708, the key number of a chord constituting tone among presently designated chord constituting tones, which is closest to the previous counter melody tone on the higher tone sides is calculated and then set in the A register $A_R$.

The key number KN of a tone closest to the previous counter melody tone on the higher tone side (tone of the shortest interval) is determined by adding together the key number CMLKN2 of the previous melody tone and the up-distance UPDIST obtained at the step 127 shown in FIG. 4.

When the result of step 13709 is YES, a judgement is made whether the content of MLKON-FLG is "1" or not, and the program is advanced to step 13710 where the content of the A register $A_R$, that is the key number LKKN of a chord constituting tone closest to the previous counter melody tone on the higher tone side is transferred to the X register $X_R$.

In the subsequent processing, when the chord constituting tone of the key number LKKN is detected to have a semi-tone difference with respect to the melody tone, that is in a dissonant relation, this key number would not be adopted as the key number of the counter melody tone. Thus, it is transferred to the X register $X_R$ as a momentarily determined key number of the counter melody tone.

Then in the subroutine (Sub-HTCHK2) of step 13711, a check is made as to whether a tone corresponding to the key number LKKN stored in the X register $X_R$ is in an dissonant relation of a semi-tone difference with respect to the melody tone or not. If the tone of the key number LKKN is not in the semi-tone difference relation with reference to the melody tone, one of the chord constituting tones closest to the previous counter melody tone on the higher tone side is determined as the key number CMLKN1 of a new counter melody tone. After being corrected to a tone production range G1 through G2 in the subroutine (Sub-HTCHK2), the key number CMLKN1 is converted into a corresponding key code KC and transferred to the counter melody buffer memory device 28.

However, when the chord constituting tone is in the dissonant relation of a semi-tone with reference to the melody tone, the program is advanced from step 13711 to step 13712 at which the key number CMLKN2 of the previous counter melody tone is transferred to the B register $B_R$. Thus, this key number CMLKN2 is sent out again as the key number CMLKN1 of the new counter melody tone.

Thus, if it is not preferable from the standpoint of a music, a counter melody tone same as the previous tone is produced as the counter melody without varying the counter melody tone.

At this time, since the key number CMLKN2 of the previous counter melody tone has been corrected to one in the tone range of G1 through G2, it is possible to directly transfer the key number to the B register $B_R$ without passing through the subroutine (Sub-SDREGN) provided for correcting the tone production range.

Foregoing description concerns a case wherein the same chord continues more than 3 times and a melody tone is produced.

A case wherein the same chord continues more than 3 times and there is no melody tone, or a case wherein the same chord continues twice and there is no melody tone will be described in the following.

In these cases according to the judgement executed at step 13700 shown in FIG. 18 the program is jumped to step 13708 at which one of the chord constituting tones which is closest to the previous counter melody tone on the higher tone side is determined as a new counter melody tone. The key number CMLKN1 corresponding to this new counter melody tone is corrected to the tone range G1 through G2 at step 13707 succeeding step 13706.

Where no melody tone is produced, one of the chord constituting tones which is closest to the previous counter melody tone is determined as a new counter melody tone. Accordingly, when the designation of the same chord is repeated more than twice, a counter melody tone which varies toward the higher tone side would be determined, more particularly the second tone of the chord constituting tones at the second time, the third tone at the third time, the fourth tone at the fourth time, the first tone at the 5th time and so on.

Figure 20:
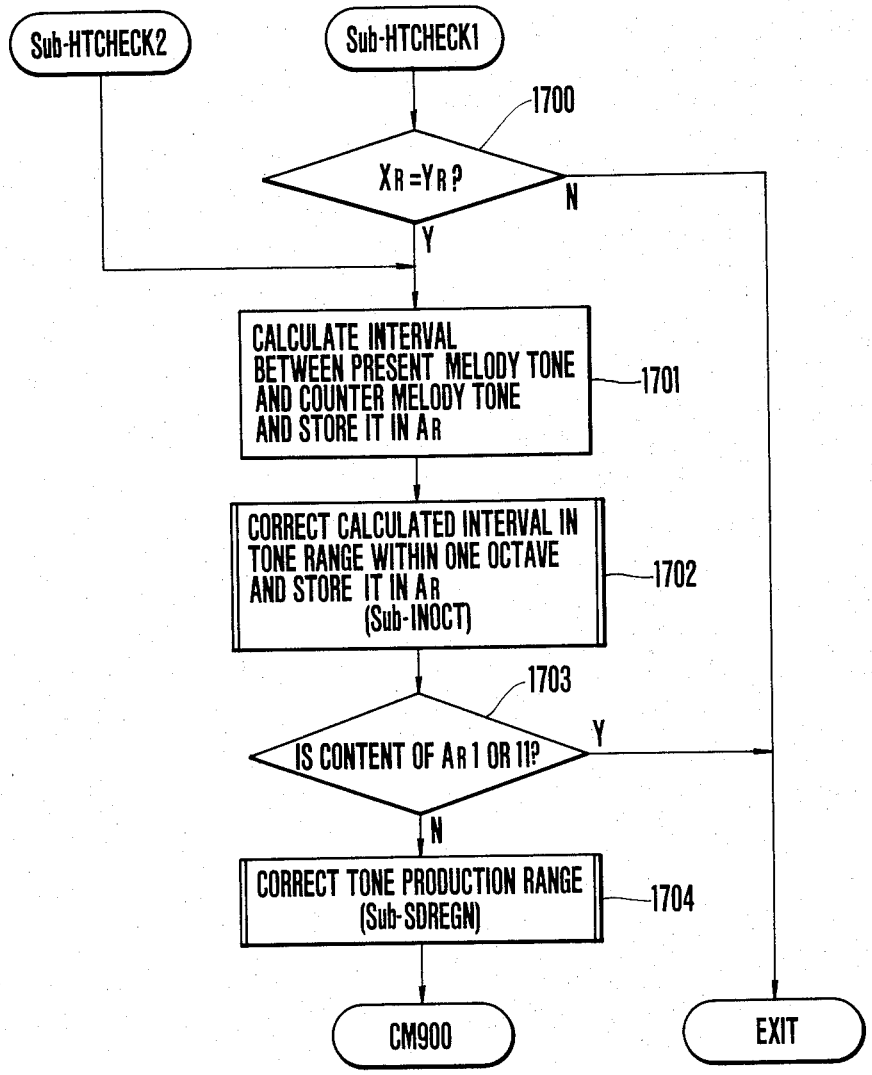
FIG. 20 is a flow chart showing the detail of a subroutine for checking the semi-tone relation with reference to a melody tone.

The detailed flow chart of the subroutine (SUB-HTCHK2) utilized to check whether a tone has a semi-tone relation with reference to the melody tone is shown in FIG. 20.

In FIG. 20, at step 1701 the interval between the present melody tone and the counter melody tone momentarily determined in the subroutine (Sub-CM200) is calculated and stored in the A register $A_R$.

This calculation of the interval comprises subtraction of the key number MLKN1 corresponding to the present melody tone from the key number CMLKN of the momentarily determined counter melody tone.

In the subroutine (Sub-INOCT) of the next step 1702, the result of calculation is converted into a key number representing an interval between two tones in one octave and stored in the A register $A_R$. At the next step 1703 a judgement is made whether the content of the A register $A_R$ is "1" or "11". More particularly, when the note of the momentarily determined counter melody tone is higher by a semi-tone than the note of the present melody tone, the value of the key number corresponding to the interval therebetween becomes "1". Conversely, when the note is on the lower tone side, the key number becomes "11". When the interval therebetween exceeds one semi-tone, the key number of the interval becomes "2 through 10".

The key number "1" or "11" representing the interval between two tones produces a semi-tone difference.

When the result of judgement shows that the present melody tone and the momentarily determined counter melody tone are not in the dissonant relation of the semi-tone difference, at step 1704 the key number CMLKN of the counter melody tone momentarily determined in the tone production range correction subroutine (Sub-SDREGN) of step 1704 is corrected to the tone range of G1 through G2 and then sent out as the key number CMLKN1 of the true counter melody tone.

However, when the momentarily determined counter melody tone and the present melody tone are in the dissonant relation of the semi-tone difference the program is branched from step 1708 and returned to step 13712 shown in FIG. 18, and the key number CMLKN2 of the previous counter melody tone is sent out as the key number CMLKN1 of a new counter melody tone.

In the flow chart shown in FIG. 20, the step 1700 is utilized for processing the subroutine (Sub-CM600) so that it will be described later.

As above described, in the subroutine (Sub-CM200), where the same chord is designated continuously more than 3 times and where a melody tone is produced, a check is made as to whether there is or not a chord constituting tone having third or 6th relation with respect to the melody tone. When such chord constituting tone presents, this tone is determined as a new counter melody tone provided that a tone same as the chord constituting tone is not the same as the previous counter melody tone. In the absence of such chord constituting tone, however, a tone same as a chord constituting tone closest to the previous counter melody tone on the higher tone side would be determined as a new counter melody tone provided that the tone is not in a dissonant relation of the semi-tone with respect to the melody tone, whereas when there is a dissonant relation with reference to the melody tone, the previous counter melody tone would be adopted again as the new counter melody tone.

Where the designation of the same chord continues more than twice and where there is no melody tone produced, a tone of the same note as a chord constituting tone closest to the previous counter melody tone on the higher tone side would be determined as a new counter melody tone.

Except a special case wherein the tone is the same as the previous counter melody tone or a case wherein a tone has a dissonant relation of a semi-tone with reference to the melody tone, a tone having third or 6th relation with respect to the previous melody tone would be determined as a new counter melody tone. Consequently, the width of variation in the pitch of the counter melody tone is widened, thus applying variation to the flow of a music.

Figure 17:
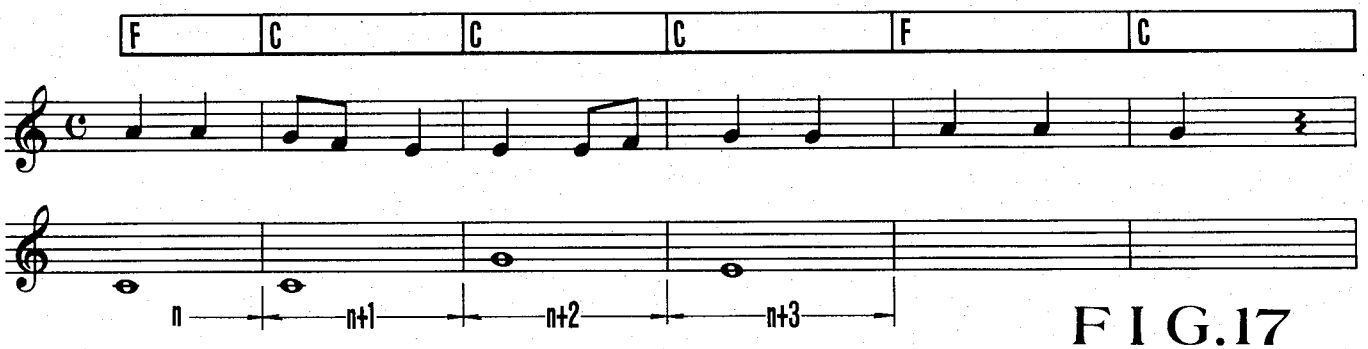
FIG. 17 is a musical score for explaining the counter melody tone determined by the subroutine shown in FIG. 16.

For example as shown by the (n+3)th measure of the musical score shown in FIG. 17, let us consider a case wherein the designation of a C major chord has been made 3 times and there is a tone production of a melody tone of note G (so).

In this case, tones having third or 6th relation with respect to the note G melody tone are tones of E, $E^b$ or B, $B^b$. Under these conditions, the chord constituting tones are C, E and G notes, and the previous counter melody tone is a G note. Consequently a E note having a minor third relation with respect to the melody tone would be determined as a new counter melody tone which is represented by a whole note at second stage of the musical score shown in FIG. 17.

Chapter 5—Detail of Subroutine (Sub-CM600)

When the pitch of the counter melody tone varies greatly as the chord type changes, the flow of the music becomes unstable. In this subroutine (Sub-CM600), under a performance mode in which the chord type changes, and there is a melody tone production, a counter melody tone is determined whose interval with respect to the previous counter melody tone is small, that is a small pitch variation difference of less than the major second.

More particularly, the previous counter melody tone is compared with respective chord constituting tones of the newly designated chord so as to determine a note same as one of the chord constituting tones having an interval less than the major second with respect to the previous counter melody tone as a new counter melody tone. In this case, where there are a plurality of chord constituting tones of less than the major second, a note same as one of them is selected according to a predetermined order of priority and determined as a new counter melody tone. In this description a chord constituting tone having third or 6th relation with respect to the melody tone is also included in the order of priority and when such chord constituting tone has an interval of less than the major second with reference to the previous counter melody tone, it can be determined as the new counter melody tone.

When no new counter melody tone is determined according to the order of priority described above, a chord constituting tone of the same note as the previous counter melody tone will be determined as a new counter melody tone.

However, since any new counter melody tone can not be determined up to this time, a chord constituting tone among the present chord constituting tones which is closest to the previous counter melody tone would be determined as the new counter melody tone.

Where there are a plurality of tones (that is respective chord constituting tones, and chord constituting tones having third or 6th relation with reference to the melody tone) that can be determined as a new counter melody tone in an interval range of less than the major third with reference to the previous counter melody tone, the order of priority for selecting which one of the tones as the new counter tone is determined or discrete chord types as shown in the following Table XIII.

TABLE XIII

| | Order of priority | | | | | |
|---|---|---|---|---|---|---|
| CDTP | 1 | 2 | 3 | 4 | 5 | 6 |
| M | 3rd* | 3/6 | 3rd | 5th | Root | — |
| 7 | 7th* | 3/6 | 7th | 3rd | 5th | Root |
| 6 | 6th* | 3/6 | 6th | 3rd | 5th | Root |
| M7 | 7th* | 3/6 | 7th | 3rd | 5th | Root |
| m | 3rd* | 3/6 | 3rd | 5th | Root | — |
| m7 | 7th* | 3/6 | 7th | 3rd | 5th | Root |
| m7-5 | 5th* | 3/6 | 5th | Root | 7th | 3rd |
| Aug | 5th* | 3/6 | 5th | 3rd | Root | — |
| dim | — | — | — | — | — | — |

More particularly, for example, where the chord type CDTP is major (M), if the 3rd note has the same note as the previous counter melody tone, this tone is preferentially selected according to the order of 3/6 note within major second, 3rd note, 7th note and root among the root notes (Root), the second note (3rd note), the fourth note (7th note) and a tone having third or 6th relation with reference to the melody tone (hereinafter termed a 3/6 note). Where the chord type CDTP is the 7th, and if this 7th is of the same note tone as the previous counter melody tone, this note will be preferentially selected and then notes are selected in the order of 3/6 note less than major 2nd , 7th , 3rd , 5th and root.

Where a chord constituting tone of the same note as the note selected according to the above described order of priority is not actually produced (designated), or where the selected note is in a dissonant relation of a semi-tone with respect to the melody tone, such note would not be determined as a new counter melody tone and a check is made whether a note of the same note as the tone of the next order can be determined as the new counter melody tone or not.

The notes added with a symbol * in Table XIII are selected only when they are of the same note as the previous counter melody tone.

Figure 21:
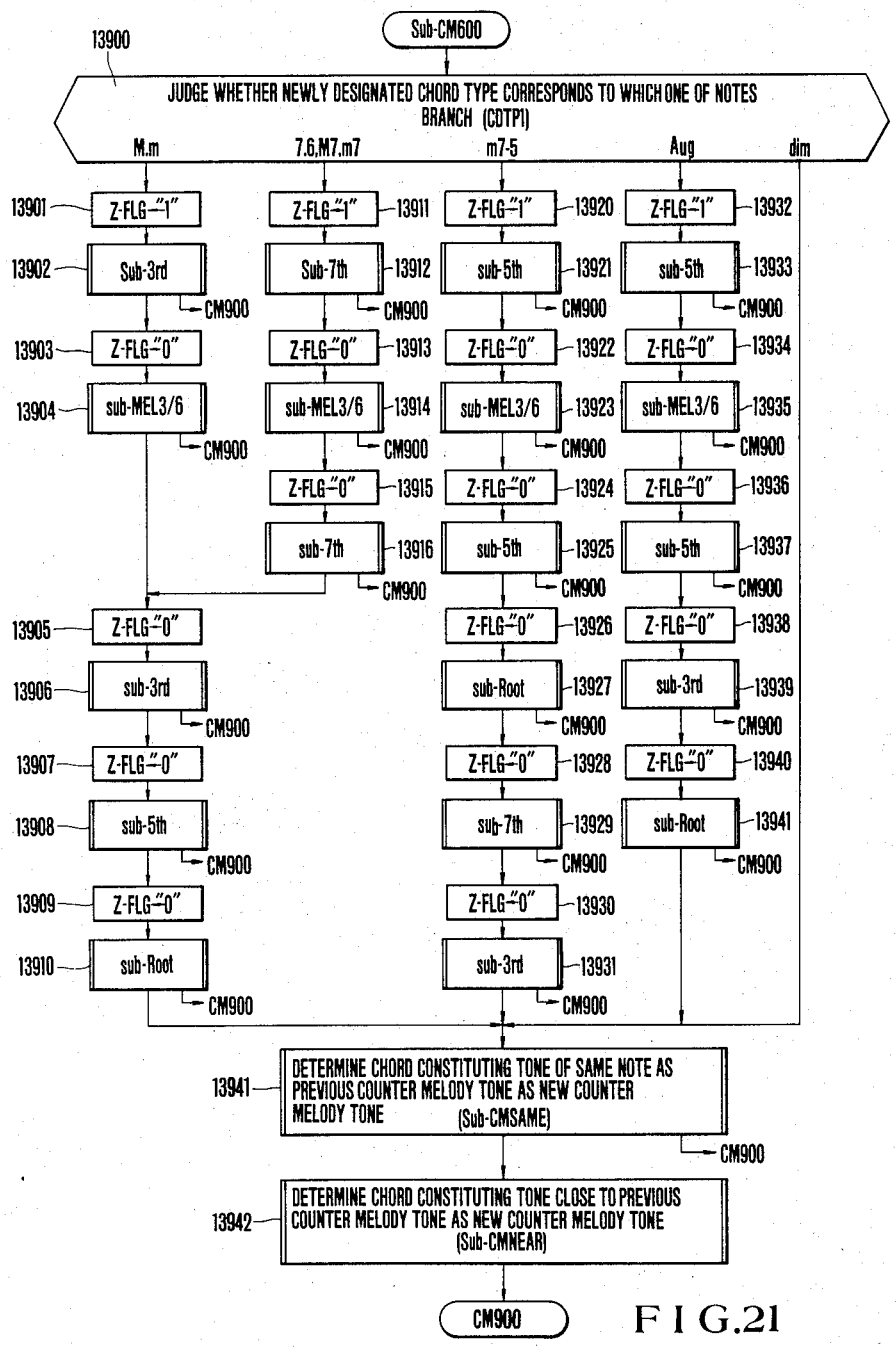
FIG. 21 is a flow chart showing the detail of a subroutine that determines a counter melody tone in a case in which the type of the chord changes and a melody tone is produced.

FIG. 21 is a flow chart showing the detail of the subroutine (Sub-CM600) which is started after the melody delay processing at step 133 or 130 shown in FIG. 4.

In FIG. 21, at step 13900, a judgement is made whether the newly designated chord type CDTP corresponds to which one of the notes according to the first chord type data CDTP1 for the purpose of comparing the chord types according to the order of priority as shown in Table XIII for determining either one of the first (root) through fourth notes (7th ) of the new chord constituting tones and 3/6 note as the new counter melody tone.

When the result of this judgement shows that the chord type CDTP is major (M) or minor (m) processings succeeding the step 13901 are executed, whereas when the chord type is either one of seventh (7), sixth (6), major seventh (m7), processings subsequent to step 13920 are executed. Where the chord type is the minor seventh flat type (m7-5), processings after step 13920 are executed, whereas in the case of a dimmish (dim), processings subsequent to step 13941 are executed.

As shown by symbols * in Table XIII, when a tone selected and determined as the new counter melody tone must be the same note tone as the previous counter melody tone, this content is designated by the Z flag Z-FLG having a content of "1".

For example, where the newly designated chord type CDTP is major (M) or minor (m), the content of the Z flag Z-FLG is set to "1" in order to designate that a tone that is checked whether it can be determined or not as a new counter melody tone at the next step should be the same note tone as the previous counter melody tone. In the subroutine (Sub-3rd) of the succeeding step 13902, a check is made whether 3rd tone (second tone) is actually produced (designated) or not. When the 3rd tone is actually produced a check is made as whether it is the same note tone as the previous counter melody tone or not. When the 3rd tone is the same note tone as the previous counter melody tone, a check is made whether the note tone has a semi-tone difference with reference to the melody tone or not. If not, a note tone same as the 3rd tone is determined as the new counter melody tone. As the new counter melody tone is determined as above described, the program is jumped from step 13902 to a subroutine (Sub-CM900).

However, the program is advanced to step 13903 when either one of the conditions described above is not satisfied. More particularly, (a) when the designated chord is established as a normal major (M) or minor (m) chord but 3rd tone is not produced (designated), (b) when the chord do not include a tone of the same note name as the previous counter melody tone, or 1 (c) where the chord is in a dissonant relation with reference to the melody tone, the program is advanced to step 13903.

At step 13903, the content of the Z flag Z-FLG is set to "0" for the purpose of designating that, a tone which can be selected or not as a new counter melody tone in the succeeding steps may be in an interval range within major second of the previous counter melody tone. In the subroutine (Sub-MEL 3/6) of the next step 13904, a check is made as to whether a tone within major 2nd of the previous counter melody tone (5 tones of the key numbers +1, −1, 0, +2 and −2) is actually produced as one of chord constituting tones or not. When the tone is actually produced a check is made as to whether this chord constituting tone has 3rd or 6th relation with the melody tone or not so as to determine a tone of the same note as a chord constituting tone having 3rd or 6th relation as a new counter melody tone. In other words, a tone in an interval range within major second of the previous counter melody tone and of the same note as a chord constituting tone having third or 6th relation with the melody tone is selected as a new counter melody tone.

However, when either one of the conditions described above is not fulfilled, that is, in either one of the following conditions the program is advanced to step 13305.

(d) no chord constituting tone presents in an interval range within major 2nd of the previous counter melody tone.

(e) Although a chord constituting tone presents in an interval range within major 2nd of the previous counter melody tone, the chord constituting tone is not in 3rd or 6th relation with the melody tone.

At step 13305, after setting the content of the Z flag Z-FLG to "0", in a subroutine (Sub-3rd) of the next step 13906 a check is made whether a 3rd note can be determined as a new counter melody tone or not. The 3rd note would be determined as the new counter melody tone so long as the 3rd note is in an interval range within major 2nd of the previous melody tone, the 3rd note is actually being produced, and not in the dissonant relation of a semi-tone difference with the melody tone.

However, where the 3rd note can not be determined as the new counter melody tone, at the next step 13907 the content of the Z flag Z-FLG is set to "0" and in a subroutine (Sub-5th) of the next step 13908, a check is made whether the 5th note (third note) can be determined as the new counter melody tone or not. When the result of this check shows that the 5th note is in an interval range within major 2nd of the previous counter melody tone, that the 5th note is actually produced, and that it is not in a dissonant relation of a semi-tone difference with the melody tone, the 5th note would be determined as a new counter melody tone.

However, where the 5th note can not be determined as the new counter melody tone, at the next step 13909, the content of the Z flag Z-flag is again set to "0" and in a subroutine (Sub-Root) of the next step 13910, a check is made whether the root can be determined as a new counter melody tone or not. When the result of this check shows that the root note is in an interval range within major 2nd of the previous counter melody tone, that the root is actually produced and that it is not in a dissonant relation of a semi-tone interval with the melody tone, the root would be determined as a new counter melody tone.

When the new counter melody tone can not yet be determined even at this stage of the program, in a subroutine (Sub-CMSAME) of step 13941, a check is made as to whether a chord constituting tone of the same note as the previous counter melody tone is being produced or not. When the chord constituting tone is being produced and it is not in a dissonant relation of a semi-tone difference with the melody tone, a tone of the same note as the previous counter melody tone would be determined as a new counter melody tone. When the new conter melody tone can not still be determined, at the next step 13942, one of the chord constituting tones having a minimum interval with respect to the previous counter melody tone is determined as the new counter melody tone.

In the same manner, where the chord type CDTP is seventh (7) , sixth (6), major seventh (M7), and minor seventh (m7), at steps 13911 through 13916, steps 13905 through 13910 and steps 13941 through 13942, the new counter melody tone would be determined according to the order of priority as shown in Table XIII.

Where the chord type CDTP is the minor seventh flat five (m7-5), the new counter melody tone would be determined at steps 13920 through 13931 and step 13941 through step 13942 according to the order of priority as shown in Table XIII. In the case of augument (Aug) too, the new counter melody tone would be determined in the same manner, at steps 13941 through 13942.

In the case of diminish, the new counter melody tone is determined at steps 13941 through 13942.

It is possible to prevent the flow of a music from becoming unstable when the chord thus designated is different from the previous chord by determining a tone of the same note as a chord constituting tone in an interval range within major 2nd of the previous counter melody tone as the new counter melody tone. Especially, a tone in an interval range within major second is selected according to the order of priority so that a tone having the smallest pitch variation with respect to the previous counter melody tone can be selected as the new counter melody tone.

Figure 22:
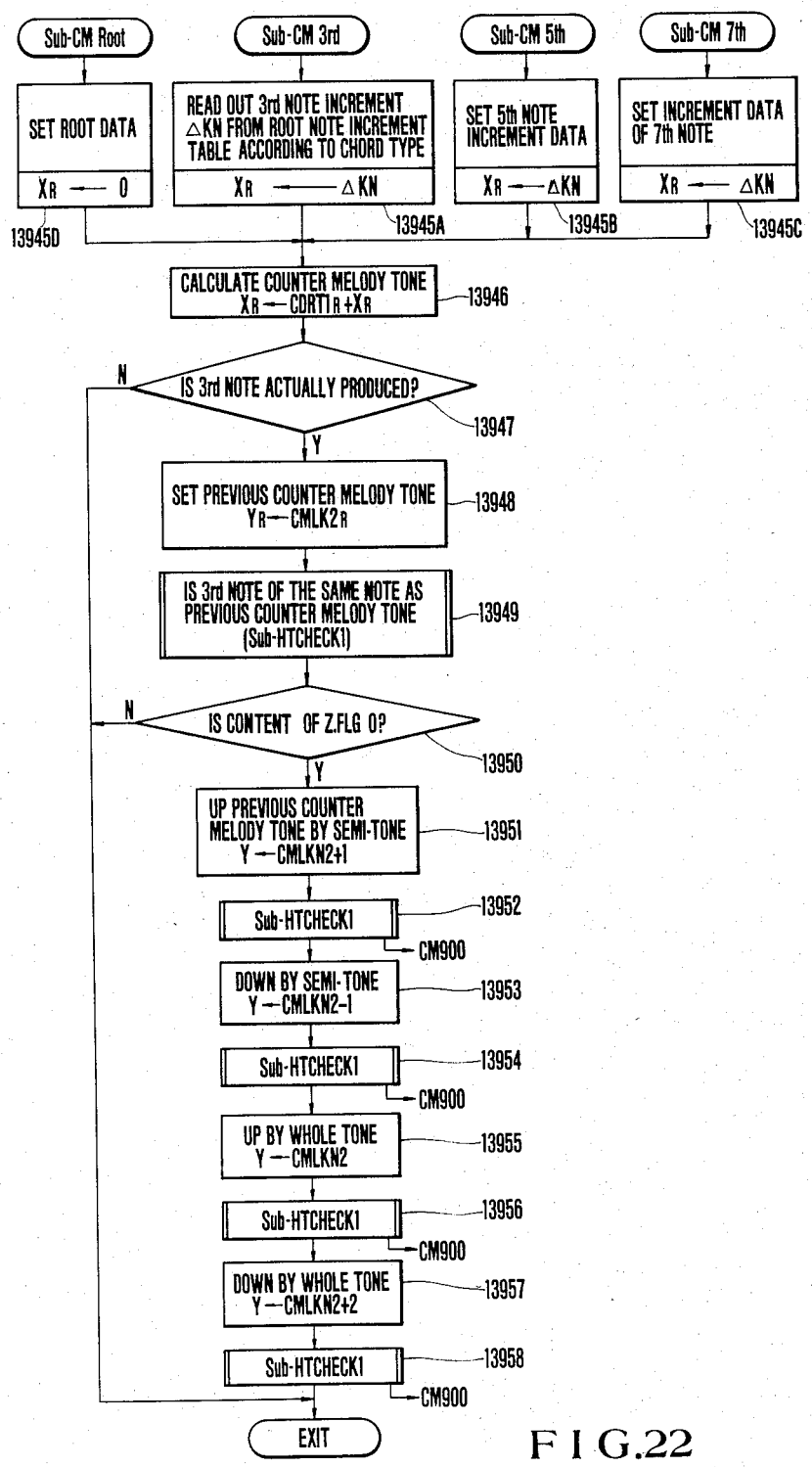
FIG. 22 is a flow chart showing the detail of a subroutine for determining that which one of the tone of the same note as the constituting tones shown in FIG. 21 can constitute a new counter melody tone.

The detailed flow charts of subroutines (Sub-3rd), (Sub-5th), (Sub-7th) and (Sub-Root) in which checks are made whether the 3rd , 5th , 7th and root notes can be determined as the counter melody tones is shown in FIG. 22.

Figure 23:
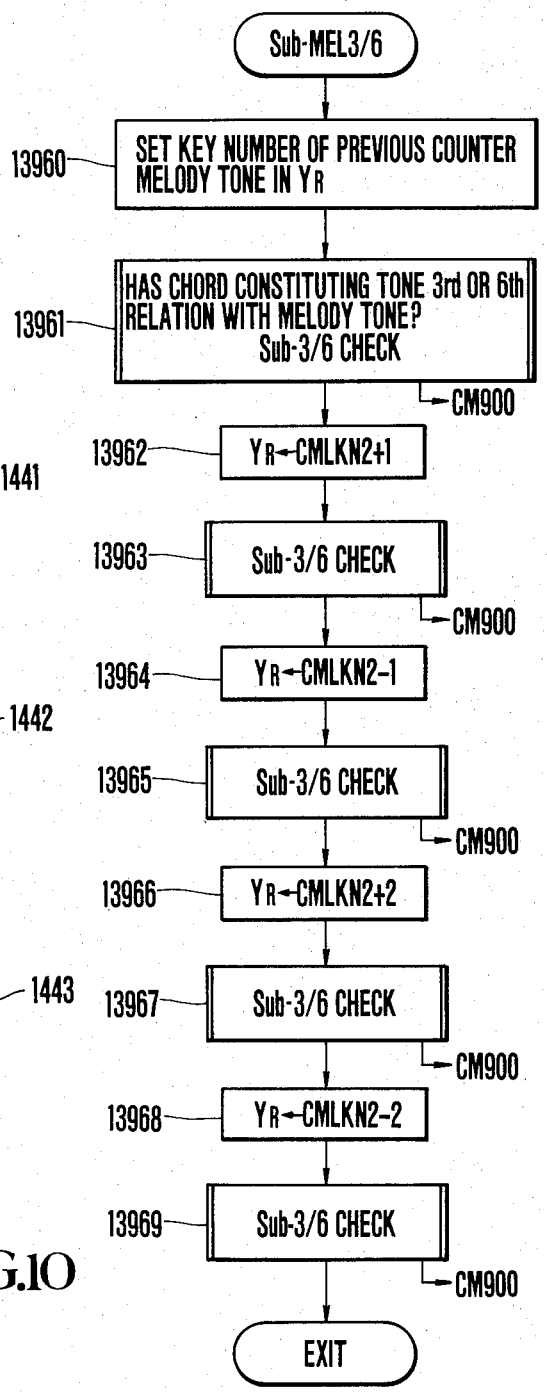
FIGS. 23 and 24 are flow charts showing the detail of the subroutines for determining that which one of the tone of the same note ss the constituting tone having a 3 or 6 degree relation with reference to a melody tone can constitute a new counter melody tone.

A detailed flow chart of a subroutine (Sub-MEL 3/6) in which a check is made whether a chord constituting tone having third or 6th relation with respect to the melody tone can be determined as a new counter melody tone is shown in FIG. 23.

In FIG. 22, only steps 13945A through 13945D are different from subroutines (Sub-3rd), (Sub-5th), (Sub-7th) and (Sub-Root), while steps 13946 through 13958 are used in common for these subroutines.

The subroutine (Sub-3rd) will firstly be described. In this subroutine (Sub-3rd), for the purpose of determining the key number LKKN of 3rd note, at step 13945A, the increment ΔKN of the key number for the key number CDRTI is read out from the root note increment table shown in Table XII. The increment ΔKN is predetermined for each type of the chord as shown in Table XII. Consequently, where a data representing the chord type CDTP and a designation data corresponding to the 3rd note are applied to the constant memory device 20 as address information, the increment ΔKN for determining the key number of the 3rd note can be read out.

The increment ΔKN thus read out is temporarily stored in the X register $X_R$. Then at the next step 13946, the root note key number CDRT1 and the increment ΔKN corresponding to the 3rd note are added together for calculating the key number LKKN corresponding to the 3rd note. This key number LKKN is momentarily determined as the key number CMLKN representing the new counter melody tone and temporarily stored in the X register $X_R$.

Then at step 13947, the key number LKKN of the 3rd note stored in the X register $X_R$ is sequentially compared with the key number LKKNI through LKKNV of the chord constituting tones stored in the key number register $LKKNI_R$ through $LKKNV_a$ so as to check whether the 3rd note is actually produced or not.

When the result of check is NO, it is determined that the 3rd note can not be determined as the new counter melody tone and the program is returned to the subroutine (Sub-CM600) shown in FIG. 21 at which a check is made as to whether a chord constituting tone at the next order of priority can be determined as the new counter melody tone or not. However, where the third note is produced, at step 13947, the key number CMLKN2 of the previous counter melody tone is set in the Y register $Y_R$. This is tone for the purpose of checking whether the 3rd note and the previous counter melody tone are of the same note or not.

In the subroutine (Sub-HTCHECK1) of the next step 13949, a check is made whether the 3rd note momentarily determined as the new counter melody tone is of the same note as the previous counter melody tone or not and whether there is a tone having dissonant relation of a semi-tone difference with reference to the melody tone or not. When the result of this check shows that the 3rd note determined as the new counter melody tone is of the same note as the previous counter melody tone and not in the semi-tone difference relation with respect to the melody tone it is determined as a normal new counter melody tone. The key number CMLKNI representing this normal new counter melody tone is corrected to the key number in the tone production range of G1 through G2. Then the program is advanced to subroutine (Sub-CM900).

However, in the subroutine (Sub-HTCHECK1) of step 13948, when the 3rd note is not of the same note as the previous melody tone or has a dissonant relation of the semi-tone difference with respect to the melody tone, the program is advanced to step 13950 at which a judgement is made as to whether the content of the Z flag Z-FLG is "0" or not.

As above described when the content of the Z flag Z-FLG is "1" it means that a note to be determined in a succeeding step should be of the same note as the previous counter melody tone.

Where the content of the Z flag Z-FLG is "1" and the result of judgement at step 13949 shows that "the 3rd note is not same as the previous counter melody tone or the 3rd note has a semi-tone difference from the melody tone, the 3rd note is entitled to be determined as the new counter melody tone, so that the program is returned to the subroutine (Sub-CM600) shown in FIG. 21 and then a tone of the next order of priority is checked. More particularly, the 3rd note momentarily determined as the new counter melody tone at step 13946 is cancelled its title of becoming the counter melody tone.

However, when the result of judgement at step 13950 shows that the content of Z flag Z-FLG is "0", for example, when a check is made as to whether the 3rd note can be determined as the new counter melody tone or not at step 13906, shown in FIG. 21, the 3rd note would be entitled to be determined as the new counter melody tone when the interval between the 3rd note and the previous melody tone is within major 2nd . Consequently, when the content of the Z flag Z-FLG is "0", at steps 13951 through 13955 a check is made whether the 3rd note is in an interval range within major second of the previous counter melody tone.

The detail of the subroutine (Sub-HTCHECK1) in which a check is made as to whether the 3rd note is the same as the previous counter melody tone and whether the 3rd note is in a relation of a semi-tone difference with respect to the melody tone will now be described in detail. This subroutine is constracted to perform the judgement described above by commonly using a portion of the subroutine (Sub-HTCHECK2) shown in FIG. 20.

More particularly, in FIG. 20, before step 1701 a step 1700 is added at which a judgement is made as to whether the content of the X register $X_R$ is the same as that of the Y register $Y_R$ or not. In other words, the key number LKKN of the 3rd note is compared with the key number CMLKN2 of the previous counter melody key number CMLKN2 to check whether its note information elements alone are the same with each other or not.

When the result of this judgement shows that the note information elements are the same, the 3rd note would become the same note as the previous counter melody tone so that the interval relation with the melody tone is checked at steps succeeding step 1701. When the result of check shows that the 3rd note has not a semi-tone difference relation with reference to the melody tone the program is transferred to the subroutine (Sub-CM900) after correcting the tone production range at step 1794, whereby a tone of the same note as the 3rd note would be produced as the new counter melody tone.

However, when the note information of the key number LKKN of the 3rd note and of the previous counter melody key number CMLKN2 do not coincide with each other, or the 3rd note has a semi-tone interval relation with reference to the melody tone the program is returned to the original subroutine (Sub-CM3rd ).

By the processings described above, when the content of the Z flag Z-FLG is "1", the 3rd note which is not of the same note as the previous counter melody tone or a 3rd note in a semi-tone difference relation with the melody tone is cancelled its title for the new counter melody tone.

However, when the content of the Z flag Z FLG is "0", a 3rd note having an interval difference within major 2nd from the previous counter melody tone is entitled to be determined as the new counter melody tone so that the processings at steps 13951 through 13958 shown in FIG. 22 would be executed just in the same manner as above described.

Turning back to FIG. 22, at steps 13951 through 13958 at which a check is made as to whether the 3rd note is within major 2nd from the previous counter melody tone. First at step 13951 to the key number CMLKN2 of the previous counter melody key is added the value "+1" of the key number corresponding to a semi-tone, and the sum "CMLKN2+1" is stored in the Y register $Y_R$ as a consequence, a key number CMLKN1 of a tone, semi-tone above the previous counter melody tone can be obtained from the Y register $Y_R$.

In the subroutine "Sub-HTCHECK1" of the next step 13952, a check is made as to whether the note information elements of that key number CMLKN2' and of the key number LKKN2 of the 3rd note are equal or not. In other word, a check is made as to whether a tone a semi-tone above the previous melody tone is the same as the 3rd note or not. Further a check is made as to whether the tone has a semi-tone difference from the melody tone or not.

When the result of check shows that a tone a semi-tone above the previous counter melody tone is of the same note as the 3rd note and has not a semi-tone interval relation from the melody tone, the 3rd note is in an interval range within major 2nd from the previous counter melody tone and not in a dissonant relation with the melody tone so that it can be determined as a new counter melody tone. Thus, the program is transferred to the subroutine (Sub-CM900) after the processing of correcting the tone production range with the result that a tone of the same note as the 3rd note would be produced as the new counter melody tone.

However, when a tone a semi-tone above the previous counter melody tone is not of the same note at the 3rd note, or has a semi-tone difference from the melody tone, at the next step 13953, a key number "1" corresponding to a semi-tone is subtracted from the key number CMLKN2 of the previous counter melody tone and the difference is stored in the Y register $Y_R$. Thus, a key number CMLKN2' of a tone a semi-tone below the previous counter key melody tone can be obtained from the Y register $Y_R$.

In the same manner as above described, in the subroutine (Sub-HTCHE) of the next step 13954, a check is made whether a tone a semi-tone below the previous counter melody tone is the same as the 3rd note and whether the tone has a semi-tone difference relation with the melody tone or not based or the key number CMLKN2' representing a tone a semi-tone below the previous counter melody tone and the key number LKKN representing the 3rd note.

Consequently, when a tone a semi-tone below the previous counter melody tone is of the same note as the third note and not in an interval relation of a semi-tone difference from the melody tone, the 3rd note is in an interval range within major second from the previous counter melody tone so that it can be determined as the new counter melody tone.

However, when a tone a semi-tone below the previous melody tone is not of the same note as the 3rd tone, or in a semi-tone difference relation from the melody tone, in the next step 13955 the value "2" of the key number corresponding to the whole tone is added to the key number CMLKN2 of the previous counter melody key number for the purpose of checking whether a tone a whole tone above the previous counter melody tone is of the same note as the 3rd note or not. In the subroutine Sub-HTCHECK1 of the next step 13956, a similar check is made.

When the result of check shows that a tone a whole tone above the previous melody tone is of the same note as the 3rd note, and not in a semi-tone difference relation from the melody tone, the third note would be determined as the new counter melody tone. However, when this condition does not hold, at the next step 13957, a key number "2" corresponding to the whole tone is subtracted from the previous counter melody key number CMLKN2. Then, in the same manner as above described at the next step 13958, the relation between a tone a whole tone below the previous counter melody tone and the 3rd note is checked.

When the result of the check shows that the note a whole tone below the previous counter melody tone is of the same note as the 3rd note and not in a dissonant relation with respect to the melody tone, the 3rd note is judged as a note within major 2nd of the previous counter melody tone and would be determined as the new counter melody tone. However when the condition described above does not hold, the title of the 3rd note that can be determined as the new counter melody tone is cancelled so that the program is returned to the original subroutine. After that, a check is made whether a chord constituting tone of the next order of priority can be determined as the counter melody tone.

The foregoing description relates to a check whether a tone of the same note as the 3rd note can be determined as the new counter melody tone or not, but the 5th , 7th and root notes can be processed in the same manner. However, in the case of the 5th note, at the step 13945B shown in FIG. 22, the increment ΔKN of the key number of the 5th is read out, whereas in the case of the 7th note, at step 13945C, the increment ΔKN of the key number of the 7th note is read out. Further in the case of the root note, the procedure is different in that at step 13945C, a key number "0" is set in the X register $X_R$.

Consequently, it would be unnecessary to describe subroutines (Sub-CM 5th) (Sub-CM 7th) and (Sub-CM Root).

A subroutine (Sub-MEL 3/6) in which a check is made as to whether a chord constituting tone having 3rd or 6th relation with reference to the melody tone can be determined as the new counter melody tone will now be described with reference to a flow chart shown in FIG. 23.

In FIG. 23, at step 13960, the key number CMLKN2 of the previous counter melody is set in the Y register $Y_R$ for the purpose of checking whether there is a chord constituting tone having a zero interval with respect to the previous melody tone and whether the chord constituting tone has a 3rd or 6th relation with the melody tone.

Then at step 13961, a check is made as to whether a chord constituting tone shown by the content of the Y register $Y_R$ is produced or not and whether the chord constituting tone has a 3rd or 6th relation with the melody tone or not. When the result of check shows that a chord constituting tone having a zero interval from the previous counter melody tone (that is the same tone as the previous counter melody tone) is produced and that this chord constituting tone has a 3rd or 6th relation with the melody tone which is a tone of the same note would be determined as the new counter melody tone. In the subroutine (Sub-3/6 CHECK) of the step 13961 the tone production region is corrected and the program is advanced to the processing of subroutine (Sub-CM900). More particularly, when the chord consituting tone having a 3rd or 6th relation with the melody tone is of the same note. The previous counter melody tone, a counter melody tone of the same note as the previous counter melody tone would be produced continuously.

Figure 24:
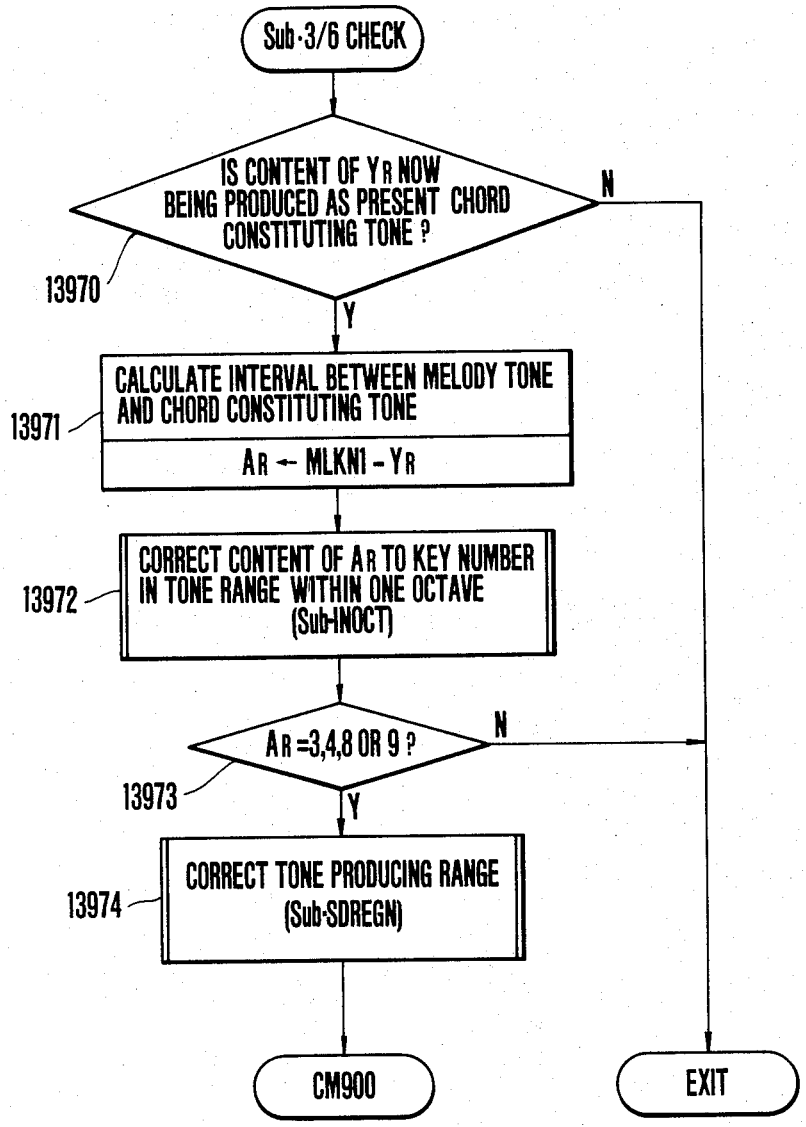

FIG. 24 shows a detailed flow chart of the subroutine (Sub-3/6 CHECK) in which these checks are made.

In FIG. 24, at step 13970 a judgement is made as to whether a tone represented by the content of the Y register $Y_R$ is now being produced as the present chord constituting tone or not. This judgement is made by sequentially comparing the key number of a tone having a zero interval difference from the previous counter melody tone stored in the Y register $Y_R$ with the key numbers LKKNI through LKKNV stored in the chord constituting tone key number register $LKKNI_R$ through $LKKNV_R$.

When the result of judgement shows that the chord constituting tone has a zero interval difference from the previous counter melody tone, at the next step 13971, the key number stored in the Y register $Y_R$ is subtrated from the key number MLKN1 for calculating an interval between the melody tone and a chord constituting tone having a zero interval difference from the previous counter melody tone, and the difference. The calculated is stored in the A register $A_R$.

Then in the subroutine (Sub-INOCT) of succeeding step 13972, the content of the A register $A_R$ is corrected to the key number in the tone range within than one octave. More particularly, the value of the key number representing the interval between the melody tone and a chord constituting tone having a zero interval from the previous counter melody tone is corrected to the key number in a tone range within one octave, and the result of correction is stored in the A register $A_R$.

By this processing the value of the key number representing the interval of the two tones becomes in a range of from 0 through 11.

In the next step 13973, a judgement is made whether the content of the A register $A_R$ corresponds to either one of "3", "4", "8" and "9". Thus, when the two tones have a minor 3rd relation, the difference in the key numbers of these two tones would become "3", and in the case of a major 3rd relation would become "4", whereas in the case of a major 6th relation would become "9". Consequently, when the content of the A register $A_R$ is either one of "3", "4", "8" and "9", a chord constituting tone having a zero interval from the previous counter melody tone and the melody tone would have a 3rd or 6th interval relation.

When the result of judgement shows that a chord constituting tone having a zero interval difference from the previous counter melody tone has a third or 6th relation with the melody tone, a tone of the same note as this constituting tone would be determined as the new counter melody tone. A key number CMLKN1 representing this new counter melody tone is corrected to the tone production range G1 through G2 at step 13974. Thereafter the program is transferred to the subroutine (Sub-CM900).

However, when a chord constituting tone having a zero interval difference from the previous counter melody tone is not produced, or when the chord constituting tone is not in a relation of 3rd or 6th with reference to the melody tone, the program is returned to the original subroutine shown in FIG. 23. Then a check is made as to whether a chord constituting tone having a semi-tone interval from the new counter melody tone is actually produced or not, or whether the chord constituting tone has a 3rd or 6th interval relation with the melody tone or not.

To this end, at step 13962 of the subroutine (Sub-MEL 3/6) shown in FIG. 23, the value "1", of a semi-tone is added to the key number CMLKN2 of the previous counter melody tone, and the sum "CMLKN2+1" is stored in the Y register $Y_R$. Thus, the key number CMLKN2' of a tone which is a semi-tone interval above the counter melody tone can be obtained from the Y register $Y_R$.

Then in the subroutine (Sub-3/6 CHECK) of step 13963, a check is made as to whether a chord constituting tone of the same note as a tone which is a semi-tone above the previous counter melody tone is actually produced or not, or whether the chord constituting tone has a 3rd or 6th relation with reference to the melody tone or not, in the same manner as at the step 13961 described above.

When the result of the judgement shows that a chord constituting tone of the same note as a tone which is a semi-tone above the previous counter melody tone is being actually produced and has a 3rd or 6th interval relation from the melody tone, a tone of the same note as this chord constituting tone would be determined as the new counter melody tone. However, when the above described condition is not fulfilled, the program is advanced to the next step 13964 at which the key number CMLKN2' of a tone a semi-tone below the previous counter melody tone is calculated.

More particularly the key number "1" of a tone which is a semi-tone below is subtracted from the key number CMLKN2 of the previous counter melody tone to obtain the key number CMLKN2' of a tone a semi-tone below the previous counter melody tone, and this key number CMLKN2' is stored in the Y register $Y_R$.

Then in the same manner as at the aforementioned step 13961, at step 13965, a check is made as to whether a chord constituting tone of the same note as a tone a semi-tone below the previous counter melody tone is actually produced or not and whether it has a 3rd or 6th interval relation with the melody tone.

When the result of this judgement shows that the chord constituting tone of the same note as a tone which is a semi-tone below the previous counter melody tone is being produced and when it has a 3rd or 6th interval relation with the melody tone, a tone of the same note as this chord constituting tone would be determined as the new counter melody tone.

When the conditions described above are not satisfied, at the next step 13966, a key number "2" corresponding to the interval of the whole tone is added to the key number CMLKN2 of the previous counter melody tone to obtain the key number CMLKN2' of a tone whole tone above the previous counter melody tone. In the same manner as the step 13961 described above, at the next step 13967, a check is made as to whether a chord constituting tone of the same note as a tone whole tone above the previous counter melody tone is being produced or not and whether it has a 3rd or 6th interval relation with the melody tone or not.

When the result of judgement shows that the chord constituting tone of the same note as the tone whole tone below the previous counter melody tone is being produced and when it has a 3rd or 6th interval relation with the melody tone, a tone of the same note as this chord constituting tone would be determined as the new counter melody tone. However, when these conditions are not satisfied, in the same manner as above described at the next step 13968, the key number CMLKN2' of a tone whole tone below the previous counter melody tone is calculated.

In the same manner as at the step 13961 described above, at the next step 13969 a check is made whether a tone of the same note as a tone whole tone below the previous counter melody tone is being produced or not and whether the tone has a 3rd or 6th interval relation with the melody tone or not.

When the result of the check shows that a chord constituting tone of the same note as the tone whole tone above the previous counter melody tone is being produced and when this tone has a 3rd or 6th interval relation with the melody tone a tone of the same note as this chord constituting tone is determined as the new counter melody tone. However, when these conditions are not satisfied, the program is returned to the original subroutine shown in FIG. 21, and a check is made whether a chord constituting tone of the next order of priority can be determined as the new counter melody tone or not.

When a new counter melody tone can not be determined in the subroutines (Sub-CM 3rd), (Sub-CM 5th), (Sub-CM 7th), (Sub-CM Root) and (Sub-ML 3/6) described above, a new counter melody tone is determined in the subroutine (Sub-CMSAME) of step 13941 shown in FIG. 21.

Figure 25:
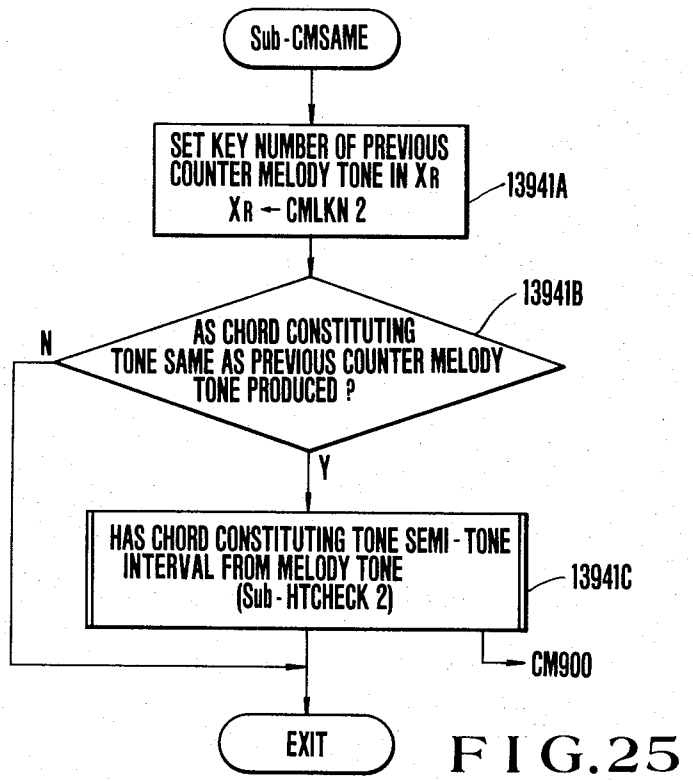
FIG. 25 is a flow chart showing the detail of a subroutine that determines a tone of the same note as a previous counter melody tone in FIG. 21 as a new counter melody tone.

FIG. 25 shows a detailed flow chart of the subroutine (Sub-CMSAME) in which at the first step 13941A, the key number CMLKN2 of the previous counter melody tone is set in the X register $X_R$. Then at the next step 13941B a check is made as to whether a chord constituting tone of the same note as the previous counter melody tone is being produced or not. This is performed by successively comparing the key number LKKNI through LKKNV stored in the chord constituting tone key number registers $LKKNI_R$ through $LKKNV_R$ with the key number CMLKN2 of the previous counter melody tone stored in the X register $X_R$.

When the result of this check shows that a chord constituting tone of the same note as the previous counter melody tone is being produced, in the subroutine (Sub HTCHECK2) of the next step 13941C a check is made whether the chord constituting tone is in a dissonant relation of a semi-tone difference with the melody tone or not. When the result of check shows that the chord constituting tone of the same note as the previous counter melody tone is not in the dissonant relation of a semi-tone difference with the melody tone a tone of the same note as this chord constituting tone would be determined as the new counter melody tone. The key number CMLKN1 representing this new counter melody tone is corrected in the tone production range G1 through G2 at the step 13941C and the program is transferred to the subroutine (Sub-CM900).

However, when a chord constituting tone of the same note as the previous counter melody tone is not produced or when the chord constituting tone is in a dissonant relation of a semi-tone difference with respect is the melody tone, the program is returned to the original subroutine shown in FIG. 21 and at the next step 13942, a processing is executed for determining the new counter melody tone.

Figure 26:
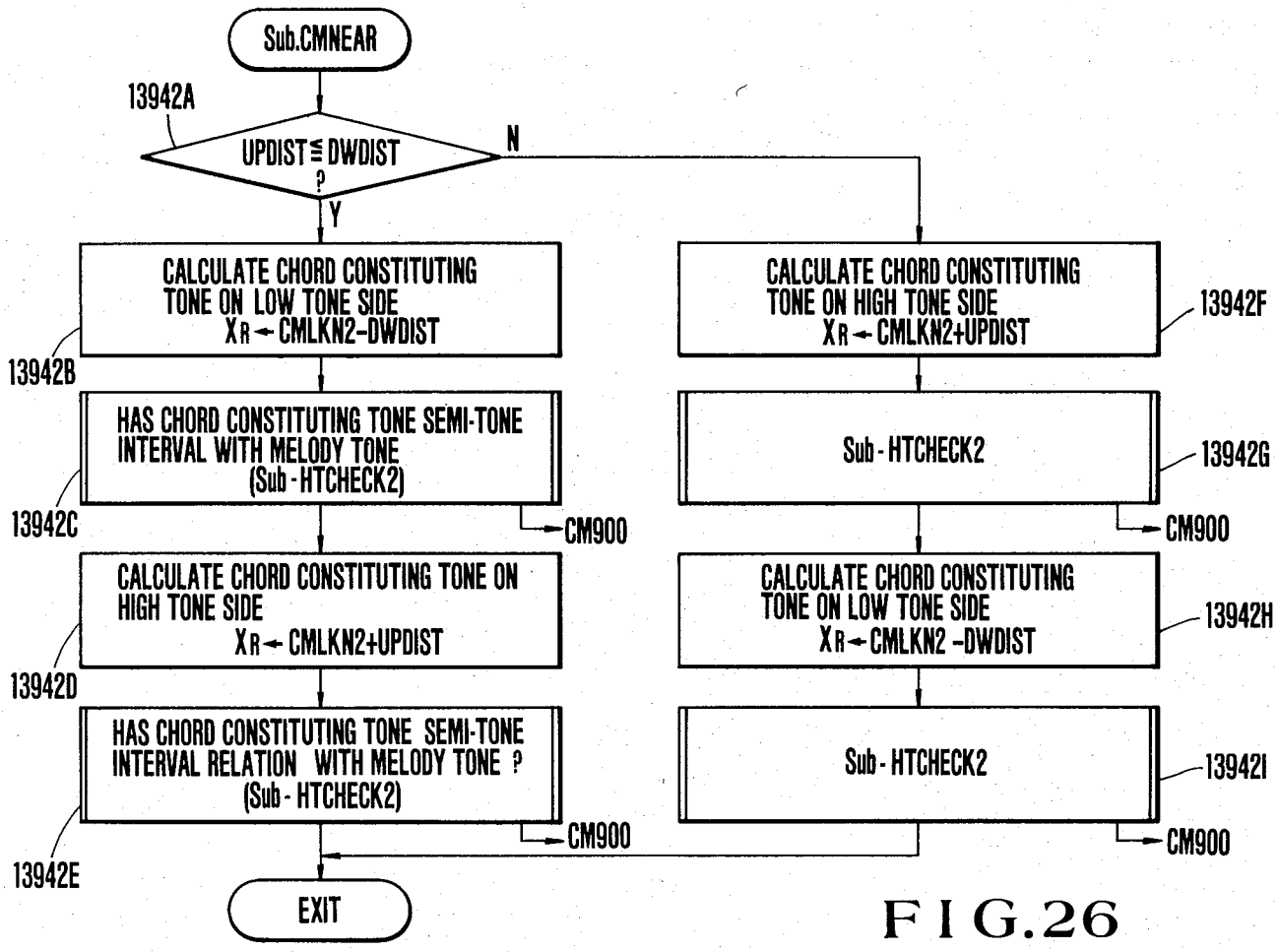
FIG. 26 is a flow chart showing the detail of a subroutine that determines a note tone same as a constituting tone having an interval closest to a previous counter melody tone in FIG. 21 as a new counter melody tone.

FIG. 26 is a flow chart showing the detail of the subroutine (Sub-CMNEAR) in which a tone of the same note as a chord constituting tone having the closest interval from the previous counter melody tone is determined as the new counter melody tone.

In FIG. 26, at step 13942A, a check is made as to whether the previous counter melody tone is close to a chord constituting tone on the high tone side among the present chord constituting tones or not, or close to a chord constituting tone on the low tone side or not. This judgement is made by comparing the up distance UPDIST calculated at step 127 shown in FIG. 4 with the down distance DWDIST. Where the UPDIST is equal to the DWDIST, it is judged that the previous melody tone is closs to the chord consituting tone, whereas when UPDICT<DWDIST, it is judged that the previous counter melody tone is close to a chord constituting tone on the high tone side.

When the previous counter melody tone is close to a chord constituting tone on the low tone side, the processings of the steps 13942B through 13942E are executed so as to determined the chord constituting tone on the low tone side as the new counter melody tone provided that this chord constituting tone is not in the semi-tone interval relation with the melody tone. However, when the previous melody tone has a semi-tone interval with respect to the melody tone, it is determined as the new counter melody tone provided that the chord constituting tone on the high tone side is not in the semi-tone difference relation with the melody tone.

More particularly at step 13942B, the key number LKKN of the chord constituting tone on the low tone side is determined by subtracting the data (key number) of the down distance DWDIST from the previous counter melody key number CMLKN2. The difference thus calculated is temporarily stored in the X register $X_R$. Then in the subroutine (Sub-HTCHECK) of the next step 13942C, a check is made as to whether the chord constituting tone on the low tone side has a semi-tone interval relation with the melody tone or not.

When the result of check shows that the note of the chord constituting tone on the low tone side has a semi-tone difference relation with the note of the melody tone, a tone of the same note as this chord constituting tone would be determined as the new counter melody tone. The key number CMLKN1 representing this new counter melody tone is corrected to the tone production range of G1 through G2 by the processing executed at step 13942C (see FIG. 20), and the program is transferred to the subroutine (sub-CM900).

However, when the note of the chord constituting tone on the low tone side has a semi-tone interval relation with the note of the melody tone, at the next step 13942D, the previous counter melody key number CMLKN2 is added to the data (key number) of the up distance UPDIST so as to determine the key number LKKN of the chord constituting tone on the high tone side and the sum is sorted in the X register $X_R$.

In the subroutine (Sub-HTCHECK2) of the next step 13942E, a check is made whether the chord constituting tone on the high tone side is in a semi-tone interval relation with respect to the melody tone or not. When the result of this check shows that the note of the chord constituting tone on the high tone side is not in a semi-tone relation with the melody tone, a tone of the same note as this chord constituting tone would be determined as the new counter melody tone. However, when the note of the chord constituting tone is in a semi-tone difference relation with the melody tone it is judged that an optimum counter melody tone can not be determined, and the program is returned to the subroutine (Sub-CMEL) shown in FIG. 4.

On the other hand, when the previous counter melody tone is close to a chord constituting tone, at steps 13942F through 13942I a new counter melody tone is determined in the same manner as above described.

More particularly, at step 13942F, the key number LKKN of the chord constiruting tone on the high tone side is determined by adding together the previous counter melody key number CMLKN2 and the data of the up distance UPDIST. Then in the subroutine (Sub-HTCHECK2) of the next step 13942G a check is made as to whether the chord constituting tone on the high tone side is in a semi-tone interval relation with the melody tone or not.

When the result of this check shows that the note of the chord constituting tone on the high tone side is not in the semi-tone relation with the note of the melody tone, a tone of the same note as this chord constituting tone would be determined as the key number CMLKN1 representing the new counter melody tone. After correcting this key number CMLKN1 to the tone production range of G1 through G2 by the processing at step 13942G (see FIG. 20), the program is transferred to the processing of subroutie (Sub-CM900).

However, when the note of the chord constituting tone on the high tone side has a semi-tone interval relation with the note of the melody tone, at the next step 13942H, the data (key number) of the down distance DWDIST is added to the previous counter melody key number CMLKN2, to obtain the key number LKKN of the chord constituting tone on the low tone side and the sum is temporarily stored in the X register $X_R$.

Then in the subroutine (Sub-HTCHECK2) of the next step 13942I, a check is made as to whether the chord constituting tone on the low tone side has a semi-tone interval relation with the melody tone or not.

When the result of this check shows that the note of the chord constituting tone on the low tone side is not in a semi-tone difference relation with the note of the melody tone, a tone of the same note as this chord constituting tone would be determined as the new counter melody tone. However, when the note of the chord constituting tone on the low tone side has a semi-tone difference with the melody tone, it is judged that no optimum counter melody tone can be determined, and the program is returned to the (subroutine Sub-CMEL) shown in FIG. 4.

Where the up distance UPDIST is equal to the down distance DWDIST, according to the judgement at step 13942A, the processings succeeding to the step 13942B are executed, so that a tone of the same note as the chord constituting tone on the low tone side will preferentially be determined as the new counter melody tone.

For example, in a musical score as shown in FIG. 11, where the note of the counter melody tone at a time when a C major chord of the second measure is designated is G (so), the note of the counter melody tone when the chord of the subsequent G major is designated becomes A, while the note of the counter melody tone when a next C major chord is designated becomes G.

More particularly, when the G major chord is designated, a tone that can be made as a new counter melody tone is selected according to the order of priority of the 3rd, 3/6, 3rd, 7th and root tones. If at this time, there are the constituting tones of notes F(fa), A(la) and C(do), it is clear that there are two chord constituting tones of notes F and A within major 2nd of the previous counter melody tone of note G. In this case, while the melody tone of note D has a minor 3rd relation with respect to the chord constituting tone of the note F, it is spaced from the previous counter melody tone of note G by more than major 2nd. Thus, a tone A at the third order of priority will be finally determined as the new counter melody tone.

As the C major chord is thereafter designated, when there are all chord constituting tones of notes C(do), E(mi), and G(so), there is only the chord constituting tone of note G within major 2nd of the previous counter melody tone of note A. In this case, although the chord constituting tone of note E is in a major 3rd relation with the note C melody tone, it is note within major 2nd of the previous counter melody tone. For this reason, a tone of note G at the forth order of priority would be finally determined as the new counter melody tone.

Chapter 6. Detail of the Subroutine (Sub-CM500)

As the type of the chord is changed, and when the tone pitch variation of the counter melody tone is increased, the flow of the music becomes unstable. In this subroutine (Sub-CM500) when the chord has changed and when no melody tone is produced, the previous melody tone is corrected with a tone pitch variation width within major 2nd so as to determine the corrected previous counter melody tone as the new counter melody tone, whereby a counter melody tone having a small pitch variation is determined.

Figure 27:
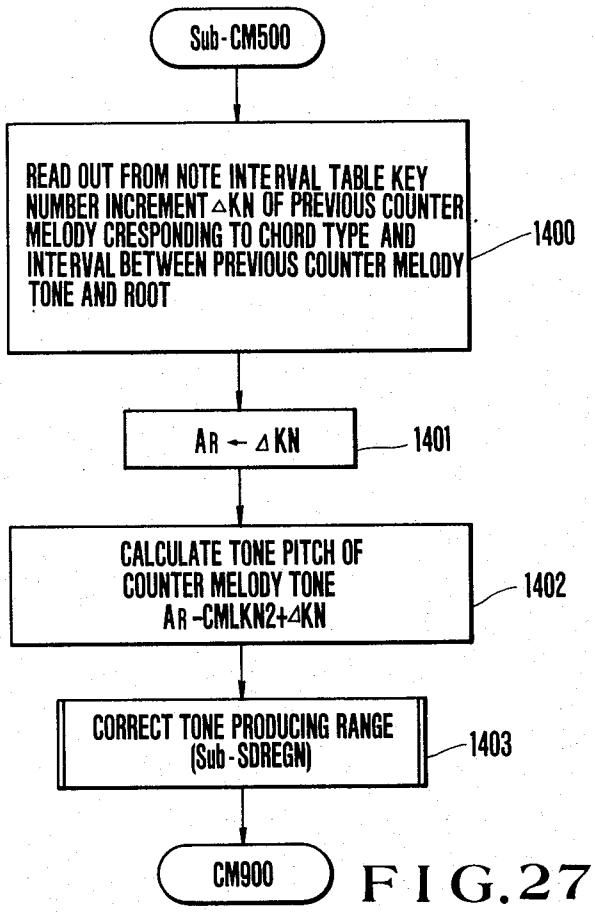
FIG. 27 is a flow chart showing the detail of a subroutine for determining a counter melody tone when the type of the chord changes and a melody tone is not produced.

FIG. 27 is a detailed flow chart of the subroutine (Sub-CM500) in which steps 1400 through 1403 are started after the judgement of step 133 shown in FIG. 4 has been made and when no melody tone is produced.

In FIG. 27, at step 1400, the increment ΔKN of the previous counter melody key number CMLKN2 corresponding to the chord type CDTP and the spacing CMLVSC between the previous counter melody tone and the root note is read out from a note difference Table XIV.

TABLE XIV (Note difference table)

| CDTP | CMLVSC 0 | 1 | 2 | 3 | 4 | 5 | 6 | 7 | 8 | 9 | A | B |
|---|---|---|---|---|---|---|---|---|---|---|---|---|
| M | 0 | −1 | 2 | 1 | 0 | −1 | 1 | 0 | −1 | −2 | 2 | 1 |
| 7 | −2 | −1 | 2 | 1 | 0 | −1 | 1 | 0 | −1 | 1 | 0 | −1 |
| 6 | 0 | −1 | 2 | 1 | 0 | −1 | 1 | 0 | 1 | 0 | −1 | 1 |
| M7 | −1 | −1 | 2 | 1 | 0 | −1 | 1 | 0 | −1 | 2 | 1 | 0 |
| m | 0 | −1 | 1 | 0 | −1 | −2 | 1 | 0 | −1 | −2 | 2 | 1 |
| m7 | 0 | −1 | 1 | 0 | −1 | −2 | 1 | 0 | −1 | −2 | 0 | 1 |
| m7-5 | 0 | −1 | 1 | 0 | −1 | 1 | 0 | −1 | −2 | 1 | 0 | −1 |
| dim | 0 | −1 | 1 | 0 | −1 | 1 | 0 | 01 | 1 | 0 | −1 | 1 |
| Aug | 0 | −1 | 2 | 1 | 0 | −1 | 2 | 1 | 0 | 1 | −2 | 1 |

More particularly, in the note difference table provided for the constant memory device 20 is prestored with the increment ΔKN of the previous counter melody key number CMLKN2 in accordance with the chord type CDTP and the spacing CMLVSC between the previous counter melody tone and the root as shown in Table XIV.

Where the chord changes and no melody tone is produced, an address information corresponding to the chord type CDTP and the spacing CMLVSC between the previous counter melody tone and the root is applied to the note difference table for reading out the increment ΔKN of the key number CMLKN2 of the previous counter melody tone.

This increment ΔKN is stored in the A register $A_K$ at the next step 1401. Then at step 1402, this increment ΔKN is added to the key number CMKN2 of the previous counter melody tone, and the sum (CMLKN+ΔKN) is determined as the key number CMLKN1 of the new counter melody tone and stored in the A register $A_R$. Then the key number is corrected to the tone range of $G_1$ through $G_2$ in the tone range correction subroutine (Sub-SDREGN) of step 1403. The key number CMLKN1 of the counter melody tone whose tone production range has been corrected is converted into a corresponding key code KC in the subroutine (Sub-900) and then transferred to the counter melody buffer memory device 28.

As can be noted from the content of the note difference table shown in Table XIV, the maximum value of the increment ΔKN is "2". Consequently, the new counter melody tone has a variation width of a maximum or within 2nd with respect to the previous counter melody tone, with the result that a counter melody tone of a small variation width can be produced.

For example, assume now that the note of the previous counter melody tone is D (re) and that the new chord is a C minor 7th (CM7), the spacing CMLVSC between the previous melody tone and the root becomes "2" so that the increment ΔKN="2" is read out from the note difference Table XIV. In this manner, a note E (mi) is determined as the new counter melody tone.

Chapter 7, Detail of the Subroutine (Sub-CM700)

In a case where a chord is designated but a normal chord code is not established, it is advantageous not to make too large the tone pitch variation width from the previous counter melody tone. To this end, in the subroutine (Sub-CM700), one of the chord constituting tone closest to the previous counter melody tone would be determined as the new counter melody tone.

A state in which the designated chord does not hold as a normal chord code also occurs at the beginning of a music, so that in this subroutine (Sub-CM700) one of the chord constituting tones closest to the previous counter melody tone would be determined as the new counter melody tone.

The state in which the designated chord does not hold as the normal chord code also occurs at the beginning of the music. In such a case, in the subroutine (Sub-CM700), after assuming that the previous counter melody tone as a $G_1$ note, a tone of the same note as this chord constituting tone is determined as the new counter melody tone if the number of the chord constituting tone designated as this time is one, whereas when the number of the chord constituting tones is more than two, a tone of the same note as a chord constituting tone closest to the $G_1$ note would be determined as the new counter melody tone.

Figure 28:
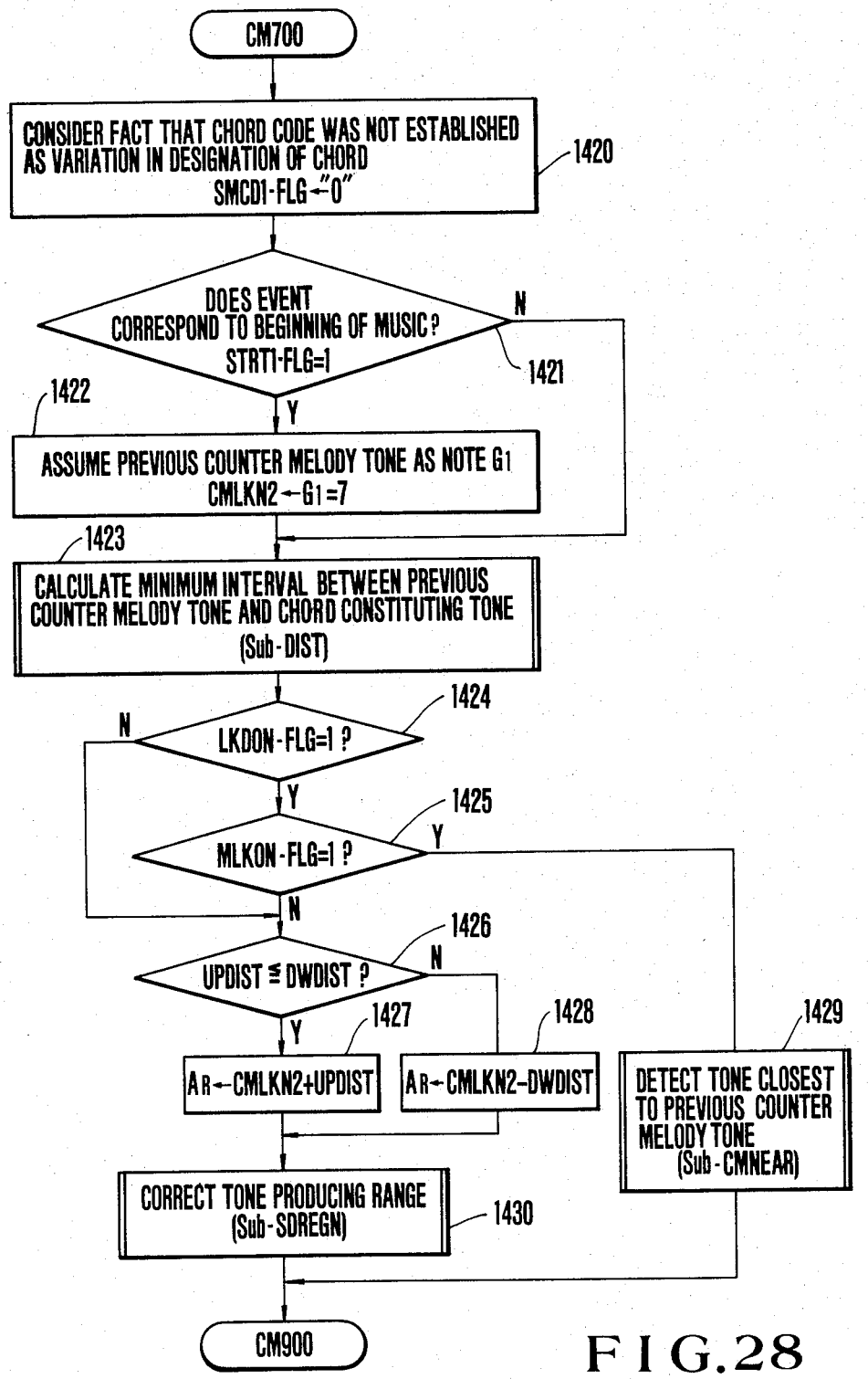
FIG. 28 is a flow chart showing the detail of a subroutine that determines a counter melody tone where a designated chord has not a normal construction.

FIG. 28 shows the detailed flow chord of the subroutine (Sub-CM700) in which steps 1420 through 1430 are executed when a chord is determined by the judgement executed at step 121 shown in FIG. 4 but the chord is not considered as a normal chord code.

At first, a processing of a case in which a chord designated at an intermediate portion of a music does not hold as a normal chord code will be described.

In such a case, at step 1420, the fact that the chord code was not established is taken as the variation in the designation of the chord and the first same code flag SMCD1-FLG is reset (logic "0").

Then at step 1421, a check is made as to whether the event corresponds to the beginning of a music or not according to the content of the start flag STRT1-FLG. When the result of this judgement shows that the event is a chord event at an intermediate point of the music, the program is jumped to step 1423, at which the shortest interval between the previous counter melody tone and the chord constituting tone, i.e., the up distance UPDIST and the down distance DWDIST are calculated. This calculation is made by using the subroutine Sub-DIST for the purpose of not utilizing step 127 shown in FIG. 4 where the chord code is not normal.

At the next step 1424, a check is made as to whether the number of the presently designated chord constituting tones is more than 2 or not according to the content of the plural chord key-on flag LKDON-FLG.

When the result of this judgement shows that the number of the chord constituting tones is more than 2 the program is branched to step 1425 at which a judgement is made as to whether a melody tone is now being produced or not according to the content of the melody key-on flag MLKON-FLG. When the result of the judgement shows that the melody tone is now being produced, the program is branched to step 1428 and in the subroutine (Sub-CMNEAR) of this step, a chord constituting tone having the shortest interval from the previous counter melody tone is detected so as to determine a new counter melody tone provided that the note of this chord constituting tone does not have a semitone difference relation with the note of the melody tone.

The subroutine (Sub-CMNEAR) is constructed such that, where the up distance UPDIST is equal to the down distance DWDIST, a chord constituting tone on the lower tone side than the previous counter melody tone is preferentially processed than a chord constituting tone on the higher tone side so as to determine a tone of the same note as the chord constituting tone on the lower tone side at a new counter melody tone However, when the number of the chord constituting tone is one or when no melody tone is produced the program is advanced from step 1424 to step 1426 or from step 1425 to step 1426 at which the up distance UPDIST is compared with the down distance DWDIST. When UPDIST≦DWDIST, at the next step 1427, the data (the key number) of the up distance UPDIST is added to the key number CMLKN2 of the previous counter melody tone, and the sum is stored in the A register $A_R$ as the key number CMLKNL of the new counter melody tone. This key number is corrected to the tone range of $G_1$ through $G_2$ in the subroutine (Sub-SDREGN) of the next step 1430. Then the program is transferred to subroutine (Sub-CM900).

In a case where UPDIST>DWDIST, at step 1428, the data (key number) of the down distance DWDIST is subtracted from the key number CMLKN2 of the previous counter melody tone, and the difference is stored in the A register $A_R$ as the key number CMLKN1 of the new counter melody tone. Thereafter, the program is transferred to step 1430.

In other words, when the number of the chord constituting tone is one, or when no melody tone is produced, a tone of the same note as a chord constituting tone having the shortest interval from the previous counter melody tone is determined as a new counter melody tone.

In this case, when the number of the chord constituting tone is one, or the intevral between the previous counter melody tone and a chord constituting tones on the high and low tone sides are equal, the up distance UPDIST becomes equal to the down distance DWDIST. In this case, however, since the program is branched to step 1428 according to the judgement of step 1426, a tone of the same note as the chord constituting tone on the low tone side would preferentially be determined at the new counter melody tone.

Where the number of the chord constituting tone is one, even when a melody tone is produced, the relation thereto is ignored.

When the chord code was not established as a normal one at the beginning of the music, at step 1421, a key number "7" corresponding to the $G_1$ note is set in the previous counter melody key number register $CMLKN2_R$. Thus it is considered that the previous counter melody tone was the $G_1$ note.

Thereafter, a new counter melody tone is determined by processings similar to those described hereinabove.

Thus where the designated chord was not established as a normal chord code, a tone of the same note as a chord constituting tone having the shortest interval from the previous counter melody tone is determined as the new counter melody tone, thus eliminating unnaturality in which production of the counter melody tone is interrupted during performance and enabling smooth variation of the counter melody tone.

As above described according to the embodiment of this invention, since the tone pitch of a root is corrected in accordance with the chord type and the corrected root note is determined as a new counter melody tone, it is possible to smoothly vary the counter melody tone.

When the keys of a melody tone following the designation operation of a chord are depressed within a predetermined time, it is considered that these operations are made at the same time so as to determine a counter melody tone, so that even when the key depression of the melody tone is delayed an optimum counter melody tone can be determined by taking into consideration a relation with reference to the melody tone.

Where the same chord is continuously designated, since a tone of the same note as a chord constituting tone having a 3rd or 6th interval from the previous counter melody tone by taking into consideration the previous counter melody tone and the present melody tone, it is possible to produce a counter melody tone having a large pitch variation width, thus imparting a variation to the flow of the music.

Where the designated chord is different from the previous chord, since a tone of the same note as one of a chord constituting tones within a major 2nd from the previous counter melody tone is determined as a new counter tone according to a predetermined order of priority it is possible to produce a counter melody tone having a small pitch variation width, thereby preventing unstability of the flow of the music.

Where a chord is designated but a normal chord code is not established, since a tone of the same note as a chord constituting tone having the shortest interval from the previous counter melody tone is determined as a new counter melody tone, it is possible to eliminate a unnaturality wherein the counter melody tone is interrupted during performance and to smoothly vary the counter melody tone.

Figure 29:
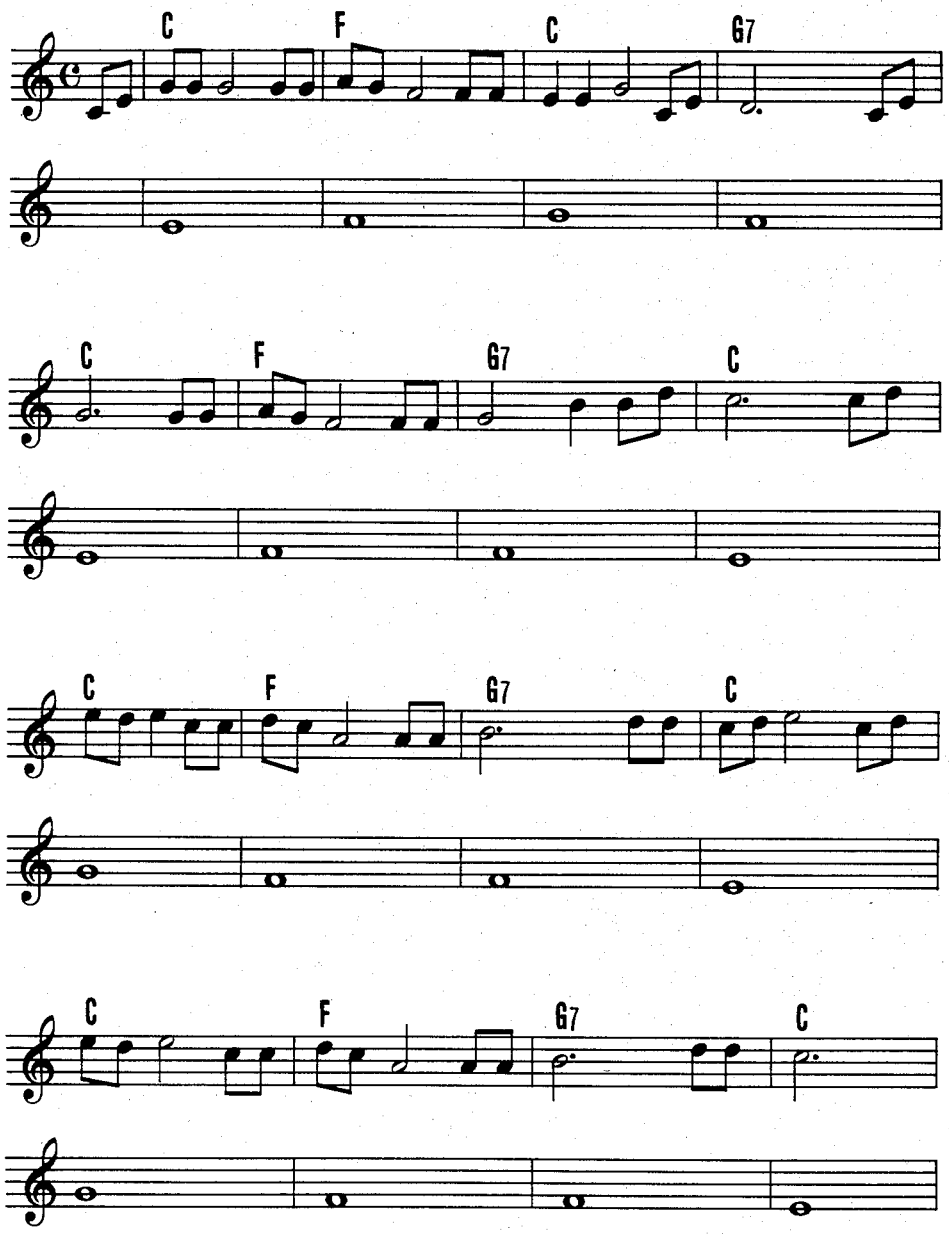
FIG. 29 shows a musical score for explaining one example of a counter melody tone determined by the embodiment shown herein.

For example, in the case of a music as shown by the musical score shown in FIG. 29, since a chord is not designated at the first measure, a counter melody tone would not be produced, but at the second measure a C major chord consisting of chord constituting tones of do, mi and so and when the keys of a melody tone of a note G (so) are depressed, a counter melody tone of a note E (mi) is determined in the subroutine (Sub-CM100). Thus, since the interval MVSC between the melody tone and the root is "7", an increment ΔKN=4 is read out from the root note pitch increment table (see Table IX). The tone pitch of the root note of the note C is corrected by this increment so as to determine a new counter melody tone of note E.

Then at the third measure, a F major chord consisting of fa, la and do is designated and when the keys of a note A melody tone are depressed, a note F (fa) counter melody tone is determined in the subroutine (Sub-CM600). Thus a chord constituting tone within major 2nd of the previous counter melody tone of note E comprises only note is a tone a major 3rd below a melody tone of note A, a tone of the same note as this note F chord constituting tone is determined as a new counter melody tone at the second order of priority.

Then at the fourth measure a C major chord consisting of chord constituting tones of do, mi and so is designated, and when the keys of a note E (mi) melody tone are depressed, a note E (mi) counter melody tone is determined in the subroutine (Sub-CM600). More particularly, while the chord constituting tones within major 2nd of the note F previous counter melody tone are two tones of notes E and G, since the order of priority of note G having 6th relation with the melody tone is high, a new counter melody tone of note G is determined.

Then at the fifth measure, a $G_7$ note consisting of a chord consisting tones of so, si, re and fa is designated and when the keys of a note D melody tone are depressed, a note F (fa) counter melody tone is determined in the subroutine (Sub-CM600). Thus, since the chord constituting tones within major 2nd from the note G previous counter melody tone are notes F and $G_1$, a F tone is 6th relation with a melody tone corresponding to the fourth order of priority is determined as a new counter melody tone.

In the same manner, also at the 6th through 9th measures of the second stage, a counter melody tone of notes E, F, F, E is determined in the subroutine.

However, at the 10th measure of the third stage, as a C measure chord continuous device, a new counter melody tone would be determined in the subroutine (Sub-CM400). In this case, the new counter melody tone comprises a tone of note G.

In the same manner, at the succeeding 11th through 17th measures, a counter melody tone comprising tones of notes F, F, E, G, F, F, E is determined.

Although in the above described embodiment, an accompaniment lower keyboard was used as designating means of a chord, a chord selection button switch or the like can also be used.

The interval difference between a previous counter melody tone and a new counter melody tone is automatically designated by the processings of subroutine (Sub-CM600) and (Sub-CM500) or subroutine (Sub-CM400) and (Sub-CM200), so that the circuit can also be contracted such that data that can be determined as new counter melody tones are prestored in a memory device or the like and that a new counter melody tone can be determined by reading out the data according to the previous counter melody tone, a previous chord construction and a new chord construction.

Although in the foregoing embodiment, the production of a counter melody tone was inhibited when the chord performance keys are not depressed by detecting a state "1" of the LKKON-FLG (see FIG. 4, 121), by adding a performance storing the depressed states of the chord performance keys, the production of the counter melody tone can be continued even after the chord performance keys have been released.

Thus, when a memory performance is selected, until the chord performance keys are newly depressed, informations regarding chord performance keys (chord constituting tone key number LKKN I-V, root note key number CDRT1, CDRT2, code types CDTP1, CDTP2, chord key-on flag LKKON-FLG, etc.) can be held in respective registers without any alternation, thereby enabling to maintain depressed states of imaginary chord performance keys, whereby even after the release of the chord performance keys, a counter melody tone can be produced based on the previously depressed chord performance keys.

As above described according to the electronic musical instrument of this invention, the tone pitch variation width of a counter melody tone determined by the variation of the chord is varied in accordance with whether the previous chord and the new chord are the same or not. Accordingly, it is possible to perform a counter melody tone in consonance with a melody tone and can vary the musical effect in accordance with the flow of the melody tone.

What is claimed is:

1. An electronic musical instrument comprising:
chord designating means for designating a chord;
chord type detecting means for detecting a chord type of said chord;
chord designation detecting means for detecting the fact that said chord has been designated;
tone selecting means for selecting, in response to the detection of said fact, one from among a group of tones in priority order determined by said chord type, said group comprising the chord constituting tones of said chord; and
tone producing means connected to said chord designating means and said tone selecting means for producing a chord tone and a supplemental tone corresponding to said chord and said selected tone respectively.

2. An electronic musical instrument according to claim 1 wherein said tone selecting means further comprises:
memory means for storing the information of a last supplemental tone; and
limiting means for limiting said tones of said group to tones within a predetermined interval of the tone corresponding to said information, so that said supplemental tone is within said predetermined interval of said tone corresponding to said information.

3. An electronic musical instrument according to claim 1 which further comprises melody tone designating means for designating a melody note, and wherein said group further comprises a tone a predetermined interval distant from said melody tone and said tone producing means further produces a melody tone corresponding to said melody note.

4. An electronic musical instrument according to claim 3 wherein said predetermined interval is 3rd degree.

5. An electronic musical instrument according to claim 1 which further comprises melody tone designating means for designating a melody tone, and wherein said tone selecting means which comprises correction information generating means for generating correction information in accordance with said melody tone, a reference tone among said chord constituting tones and said chord type, said priority order being determined by said correction information and said reference tone.

6. An electronic musical instrument according to claim 3 which further comprises:
measuring means for measuring time from the designation of said chord to that of said melody note; and
designating means for designating to determine a new supplemental tone to said tone selecting means in place of said supplemental tone only when said measured time is within a predetermined time.

7. An electronic musical instrument according to claim 1 which further comprises:
melody tone designating means for designating a melody tone; and
preventing means for preventing the production of said supplemental tone when said selected tone is a semi-tone distant from said melody tone.

8. An electronic musical instrument according to claim 3 wherein said predetermined interval is 6th degree.

9. An electronic musical instrument comprising:

a chord designating means for designating a chord;

chord variation detecting means which comprises memory means for storing a previous chord designated by said chord designating means and coincidence detecting means detecting whether said previous chord and a newly designated chord are the same or not;

supplemental tone determining means for determining a supplemental tone, said supplemental tone determining means comprising memory means for storing a last supplemental tone and tone selecting means for selecting one within the interval determined by the detection result of said chord variation detecting means of said last supplemental tone from among a group of tones relating to said chord; and tone producing means connected to said chord designation means and said supplemental tone determining means for producing a chord tone and a present supplemental tone corresponding to said chord and said selected tone.

10. An electronic musical instrument according to claim 9 wherein said interval is major 2nd when the previously and newly designated chords are different.

11. An electronic musical instrument according to claim 9 wherein said interval is different in accordance with whether said previously and newly designated chords are the same or not.

12. An electronic musical instrument according to claim 9 which further comprises melody tone designating means for designating a melody tone, and wherein said group further comprises said melody note and said tone production means further produces a melody tone corresponding to siad melody note.

13. An electronic musical instrument comprising:

chord designating means for designating a chord;

melody note designating means for disignating a melody note;

chord designation detecting means for detecting the fact that said chord has been designated;

tone selecting means for selecting, in response to the detection of said fact, one from among a group of tones, said group comprising the chord constituting tones of said chord and a tone a predetermined interval distant from said melody note; and tone producing means for producing a chord tone, a melody tone and a supplemental tone for producing a chord tone, a melody tone and a supplemental tone corresponding to sid chord, said melody note and said selected tone respectively.

14. An electronic musical instrument according to claim 13 wherein said predetermined interval is 3rd degree.

15. An electronic musical instrument according to claim 13 wherein said predetermined enterval is 6th degree.

16. An electronic musical instrument comprising:

chord designating means for designating a chord chord designation detecting means for detecting the fact that a chord has been designated;

supplemental tone determining means for determining means for determining a supplemental tone;

memory means for storing a previous supplemental tone, correction information forming means for forming correction information based on said previous supplemental tone and said chord, said supplemental tone determining means determining said supplemental tone in accordance with said previous supplemental tone and said correction information; and tone producing means for producing a chord tone and a musical tone corresponding to said chord and said supplemental tone respectively.

* * * * *